US011591832B2

(12) United States Patent
Kajigai et al.

(10) Patent No.: US 11,591,832 B2
(45) Date of Patent: Feb. 28, 2023

(54) VEHICLE DOOR LOCK DEVICE

(71) Applicant: AISIN CORPORATION, Kariya (JP)

(72) Inventors: Naoki Kajigai, Kariya (JP); Yasuaki Tanino, Kariya (JP); Kazunori Kojima, Kariya (JP); Takumi Hayashi, Kariya (JP); Yasuhiko Sono, Kariya (JP)

(73) Assignee: AISIN CORPORATION, Aichi (JP)

( * ) Notice: Subject to any disclaimer, the term of this patent is extended or adjusted under 35 U.S.C. 154(b) by 307 days.

(21) Appl. No.: 16/727,250

(22) Filed: Dec. 26, 2019

(65) Prior Publication Data

US 2020/0208444 A1 Jul. 2, 2020

(30) Foreign Application Priority Data

Dec. 26, 2018 (JP) ..... JP2018-242137

(51) Int. Cl.
*E05B 85/26* (2014.01)
*E05B 85/24* (2014.01)

(52) U.S. Cl.
CPC ..... *E05B 85/26* (2013.01); *E05B 85/243* (2013.01)

(58) Field of Classification Search
CPC ..... E05B 85/20; E05B 85/24; E05B 85/243; E05B 85/26; E05B 83/36; Y10T 292/1047; Y10T 292/1082; Y10S 292/23
See application file for complete search history.

(56) References Cited

U.S. PATENT DOCUMENTS 5,979,951 A * 11/1999 Shimura ..... E05B 83/40 292/216
6,848,727 B1 * 2/2005 Cetnar ..... E05B 81/20 292/216

(Continued)

FOREIGN PATENT DOCUMENTS

DE 102009046880 A1 * 5/2011 ..... E05B 77/04
JP H04-014666 U 2/1992

(Continued)

OTHER PUBLICATIONS

Office Action (Notice of Reasons for Refusal) dated Aug. 23, 2022, by the Japan Patent Office in corresponding Japanese Patent Application No. 2018-242137 and an English Translation of the Office Action. (8 pages).

*Primary Examiner* — Kristina R Fulton
*Assistant Examiner* — Noah Horowitz
(74) *Attorney, Agent, or Firm* — Buchanan Ingersoll & Rooney PC

(57) ABSTRACT

A vehicle door lock device includes: a latch that has a full latch claw portion and a half latch claw portion, engages with a striker attached to a vehicle body during a closing operation of a vehicle door, is rotatable between an unlatch position and a full latch position, and rotates from the unlatch position to the full latch position; a pawl that is rotatable between an engagement position and a disengagement position, is pressed by the full latch claw portion to rotate in a direction from the engagement position toward the disengagement position, and engages with the full latch claw portion by rotating from the disengagement position to the engagement position; a block lever that is rotatable between a restriction position and a non-restriction position; and a half latch lever that is rotatable between an operation position, and a non-operation position.

15 Claims, 35 Drawing Sheets

(56) References Cited

U.S. PATENT DOCUMENTS

| | | | | |
|---|---|---|---|---|
| 8,480,138 | B2 * | 7/2013 | Bendel | E05B 77/36 292/216 |
| 8,955,889 | B2 * | 2/2015 | Bendel | E05B 81/20 292/201 |
| 9,611,677 | B2 * | 4/2017 | Bendel | E05B 79/08 |
| 9,617,761 | B2 * | 4/2017 | Scholz | E05B 85/26 |
| 9,777,517 | B2 * | 10/2017 | Scholz | E05B 85/26 |
| 10,808,437 | B2 * | 10/2020 | Brickner | E05B 85/26 |
| 10,858,868 | B2 * | 12/2020 | Gotzen | E05B 79/10 |
| 11,015,375 | B2 * | 5/2021 | Lebsak | E05B 85/26 |
| 2014/0291998 | A1 | 10/2014 | Pettengill et al. | |
| 2019/0085601 | A1 | 3/2019 | Kojima et al. | |
| 2021/0230911 | A1 * | 7/2021 | Weichsel | E05B 81/14 |

FOREIGN PATENT DOCUMENTS

| | | | | |
|---|---|---|---|---|
| JP | H04-297685 | A | 10/1992 | |
| JP | 2015-511669 | A | 4/2015 | |
| JP | 2019052501 | A | 4/2019 | |
| WO | 2013/057590 | A2 | 4/2013 | |
| WO | WO-2016206665 | A1 * | 12/2016 | E05B 81/15 |

* cited by examiner

VEHICLE DOOR LOCK DEVICE

CROSS REFERENCE TO RELATED APPLICATIONS

This application is based on and claims priority under 35 U.S.C. § 119 to Japanese Patent Application 2018-242137, filed on Dec. 26, 2018, the entire contents of which are incorporated herein by reference.

TECHNICAL FIELD

This disclosure relates to a vehicle door lock device.

BACKGROUND DISCUSSION

A vehicle door lock device generally includes a latch and a pawl, and is configured to prevent opening of a vehicle door by causing the pawl to restrict rotation of the latch engaging with a striker attached to a vehicle body side. However, when the pawl restricts the rotation of the latch, it is conceivable that the restricted latch may be released after the pawl is rotated due to an input of an unexpected load. In order to prevent this disadvantage, a vehicle door lock device has been developed which includes a block lever for restricting the rotation of the pawl (for example, refer to US 2014/0291998A (Reference 1)).

In a case where the vehicle door lock device includes the latch, the pawl, and the block lever in order to prevent the opening of the vehicle door as disclosed in Reference 1, when the vehicle door is in a fully closed state, the pawl restricts the rotation of the latch, and the block lever restricts the rotation of the pawl. In this case, the pawl restricts the rotation of the latch at an engagement position where the pawl enters a rotation region of a full latch claw portion of the latch, and the block lever restricts the rotation of the pawl at a restriction position where the block lever enters a rotation region of the pawl. However, in some cases, due to a rotation delay of the pawl, the rotation may be restricted by the block lever before the pawl reaches a normal engagement position. In this case, there is a possibility that undesired engagement states may occur as follows.

One of the undesirable engagement states is as follows. The rotation of the latch is restricted at a rotation position before the pawl reaches the normal engagement position. The rotation of the pawl is restricted at the rotation position before the block lever reaches a normal restriction position. This engagement state is called a pseudo latch state. In a case of the pseudo latch state, an engagement force between the pawl and the latch and an engagement force between the block lever and the pawl are weak. Consequently, the latch and the pawl disengage from each other. Accordingly, there is a disadvantageous possibility that the vehicle door may be opened.

Another undesirable engagement state is as follows. The rotation of the pawl is restricted by the block lever when the rotation position of the pawl is retreated from the rotation region of the latch. This engagement state is called a completely fixed state. In this case, the rotation of the latch is restricted by the block lever at a position where the pawl is retreated from the rotation region of the latch. Accordingly, the rotation of the latch cannot be restricted by the pawl, thereby causing a disadvantage in that the vehicle door cannot be closed.

Thus, a need exists for a vehicle door lock device which is not susceptible to the drawback mentioned above.

SUMMARY

A vehicle door lock device according to an aspect of this disclosure includes a latch, a pawl, a block lever, and a half latch lever. The latch has a full latch claw portion and a half latch claw portion, engages with a striker attached to a vehicle body during a closing operation of a vehicle door, is rotatable between an unlatch position serving as a rotation position where the engaged striker is releasable and a full latch position serving as a rotation position where the striker is held not to be releasable, and rotates from the unlatch position to the full latch position by the engaged striker moving in response to the closing operation of the vehicle door. The pawl is rotatable between an engagement position serving as a rotation position where the pawl enters a rotation region of the full latch claw portion and a disengagement position serving as a rotation position where the pawl is retreated from the rotation region of the full latch claw portion, is pressed by the full latch claw portion to rotate in a direction from the engagement position toward the disengagement position when the latch rotates in a direction from the unlatch position to the full latch position, engages with the full latch claw portion of the latch located at the full latch position by rotating from the disengagement position to the engagement position after the pressing of the full latch claw portion is completed when the latch is located at the full latch position, thereby restricting the rotation of the latch in a direction toward the unlatch position. The block lever is rotatable between a restriction position serving as a rotation position where the block lever enters a rotation region of the pawl and a non-restriction position serving as a rotation position where the block lever is retreated from the rotation region of the pawl, is located at the non-restriction position when the pawl rotates in a direction from the engagement position toward the disengagement position, engages with the pawl located at the engagement position by rotating from the non-restriction position to the restriction position when the pawl is located at the engagement position by rotating from the disengagement position to the engagement position, thereby restricting the rotation of the pawl in a direction toward the disengagement position. The half latch lever is rotatable between an operation position inside an operation region serving as a rotation region for restricting the rotation of the latch in a direction toward the unlatch position by entering the rotation region of the half latch claw portion and engaging with the half latch claw portion when the latch is located at the half latch position serving as a rotation position for holding the striker not to be releasable, which is the rotation position between the unlatch position and the full latch position, and a non-operation position inside a non-operation region serving as a rotation region where the half latch lever is retreated from the rotation region of the half latch claw portion, and that is located at the operation position when the rotation position of the latch is located at the rotation position from the half latch position to the full latch position during the closing operation of the vehicle door.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments disclosed here will be described with reference to the drawings. A direction indicated by an arrow in each drawing represents a direction set based on a closed state vehicle door assembled to a vehicle.

Figure 1:
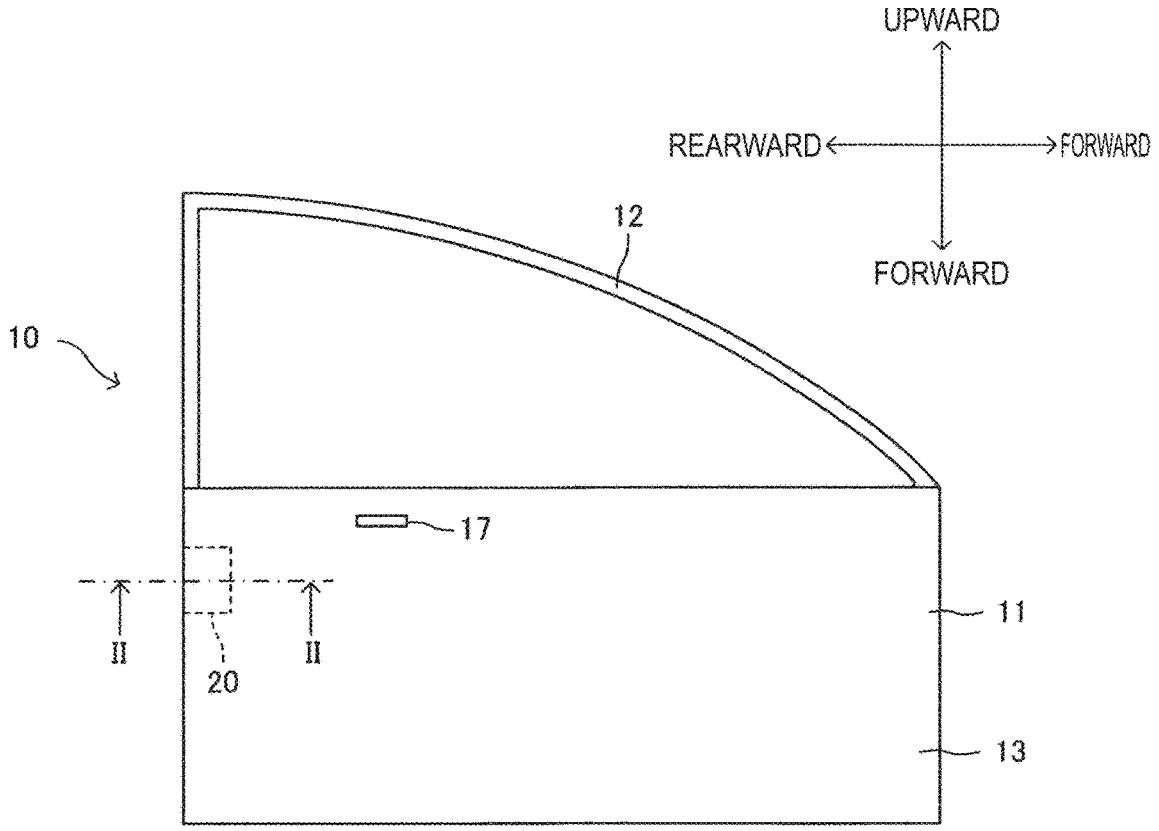
FIG. 1 is a view schematically illustrating a configuration example of a vehicle door.
Figure 2:
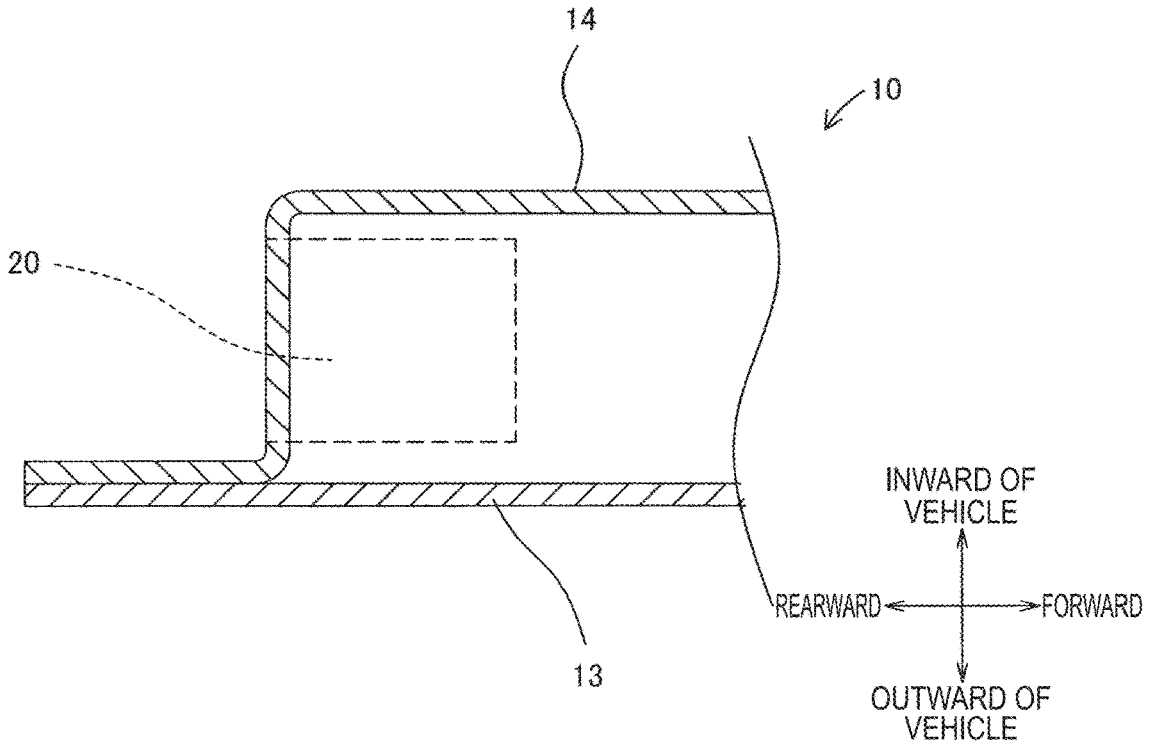
FIG. 2 is a sectional view taken along line II-II in FIG. 1.

FIG. 1 is a view schematically illustrating a configuration example of a vehicle door 10. FIG. 2 is a sectional view taken along line II-II in FIG. 1. The vehicle door 10 illustrated in FIGS. 1 and 2 is a right front door (FR door) of a vehicle, and a front end portion thereof is supported by a vehicle body (not illustrated) to be rotatable around a rotary shaft in an upward-downward direction. The vehicle door 10 can rotate in a horizontal direction with respect to the vehicle body between an opening position for opening an opening portion formed on a side surface of the vehicle body and a closing position for closing the opening portion. In the following description, a "forward-rearward direction" and a "vehicle inward-outward direction" are directions set based on a case where the vehicle door 10 is located at the closing position.

The vehicle door 10 includes a door main body 11 configuring a lower half portion thereof, and a door sash portion 12 disposed in an upper portion of the door main body 11. As illustrated in FIG. 2, the door main body 11 includes an outer panel 13 configuring an outer surface, an inner panel 14 fixed to a compartment side surface of the outer panel 13, and a resin-made trim (not illustrated) fixed to the compartment side surface of the inner panel 14 and configuring an inner surface of the door main body 11. As illustrated in FIG. 1, a door outside handle 17 is rotatably supported in the outer panel 13. A door inside handle (not illustrated) is rotatably supported in the inner panel 14. The door outside handle 17 and the door inside handle can rotate between an initial position and an opening position, and are rotationally biased toward the initial position by a biasing force of a torsion coil spring (not illustrated).

As illustrated in FIG. 2, the vehicle door lock device 20 is located between the outer panel 13 and the inner panel 14, that is, inside the door main body 11, and a portion thereof is exposed on a rear end surface of the vehicle door 10.

Figure 3:
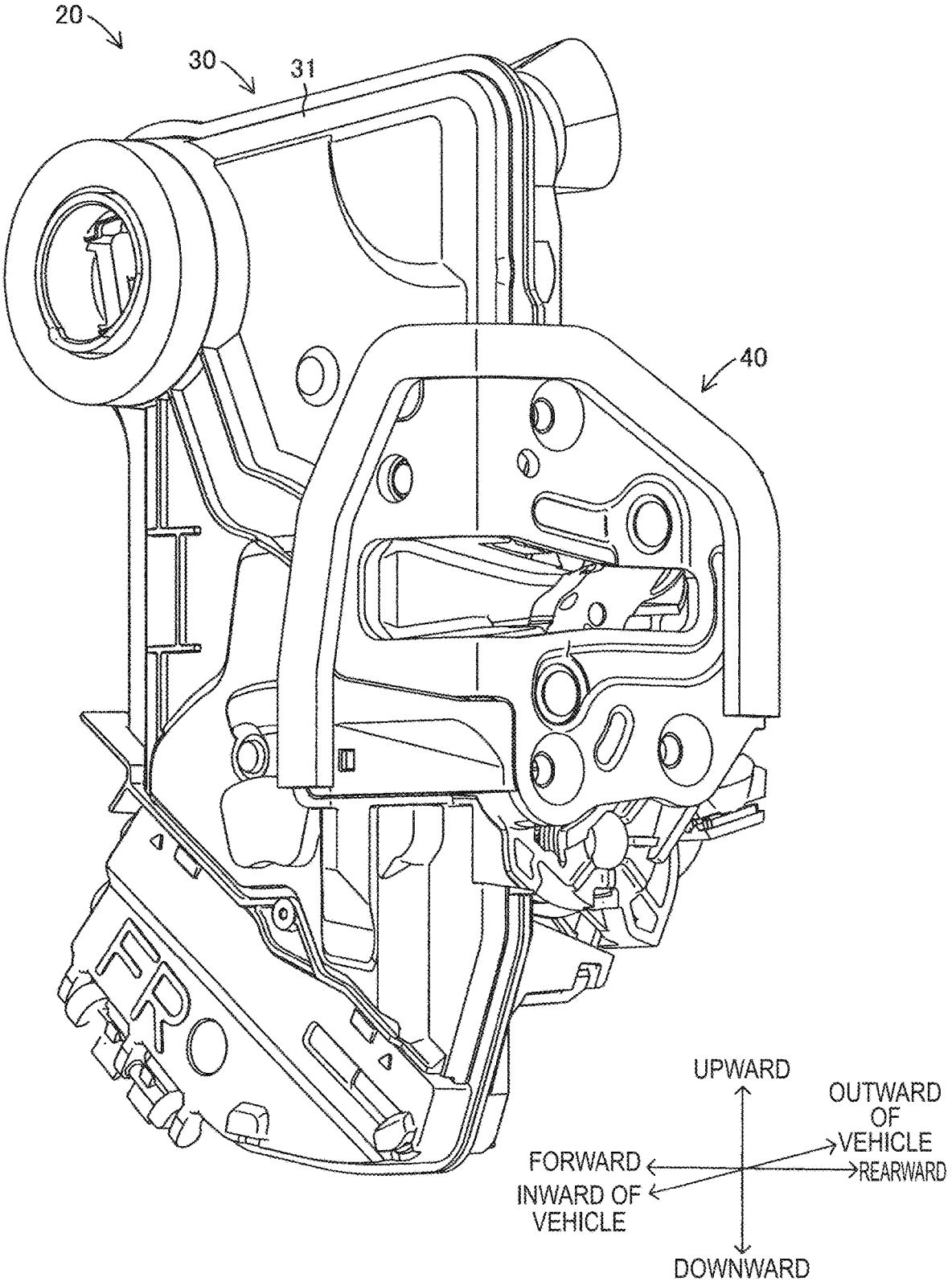
FIG. 3 is a perspective view when a vehicle door lock device is viewed from a compartment side and a rear side of a vehicle.

FIG. 3 is a perspective view when the vehicle door lock device 20 is viewed from the rear side in the vehicle inward direction. As illustrated in FIG. 3, the vehicle door lock device 20 includes a locking/unlocking mechanism 30 and an opening/closing mechanism 40. The locking/unlocking mechanism 30 has a housing 31 that extends in the forward-rearward direction and the upward-downward direction, and the housing 31 internally houses a plurality of operation levers operated to lock and unlock the vehicle door 10.

The opening/closing mechanism 40 is attached to a rear portion of the housing 31. When the vehicle door 10 is unlocked, the door outside handle 17 or the door inside handle is caused to rotate from the initial position to the opening position. In this manner, the closed vehicle door 10 is brought into an open state. On the other hand, when the vehicle door 10 is locked, even if the door outside handle 17 or the door inside handle is caused to rotate from the initial position to the opening position, the closed vehicle door 10 is held in a closed state. The embodiments disclosed here are characterized by the opening/closing mechanism 40. Accordingly, detailed description of the locking/unlocking mechanism 30 will be omitted. Hereinafter, the opening/closing mechanism 40 will be described.

First Embodiment

Figure 4:
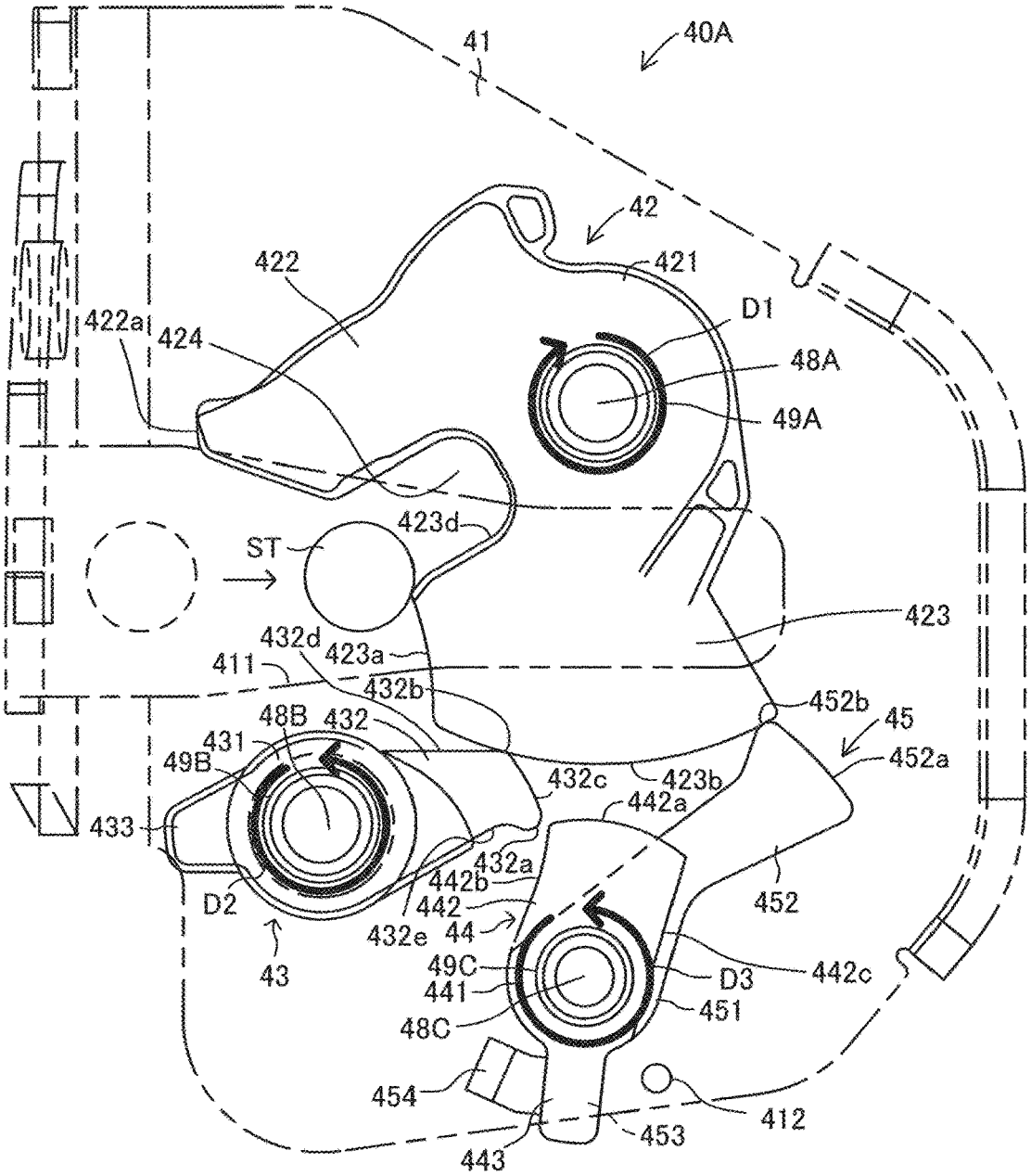
FIG. 4 is a rear view of an opening/closing mechanism according to a first embodiment.
Figure 4:
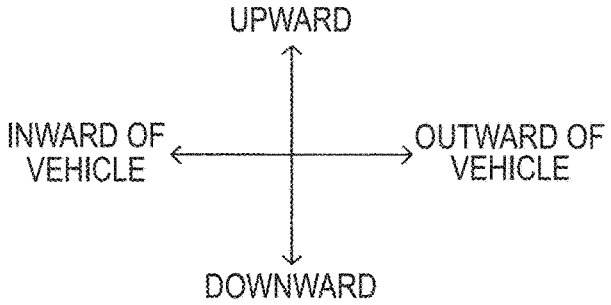

FIG. 4 is a rear view of an opening/closing mechanism 40A according to a first embodiment. As illustrated in FIG. 4, the opening/closing mechanism 40A includes a base member 41, a latch 42, a pawl 43, a block lever 44, and a half latch lever 45. The base member 41 is illustrated using a two-dot chain line.

The base member 41 supports various components of the opening/closing mechanism 40A. The base member 41 has a striker entering groove 411 which a striker ST attached to the vehicle body enters when the vehicle door 10 performs a closing operation. The striker entering groove 411 extends in the vehicle inward-outward direction, and is open in the vehicle inward direction. When the vehicle door 10 performs the closing operation, the striker ST enters the striker entering groove 411 from an opening end of the striker entering groove 411, and moves inside the striker entering groove 411 in the vehicle outward direction.

The base member 41 has a latch support shaft 48A, a pawl support shaft 48B, and a block lever support shaft 48C. The support shafts respectively extend in the forward-rearward direction. The latch support shaft 48A is disposed in the base member 41 at an upper position of the striker entering groove 411. On the other hand, the pawl support shaft 48B and the block lever support shaft 48C are disposed in the base member 41 at lower positions of the striker entering groove 411. The pawl support shaft 48B is located on a side in the vehicle inward direction from the block lever support shaft 48C.

The latch 42 is rotatably supported by the latch support shaft 48A. Therefore, the latch 42 is supported by the base member 41 to be rotatable around the axis in the forward-rearward direction. The latch 42 has a support portion 421, a full latch claw portion 422, and a half latch claw portion 423. The support portion 421 configures a portion rotatably supported by the latch support shaft 48A. The full latch claw portion 422 and the half latch claw portion 423 are bifurcated from the support portion 421 within a rotary plane of the latch 42, and extend in substantially the same direction. Therefore, a space is disposed between the full latch claw portion 422 and the half latch claw portion 423, and a striker holding recess portion 424 is formed by the space.

The striker holding recess portion 424 is formed by a space surrounded with an inner wall surface of the full latch claw portion 422 and an inner wall surface of the half latch claw portion 423 which face each other, and a bottom surface that connects base ends of the inner wall surfaces to each other. The striker holding recess portion 424 is open on an outer peripheral surface of the latch 42. Therefore, the full latch claw portion 422 and the half latch claw portion 423 are formed across the striker holding recess portion 424. As will be understood from FIG. 4, the striker holding recess portion 424 is disposed at a position overlapping the striker entering groove 411 when viewed in the forward-rearward direction.

The full latch claw portion 422 is located forward in the rotation direction from the half latch claw portion 423 in a case where the latch 42 rotates in the clockwise direction in FIG. 4. An engagement protruding portion 422*a* is formed in a tip portion of the full latch claw portion 422.

A first engagement wall surface 423*a* and a second engagement wall surface 423*b* are formed in the half latch claw portion 423. The first engagement wall surface 423*a* is formed in a tip portion of the half latch claw portion 423. The first engagement wall surface 423*a* extends to be curved downward in FIG. 4 from a radially outer end (opening end of the striker holding recess portion 424) of the inner wall surface 423*d* of the half latch claw portion 423. The second engagement wall surface 423*b* extends to be curved in the vehicle outward direction in FIG. 4 from a lower end of the first engagement wall surface 423*a*. When viewed in a direction (from the rear side) illustrated in FIG. 4, the second engagement wall surface 423*b* is formed in an arc shape around the axis of the latch support shaft 48A. The second engagement wall surface 423*b* configures a portion of an outer peripheral wall surface of the latch 42.

A latch return spring 49A (latch biasing member) is attached to the latch support shaft 48A, and the latch 42 is biased by the latch return spring 49A in the clockwise direction indicated by an arrow D1 in FIG. 4. Although the latch 42 rotates in the clockwise direction around the latch support shaft 48A by using a rotational biasing force of the latch return spring 49A, the rotation is restricted by the latch 42 engaging with a latch stopper (not illustrated). A rotation position where the rotation of the latch 42 in the clockwise direction is restricted by the latch stopper is defined as an unlatch position. FIG. 4 illustrates the latch 42 located at the unlatch position. When the latch 42 is located at the unlatch position, as illustrated in FIG. 4, the striker holding recess portion 424 is open in the vehicle inward direction. Therefore, when the latch 42 is located at the unlatch position, the striker holding recess portion 424 can receive the striker ST moving inside the striker entering groove 411 toward the side in the vehicle outward direction, and can engage with the striker ST. When the latch 42 is located at the unlatch position, the striker ST engaging with the striker holding recess portion 424 moves in the vehicle inward direction. In this manner, the latch 42 can be removed from the striker holding recess portion 424. That is, the unlatch position is the rotation position where the striker ST engaging with the latch 42 can be released.

The pawl 43 is rotatably supported by the pawl support shaft 48B. Therefore, the pawl 43 is supported by the base member 41 to be rotatable around the axis in the forward-rearward direction. The pawl 43 has a support portion 431, a first engagement arm 432, and a connecting arm 433. The support portion 431 configures a portion rotatably supported by the pawl support shaft 48B. The first engagement arm 432 extends radially outward of the pawl support shaft 48B from the support portion 431. In FIG. 4, the first engagement arm 432 extends in the vehicle outward direction from the support portion 431. The first engagement arm 432 has an engagement wall surface 432*c*, an upper side wall surface 432*d*, and a lower side wall surface 432*e*. The engagement wall surface 432*c* includes a tip surface of the first engagement arm 432. The upper side wall surface 432*d* is formed from the one end (upper end) of the engagement wall surface 432*c* toward the support portion 431, and the lower side wall surface 432*e* is formed from the other end (lower end) of the engagement wall surface 432*c* toward the support portion 431. In FIG. 4, the upper side wall surface 432*d* faces upward, and the lower side wall surface 432*e* faces downward. An engagement protruding portion 432*a* protruding downward in FIG. 4 is formed in a boundary portion between the engagement wall surface 432*c* and the lower side wall surface 432*e*. An engagement protruding portion 432*b* protruding toward the second engagement wall surface 423*b* of the latch 42 is formed in a boundary portion between the engagement wall surface 432*c* and the upper side wall surface 432*d*. The connecting arm 433 extends from the support portion 431 in a direction opposite to an extending direction of the first engagement arm 432.

A pawl return spring 49B (pawl biasing member) is attached to the pawl support shaft 48B, and the pawl 43 is biased by the pawl return spring 49B in the counterclockwise direction indicated by an arrow D2 in FIG. 4. Therefore, the pawl 43 tries to rotate in the counterclockwise direction by the rotational biasing force of the pawl return spring 49B. However, the rotation is restricted by a pawl stopper (not illustrated) disposed in the base member 41. The rotation position of the pawl 43 illustrated in FIG. 4 where the rotation is restricted by the pawl stopper is defined as an engagement position. When the rotation position of the pawl 43 is located at the engagement position, the first engagement arm 432 of the pawl 43 interferes with a rotation region of the full latch claw portion 422 of the latch 42. That is, the engagement position of the pawl 43 is the position where the pawl enters the rotation region of the full latch claw portion 422.

The block lever 44 is rotatably supported by the block lever support shaft 48C. Therefore, the block lever 44 is supported by the base member 41 to be rotatable around the axis in the forward-rearward direction. The block lever 44 has a support portion 441, a second engagement arm 442, and a third engagement arm 443. The support portion 441 configures a portion rotatably supported by the block lever support shaft 48C. The second engagement arm 442 extends radially outward of the block lever support shaft 48C from the support portion 441. In FIG. 4, the second engagement arm 442 extends upward from the support portion 441. The third engagement arm 443 extends radially outward of the block lever support shaft 48C from the support portion 441 in the direction opposite to the extending direction of the second engagement arm 442. A lift lever (not illustrated) is connected to the third engagement arm 443.

The second engagement arm 442 of the block lever 44 has an abutting wall surface 442*a*, a vehicle interior side wall surface 442*b*, and a vehicle exterior side wall surface 442*c*. The abutting wall surface 442*a* includes a tip wall surface of the second engagement arm 442, and is formed in an arc shape around the axis of the block lever support shaft 48C when viewed in a direction (from the rear side) illustrated in FIG. 4. The vehicle interior side wall surface 442*b* is a wall surface extending from one end (end on a side in the vehicle inward direction) of the abutting wall surface 442*a* toward the support portion 441, and the vehicle exterior side wall surface 442*c* is a wall surface extending from the other end (end on a side in the vehicle outward direction) of the abutting wall surface 442*a* toward the support portion 441.

The half latch lever 45 is supported by the block lever support shaft 48C to be rotatable coaxially with the block lever 44. The half latch lever 45 is supported by the block lever support shaft 48C, for example, in a state of overlapping with the block lever 44 on a front side of the block lever 44. Therefore, the half latch lever 45 is supported by the base member 41 to be rotatable around the axis in the forward-rearward direction. The half latch lever 45 has a support portion 451, a half latch arm 452, and a connecting arm 453. The support portion 451 configures a portion rotatably supported by the block lever support shaft 48C. The half latch arm 452 extends radially outward of the block lever support shaft 48C from the support portion 451. In FIG. 4, the half latch arm 452 extends obliquely upward from the support portion 451 in the vehicle outward direction. A half latch engagement wall surface 452*a* and an engagement protruding portion 452*b* are formed in the half latch arm 452. The half latch engagement wall surface 452*a* includes a tip wall surface of the half latch arm 452. The engagement protruding portion 452*b* is formed to protrude from one end portion of the half latch engagement wall surface 452*a* toward the second engagement wall surface 423*b* of the latch 42. The connecting arm 453 extends radially outward of the block lever support shaft 48C from the support portion 451 in a direction substantially opposite to the extending direction of the half latch arm 452. In FIG. 4, the connecting arm 453 extends in the same direction as the third engagement arm 443 of the block lever 44. The connecting arm 453 has the same shape as the third engagement arm 443 of the block lever 44. In FIG. 4, the connecting arm 453 is hidden behind the third engagement arm 443, and is not visible.

A block lever return spring 49C is attached to the block lever support shaft 48C. Both the block lever 44 and the half latch lever 45 are biased by the block lever return spring 49C in the counterclockwise direction indicated by an arrow D3 in FIG. 4. When the latch 42 is located at the unlatch position, the engagement protruding portion 452*b* of the half latch lever 45 engages with the second engagement wall surface 423*b* disposed in the half latch claw portion 423 of the latch 42. In this manner, the rotation of the half latch lever 45 in the counterclockwise direction by the block lever return spring 49C is restricted.

A coupling piece 454 is formed in the half latch lever 45. The coupling piece 454 extends from the connecting arm 453 in the vehicle inward direction, and a tip portion thereof is formed to be bent rearward. The third engagement arm 443 of the block lever 44 can engage with the coupling piece 454.

In a state illustrated in FIG. 4, the block lever 44 is located in the rotation region of the pawl 43, more specifically, at a position retreated from the rotation region of the first engagement arm 432 of the pawl 43. The rotation position of the block lever 44 retreated from the rotation region of the pawl 43 is defined as a non-restriction position.

The rotary plane of the latch 42, the rotary plane of the pawl 43, and the rotary plane of the block lever 44 coincide with each other. Therefore, in a case where the rotation regions of the rotary members interfere with each other, interfering members are brought into the engagement state. The rotary plane of the half latch lever 45 may be configured so that at least the rotary plane of the half latch engagement wall surface 452*a* and the engagement protruding portion 452*b* coincide with the rotary plane of the above-described rotary member.

As illustrated in FIG. 4, a half latch stopper 412 is formed in the base member 41. The half latch stopper 412 is formed at a position which interferes with the rotation region of the connecting arm 453 of the half latch lever 45 and the rotation region of the third engagement arm 443 of the block lever 44. The half latch stopper 412 restricts the rotation of the half latch lever 45 in the counterclockwise direction by engaging with the connecting arm 453 of the half latch lever 45. The half latch stopper 412 restricts the rotation of the block lever 44 in the counterclockwise direction by engaging with the third engagement arm 443 of the block lever 44.

An operation of the opening/closing mechanism 40A having the above-described configuration will be described. When the vehicle door 10 is open, an operation state of the opening/closing mechanism 40A is as illustrated in FIG. 4. In this case, the latch 42 is located at the unlatch position. The pawl 43 is rotationally restricted at the engagement position illustrated in FIG. 4 in a state where the pawl 43 is rotationally restricted by the pawl stopper. The half latch lever 45 is rotationally restricted at the non-operation position illustrated in FIG. 4 in a state where the half latch lever 45 engages with the second engagement wall surface 423*b* of the latch 42. In a case where the half latch lever 45 is located at the non-operation position, the half latch lever 45 engages with the outer peripheral wall surface (second engagement wall surface 423*b*) of the half latch claw portion 423. Accordingly, the half latch lever 45 is retreated from the rotation region of the half latch claw portion 423. That is, the non-operation position is a position inside the rotation region which is retreated from the rotation region of the half latch claw portion 423 within the rotation region of the half latch lever 45. The block lever 44 is rotationally restricted at the non-restriction position illustrated in FIG. 4. Here, the half latch lever 45 has an engagement piece (not illustrated in FIG. 4), and the engagement piece engages with the block lever 44. Due to the engagement, the block lever 44 is rotationally restricted at the non-restriction position illustrated in FIG. 4. The engagement piece is configured as follow. In a case where the half latch lever 45 rotates in the clockwise direction from a position illustrated in FIG. 4, the engagement piece engages with the block lever 44, and rotates the block lever 44 in the clockwise direction. In a case where the half latch lever 45 rotates in the counterclockwise direction from a position illustrated in FIG. 4, the engagement piece is separated from the block lever 44 located at the non-restriction position.

If the vehicle door 10 performs the closing operation, the striker ST disposed in the vehicle body enters the striker entering groove 411 of the base member 41, and further moves the striker entering groove 411 outward of the vehicle. The striker ST eventually comes into contact with an opening end portion of the striker holding recess portion 424 formed in the latch 42 (refer to FIG. 4).

If the closing operation of the vehicle door 10 is progressively performed and the striker ST moves the striker entering groove 411 outward of the vehicle, the striker ST is received by the striker holding recess portion 424, and engages with a wall surface of the striker holding recess portion 424. In this way, the latch 42 is capable of engaging with the striker ST. The striker ST further moves outward of the vehicle while engaging with the wall surface of the striker holding recess portion 424. In this manner, while the latch 42 holds the striker ST, the latch 42 rotates in the counterclockwise direction in FIG. 4 against the rotational biasing force of the latch return spring 49A.

Figure 5:
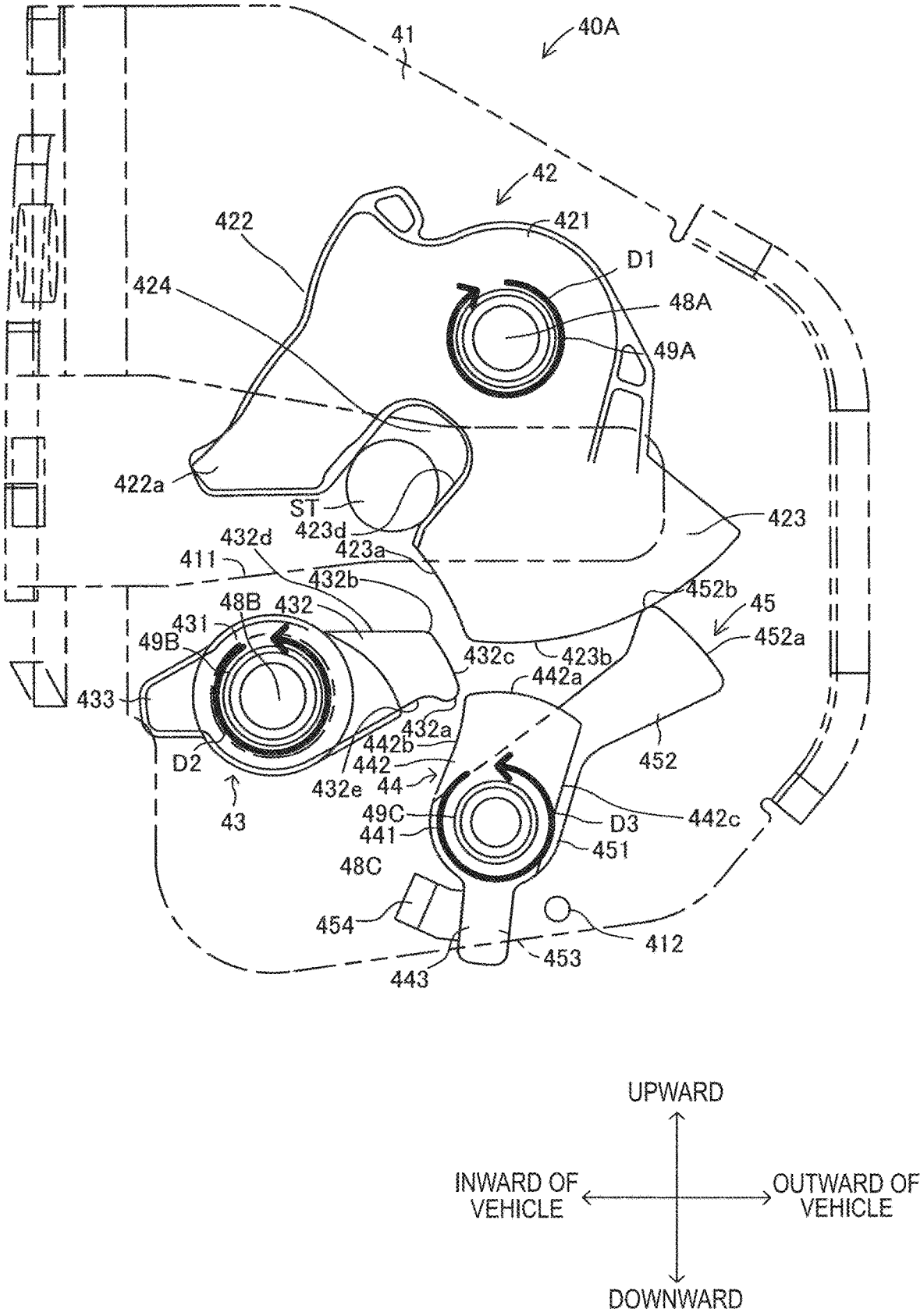
FIG. 5 is a rear view of the opening/closing mechanism in which a latch rotates in a clockwise direction from a rotation position illustrated in FIG. 4.

FIG. 5 is a rear view of the opening/closing mechanism 40A which illustrates a state where the latch 42 rotates in the clockwise direction from the rotation position illustrated in FIG. 4. As illustrated in FIG. 5, if the latch 42 rotates in the clockwise direction from the unlatch position, the engagement protruding portion 452*b* formed in the half latch arm 452 of the half latch lever 45 slides toward the tip side of the half latch claw portion 423 on the second engagement wall surface 423*b* formed in the half latch claw portion 423 of the latch 42. Here, the second engagement wall surface 423*b* is formed in an arc shape around the rotation center (axis of the latch support shaft 48A) of the latch 42. Accordingly, even in a case where the latch 42 rotates, a radial position of the second engagement wall surface 423*b* is not changed. Therefore, the half latch lever 45 slides on the second engagement wall surface 423*b* of the half latch claw portion 423 without changing the rotation position, that is, while the rotation position is located at the non-operation position.

Figure 6:
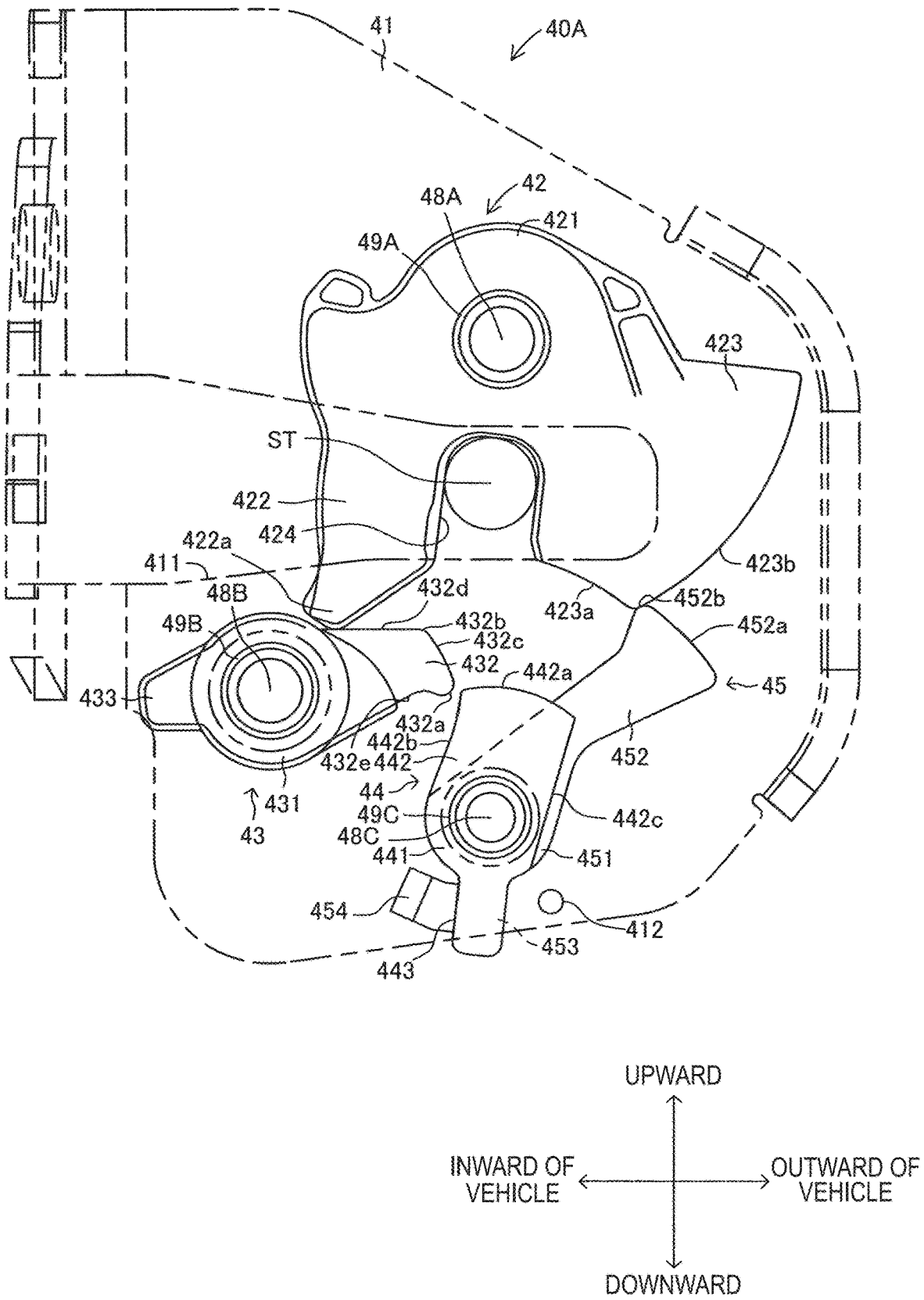
FIG. 6 is a rear view of the opening/closing mechanism in which a first engagement arm of a pawl abuts on a full latch claw portion of the latch.

If the striker ST progressively moves in the vehicle outward direction and the latch 42 rotates in the counterclockwise direction, the full latch claw portion 422 of the latch 42 abuts on the first engagement arm 432 of the pawl 43. FIG. 6 is a rear view of the opening/closing mechanism 40A which illustrates a state where the first engagement arm 432 of the pawl 43 abuts on the full latch claw portion 422 of the latch 42. As illustrated in FIG. 6, the engagement protruding portion 422*a* of the full latch claw portion 422 abuts on the upper side wall surface 432*d* of the first engagement arm 432 of the pawl 43. When the latch 42 is located at a position illustrated in FIG. 6, the half latch lever 45 maintains a state of engaging with the second engagement wall surface 423*b* of the half latch claw portion 423. Therefore, in an initial stage when the pawl 43 abuts on the latch 42, the half latch lever 45 is located at the non-operation position. The rotation position of the block lever 44 is the non-restriction position.

If the latch 42 further rotates in the counterclockwise direction from a state illustrated in FIG. 6, the engagement protruding portion 452*b* of the half latch lever 45 eventually disengages from the second engagement wall surface 423*b* of the half latch claw portion 423. In this manner, the half latch lever 45 rotates in the counterclockwise direction in FIG. 6 in accordance with the rotational biasing force of the block lever return spring 49C. The rotation of the half latch lever 45 in the counterclockwise direction is restricted by the engagement between the connecting arm 453 of the half latch lever 45 and the half latch stopper 412. The rotation position of the half latch lever 45 whose rotation in the counterclockwise direction is restricted by the engagement with the half latch stopper 412 is the operation position.

Figure 7:
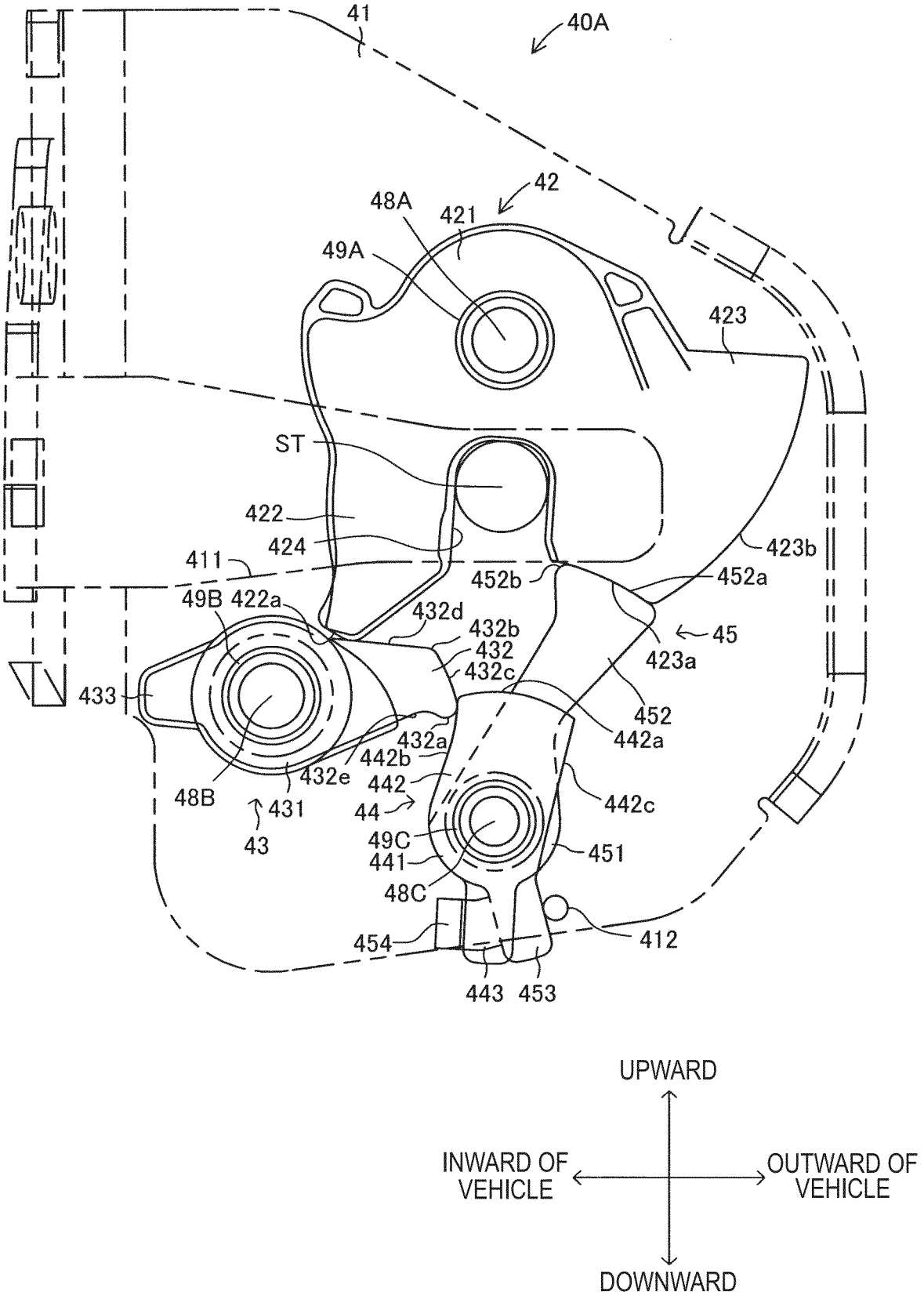
FIG. 7 is a rear view of the opening/closing mechanism which illustrates a half latch lever located at an operation position.

FIG. 7 is a rear view of the opening/closing mechanism 40A which illustrates the half latch lever 45 located at the operation position. As illustrated in FIG. 7, when the half latch lever 45 is located at the operation position, the half latch lever 45 enters the rotation region of the half latch claw portion 423, and the half latch engagement wall surface 452*a* of the half latch lever 45 is located at a position where the half latch engagement wall surface 452*a* can face the first engagement wall surface 423*a* of the half latch claw portion 423. In this case, in a case where the closing operation of the vehicle door 10 is completely performed, the latch 42 tries to rotate in the clockwise direction in accordance with the rotational biasing force of the latch return spring 49A. However, the rotation is restricted since the half latch engagement wall surface 452*a* of the half latch lever 45 engages with the first engagement wall surface 423*a* of the half latch claw portion 423. The rotation position of the latch 42 whose rotation in the clockwise direction is restricted by the engagement with the half latch lever 45 located at the operation position is defined as the half latch position. Therefore, inside the rotation region of the half latch lever 45, the operation position is a position inside the rotation region (operation region) where the latch 42 enters the rotation region of the half latch claw portion 423 when the latch 42 is located at the half latch position and engages with the half latch claw portion 423 so as to restrict the rotation of the latch 42 in the direction toward the unlatch position. An operation state of the opening/closing mechanism 40A in which the rotation of the latch 42 in the clockwise direction at the half latch position is restricted by the half latch lever 45 is called a half latch state. When in the half latch state, the vehicle door 10 is brought into a so-called half closed state. In this case, the vehicle door 10 is closed in a slightly open state compared to a fully closed state, and the closed state is maintained.

As illustrated in FIG. 7, due to the rotation of the latch 42 in the counterclockwise direction, the first engagement arm 432 of the pawl 43 abutting on the full latch claw portion 422 is pressed against the full latch claw portion 422. Therefore, the pawl 43 rotates in the clockwise direction from the engagement position against the rotational biasing force of the pawl return spring 49B. As the latch 42 rotates in the counterclockwise direction, a contact position between the engagement protruding portion 422*a* of the full latch claw portion 422 and the upper side wall surface 432*d* of the first engagement arm 432 is shifted to the tip side of the first engagement arm 432. When the operation state of the opening/closing mechanism 40A is as illustrated in FIG. 7, in order for the half latch lever 45 to be located at the operation position where the half latch lever rotates in the counterclockwise direction from the non-operation position, the engagement piece disposed in the half latch lever 45 and the block lever 44 disengage from each other. However, before the engagement therebetween, the pawl 43 rotates in the clockwise direction from the engagement position illustrated in FIG. 4. Accordingly, as illustrated in FIG. 7, the engagement wall surface 432*c* of the pawl 43 abuts on the vehicle interior side wall surface 442*b* of the block lever 44 located at the non-restriction position. Through the abutting, the rotation position of the block lever 44 is maintained at the non-restriction position.

Figure 8:
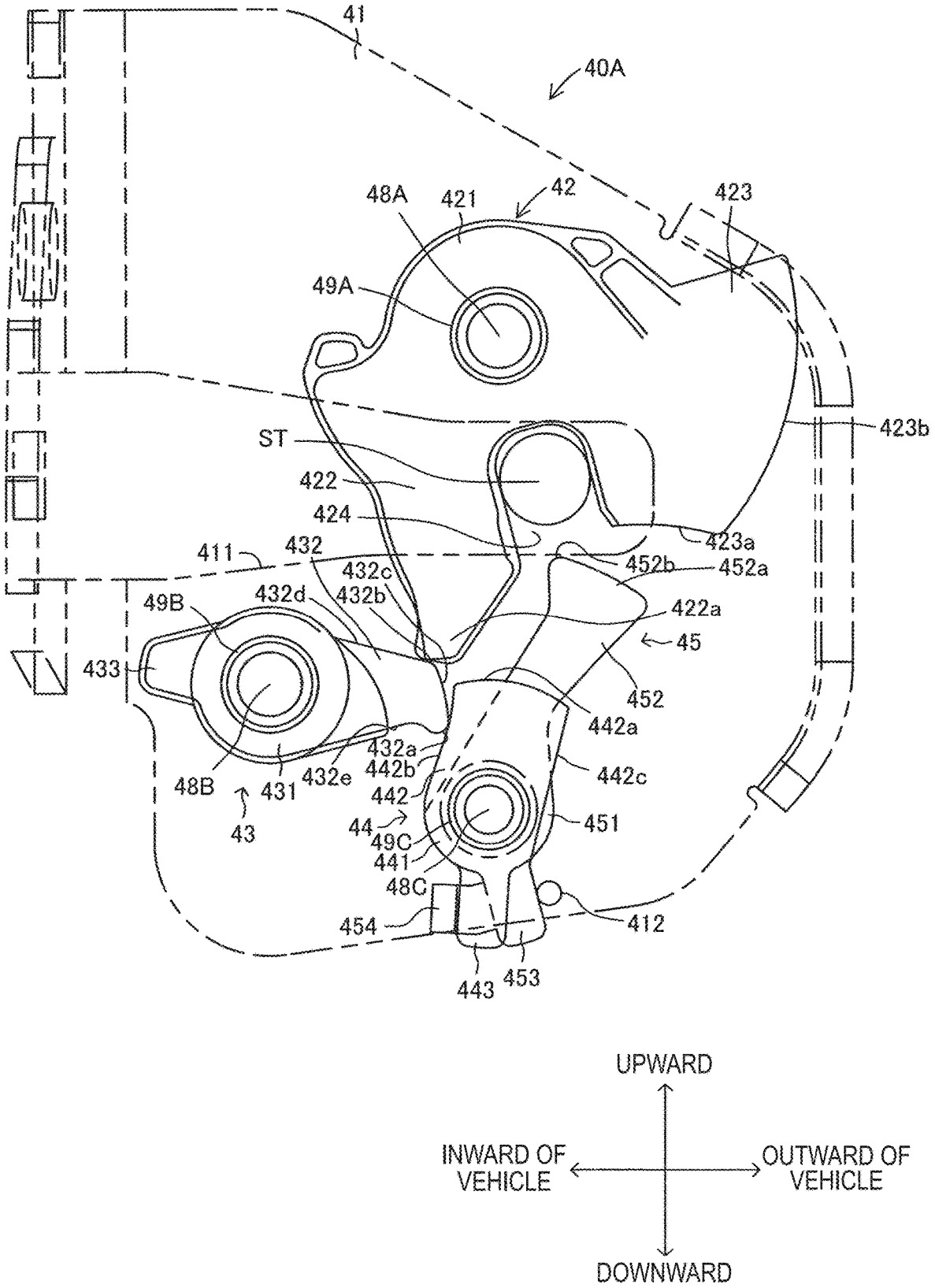
FIG. 8 is a rear view of the opening/closing mechanism which illustrates a state where the latch further rotates in a counterclockwise direction from a rotation position illustrated in FIG. 7.

FIG. 8 is a rear view of the opening/closing mechanism 40A which illustrates a state where the latch 42 further rotates in the counterclockwise direction from the rotation position illustrated in FIG. 7 so that the full latch claw portion 422 comes into contact with the engagement protruding portion 432*b* located at a tip position of the first engagement arm 432 of the pawl 43. As illustrated in FIG. 8, the pawl 43 is pressed by the full latch claw portion 422, thereby rotating in the most clockwise direction. The rotation position of the pawl 43 illustrated in FIG. 8 is defined as the disengagement position. When the pawl 43 is located at the disengagement position, the pawl 43 is retreated from the rotation region of the latch 42, specifically, the rotation region of the full latch claw portion 422. That is, the disengagement position is the rotation position where the pawl 43 is retreated from the rotation region of the full latch claw portion 422 out of the rotation positions of the pawl 43. In this way, the pawl 43 is rotatable from the engagement position to the disengagement position. In a state illustrated in FIG. 8, the half latch lever 45 maintains a state of being locked to the half latch stopper 412 by the connecting arm 453. That is, the rotation position of the half latch lever 45 is the operation position. The first engagement wall surface 423*a* formed in the half latch claw portion 423 of the latch 42 is separated from the half latch engagement wall surface 452*a* of the half latch lever 45 located at the operation position in response to the rotation of the latch 42 in the counterclockwise direction. Even when the operation state of the opening/closing mechanism 40A is a state illustrated in FIG. 8, the vehicle interior side wall surface 442*b* of the block lever 44 maintains a state of abutting on the engagement wall surface 432*c* of the pawl 43. Therefore, the rotation position of the block lever 44 is the non-restriction position.

If the latch 42 further rotates in the clockwise direction from the rotation position illustrated in FIG. 8, the full latch claw portion 422 and the first engagement arm 432 of the pawl 43 disengage from each other. Then, the pawl 43 is completely pressed by the full latch claw portion 422, and the pawl 43 returns to the engagement position after rotating in the counterclockwise direction in accordance with the rotational biasing force of the pawl return spring 49B.

The vehicle door 10 is brought into a substantially fully closed state at a position where the full latch claw portion 422 of the latch 42 disengages from the first engagement arm 432 of the pawl 43. Therefore, the striker ST stops moving, and the latch 42 tries to rotate in the clockwise direction in accordance with the rotational biasing force of the latch return spring 49A. In this way, the engagement protruding portion 422*a* disposed in the full latch claw portion 422 of the latch 42 rotationally biased in the clockwise direction engages with the engagement wall surface 432*c* disposed in the first engagement arm 432 of the pawl 43 located at the engagement position. In this manner, the rotation of the latch 42 in the clockwise direction by the rotational biasing force of the latch return spring 49A is restricted. The position of the latch 42 whose rotation is restricted in this way is defined as the full latch position. Thus, the latch 42 is rotatable in the rotation region between the unlatch position and the full latch position, and the striker ST moves in the vehicle outward direction in response to the closing operation of the vehicle door 10. In this manner, the latch 42 rotates from the unlatch position to the full latch position. The operation state of the opening/closing mechanism 40A in which the rotation of the latch 42 in the clockwise direction is restricted at the full latch position is called a full latch state. In the full latch state, the vehicle door 10 is in a fully closed state. In the full latch state, the latch return spring 49A rotationally biases the latch 42 in the clockwise direction from the full latch position toward the unlatch position.

If the full latch claw portion 422 and the first engagement arm 432 of the pawl 43 disengage from each other and the pawl 43 rotates in the counterclockwise direction, the engagement wall surface 432*c* of the pawl 43 and the vehicle interior side wall surface 442*b* of the block lever 44 no longer abut on each other. Therefore, the block lever 44 rotates in the counterclockwise direction from the non-restriction position in accordance with the rotational biasing force of the block lever return spring 49C. The rotation of the block lever 44 in the counterclockwise direction is restricted since the third engagement arm 443 of the block lever 44 engages with the half latch stopper 412. The rotation position of the block lever 44 whose rotation in the counterclockwise direction is restricted by engaging with the half latch stopper 412 is defined as the restriction position. In this way, the block lever 44 is rotatable in the rotation region between the restriction position and the non-restriction position. When the pawl 43 is pressed by the full latch claw portion 422 and rotates in the direction from the engagement position toward the disengagement position, the pawl 43 is located at the non-restriction position as illustrated in FIGS. 6, 7, and FIG. 8. The full latch claw portion 422 is completely pressed, and the pawl 43 rotates in the direction from the disengagement position toward the engagement position. In this manner, the block lever 44 rotates to the restriction position when the pawl 43 is located at the engagement position.

Figure 9:
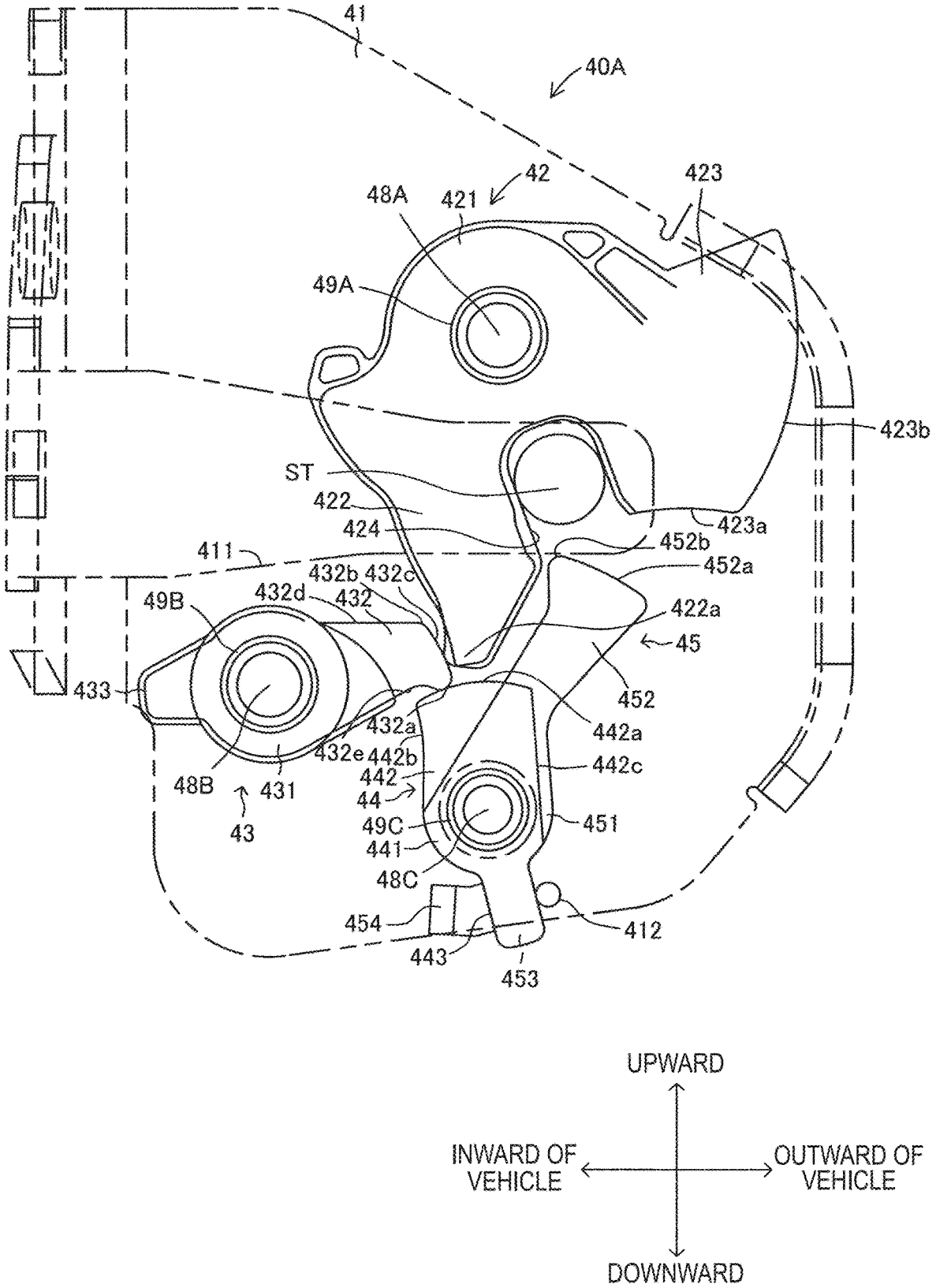
FIG. 9 is a rear view of the opening/closing mechanism in a full latch state.

FIG. 9 is a rear view of the opening/closing mechanism 40A in the full latch state. When the operation state of the opening/closing mechanism 40A is the full latch state illustrated in FIG. 9, the opening of the striker holding recess portion 424 of the latch 42 located at the full latch position faces outward of the vehicle. Therefore, the striker ST inside the striker holding recess portion 424 cannot move in the vehicle inward direction which is an opening direction of the vehicle door 10. When in the full latch state, as described above, the rotation of the latch 42 in the clockwise direction is restricted by the pawl 43 located at the engagement position. Therefore, the striker ST engaging with the latch 42 cannot be released from the latch 42. That is, when the latch 42 is located at the full latch position, the latch 42 holds the striker ST so that the striker ST cannot be released.

When in the full latch state, the block lever 44 is located at the restriction position. At the restriction position, the block lever 44 is hidden under the pawl 43 located at the engagement position. When the block lever 44 is located at the restriction position, the second engagement arm 442 of the block lever 44 enters the rotation region of the first engagement arm 432 of the pawl 43. That is, the restriction position is the rotation position where the block lever 44 enters the rotation region of the pawl 43 out of the rotation positions of the block lever 44.

When in the full latch state, the pawl 43 located at the engagement position restricts the rotation of the latch 42 as described above. However, in this case, the pawl 43 receives a rotating force in the direction against the rotational biasing force of the pawl return spring 49B, that is, in the clockwise direction, due to the biasing force applied from the latch 42. That is, when in the full latch state, the pawl 43 is rotationally biased in the clockwise direction from the engagement position toward the disengagement position. In this manner, the first engagement arm 432 of the pawl 43 tries to rotate around the pawl support shaft 48B so that a tip side thereof faces downward in FIG. 9. However, as described above, the block lever 44 located at the restriction position is hidden under the first engagement arm 432 of the pawl 43. Therefore, the rotation of the first engagement arm 432 is restricted since the engagement protruding portion 432*a* of the first engagement arm 432 abuts on the abutting wall surface 442*a* of the second engagement arm 442 of the block lever 44. In this way, the pawl 43 restricts the rotation of the latch 42, and the block lever 44 restricts the rotation of the pawl 43.

When in the full latch state, the half latch lever 45 is located at the operation position in a state of engaging with the half latch stopper 412.

The operation of the above-described opening/closing mechanism 40A in a case where the vehicle door 10 performs the closing operation, particularly, the operation of respective operation components from the half latch state to the full latch state is realized in such a way that the operation components are respectively operated at each desired timing. However, the following case is assumed. Due to a slight shift in the operation timing of the respective operation components, for example, a rotation delay of the pawl, the latch engages with the pawl in a mode different from the full latch state, before the respective operation components rotate to a normal position. This operation state of the opening/closing mechanism is called a pseudo latch state.

Figure 10:
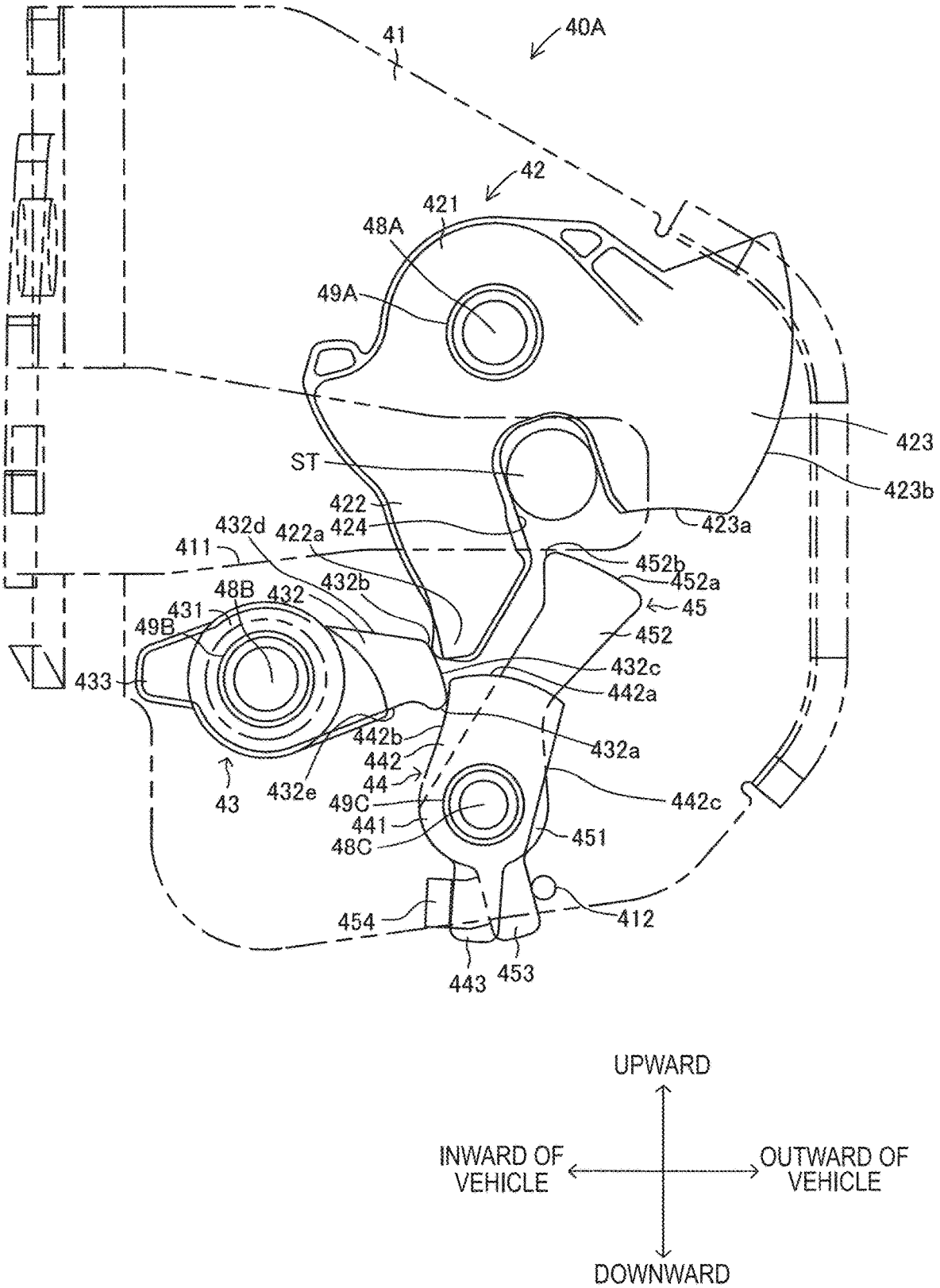
FIG. 10 is a rear view of the opening/closing mechanism in a pseudo latch state.

FIG. 10 is a rear view illustrating the opening/closing mechanism 40A in the pseudo latch state. As illustrated in FIG. 10, in the pseudo latch state, the engagement protruding portion 422*a* of the full latch claw portion 422 engages with an upper portion of the engagement wall surface 432*c* of the first engagement arm 432 of the pawl 43. The second engagement arm 442 of the block lever 44 is not hidden under the first engagement arm 432 of the pawl 43. The vehicle interior side wall surface 442*b* of the second engagement arm 442 of the block lever 44 engages with a lower portion of the engagement wall surface 432*c* of the first engagement arm 432 of the pawl 43. This engagement state occurs since the pawl 43 engages with the latch 42 before reaching the normal engagement position illustrated in FIG. 9 and the block lever 44 engages with the pawl 43 before reaching the normal restriction position illustrated in FIG. 9. Even in a case where the operation state of the opening/closing mechanism 40A is in the pseudo latch state, in order to restrict the rotation of the latch 42 by the engagement with the pawl 43, the striker ST is held by the latch 42, and the vehicle door 10 maintains a closed state. However, the block lever 44 only restricts the rotation of the pawl 43 by using the frictional force at the engagement position with the pawl 43. Accordingly, an engagement force is weak between the block lever 44 and the pawl 43. The engagement is shallow between the pawl 43 and the latch 42. Accordingly, the engagement force is also weak between the pawl 43 and the latch 42. Therefore, there is a possibility that the engagement state may be released due to an applied external force.

In the pseudo latch state, in a case where the rotational restriction of the latch is released by the pawl, it is preferable that the closed state of the vehicle door is maintained in at least a half closed state. That is, it is desirable that the rotation of the latch is restricted at the half latch position. However, in the related art, there is the following possibility. Even if the rotational restriction of the latch is released by the pawl in the pseudo latch state, there is no sufficient measure to restrict the rotation of the latch at the half latch position. Accordingly, if the pseudo latch state is released, the latch 42 rotates to the unlatch position, and the vehicle door 10 is brought into an openable state.

In this regard, the opening/closing mechanism 40A of the vehicle door lock device 20 according to the present embodiment is configured so that the rotation of the latch 42 can be restricted at the half latch position even in a case where the rotation of the latch 42 is released by the pawl 43 when in the pseudo latch state. For this purpose, the opening/closing mechanism 40A according to the present embodiment includes the half latch lever 45 that can rotate coaxially with the block lever 44. As illustrated in FIGS. 4, 5, and 6, the half latch lever 45 is located at the non-operation position while the rotation position of the latch 42 is located from the unlatch position to the half latch position. On the other hand, as illustrated in FIGS. 7, 8, and 9, the half latch lever 45 is located at the operation position in a case where the rotation position of the latch 42 is located from the half latch position to the full latch position. That is, the half latch lever 45 is configured as follows. When the rotation position of the latch 42 during the closing operation of the vehicle door 10 is located on the unlatch position side from the half latch position, the half latch lever 45 is located at the non-operation position. When the rotation position of the latch 42 during the closing operation of the vehicle door 10 is located at the rotation position from the half latch position to the full latch position, the half latch lever 45 is located at the operation position. In the pseudo latch state, the rotation position of the latch 42 is located between the half latch position and the full latch position. Accordingly, even in the pseudo latch state, the half latch lever 45 is located at the operation position as illustrated in FIG. 10. Therefore, when the operation state of the opening/closing mechanism 40A is the pseudo latch state, even if the latch 42 rotates toward the unlatch position after the pawl 43 and the latch 42 disengage from each other, the latch 42 engages with the half latch lever 45 at the half latch position, and the rotation of the latch 42 is restricted by the engagement therebetween.

Figure 11:
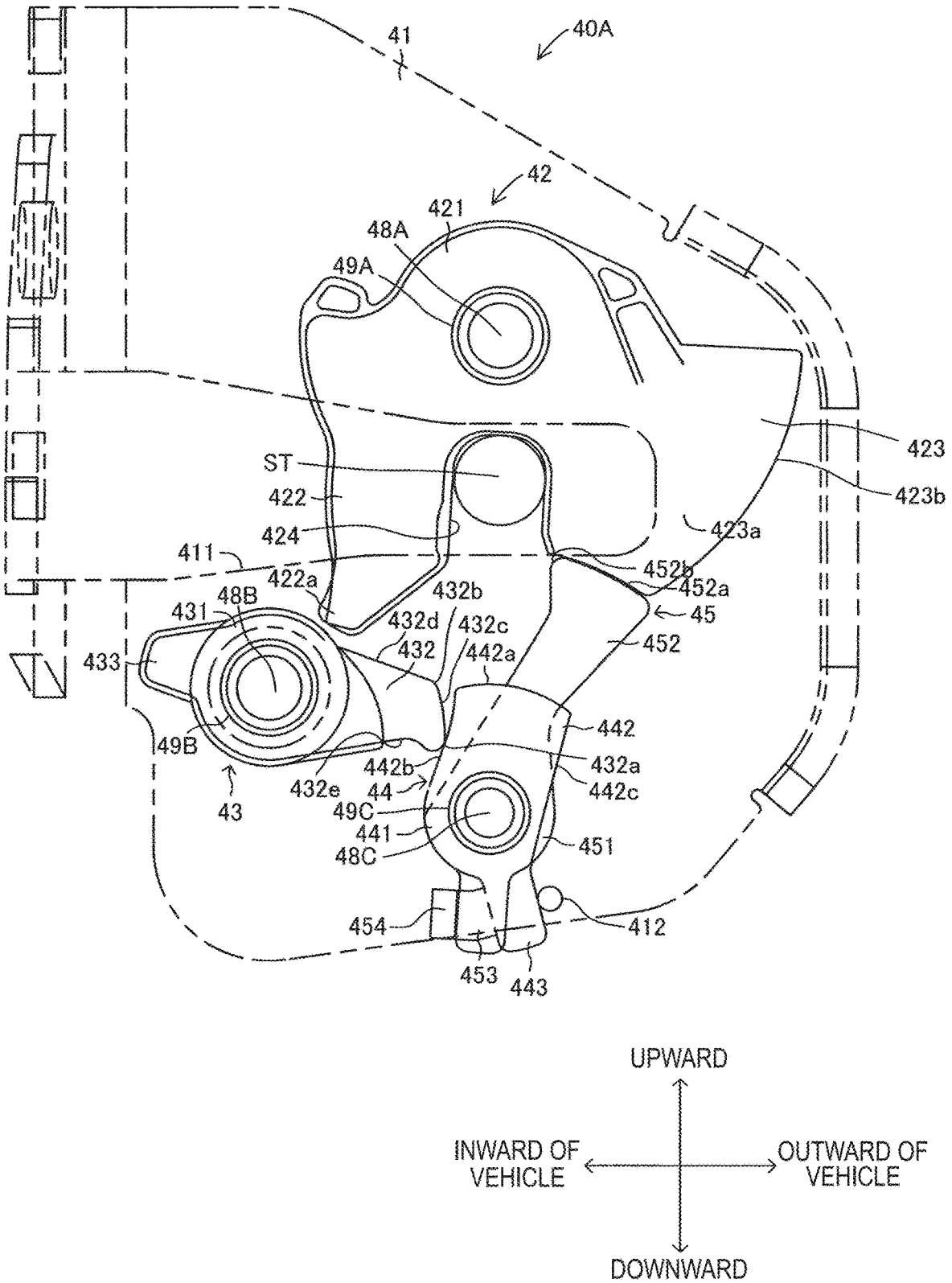
FIG. 11 is a rear view of the opening/closing mechanism which illustrates a state where the pawl and the latch disengage from each other when in the pseudo latch state.

FIG. 11 is a rear view of the opening/closing mechanism 40A which illustrates a state where the half latch engagement wall surface 452*a* of the half latch lever 45 abuts on the first engagement wall surface 423*a* of the half latch claw portion 423 when the pawl 43 and the latch 42 disengage from each other in the pseudo latch state. As illustrated in FIG. 11, the latch 42 engages with the half latch lever 45 at the half latch position. That is, the operation state of the opening/closing mechanism 40A is changed to the half latch state. Therefore, the closed state of the vehicle door 10 is maintained. In this way, according to the present embodiment, the vehicle door 10 can be effectively prevented from being opened due to the pseudo latch state.

In a case where the vehicle door 10 in the fully closed state is opened, the door outside handle 17 or the door inside handle disposed in the vehicle door 10 is rotated from the initial position to the opening position. In this manner, the operation lever is operated inside the locking/unlocking mechanism 30 of the vehicle door lock device 20. If the operation lever is operated inside the locking/unlocking mechanism 30, in conjunction with the operation, the block lever 44 of the opening/closing mechanism 40A rotates in the clockwise direction from the restriction position toward the non-restriction position illustrated in FIG. 9. In this case, the third engagement arm 443 of the block lever 44 engages with the coupling piece 454 disposed in the half latch lever 45. Then, while the third engagement arm 443 engages with the coupling piece 454, the block lever 44 further rotates in the clockwise direction. In this manner, the half latch lever 45 engaging with the block lever 44 in the coupling piece 454 also rotates together with the block lever 44 in the clockwise direction. In this manner, the half latch lever 45 rotates from the operation position to the non-operation position. In this way, the coupling piece 454 engages with the block lever 44 rotating in the direction from the restriction position toward the non-restriction position when the half latch lever 45 is located at the operation position. The half latch lever 45 rotates in the direction from the operation position toward the non-operation position.

Figure 12:
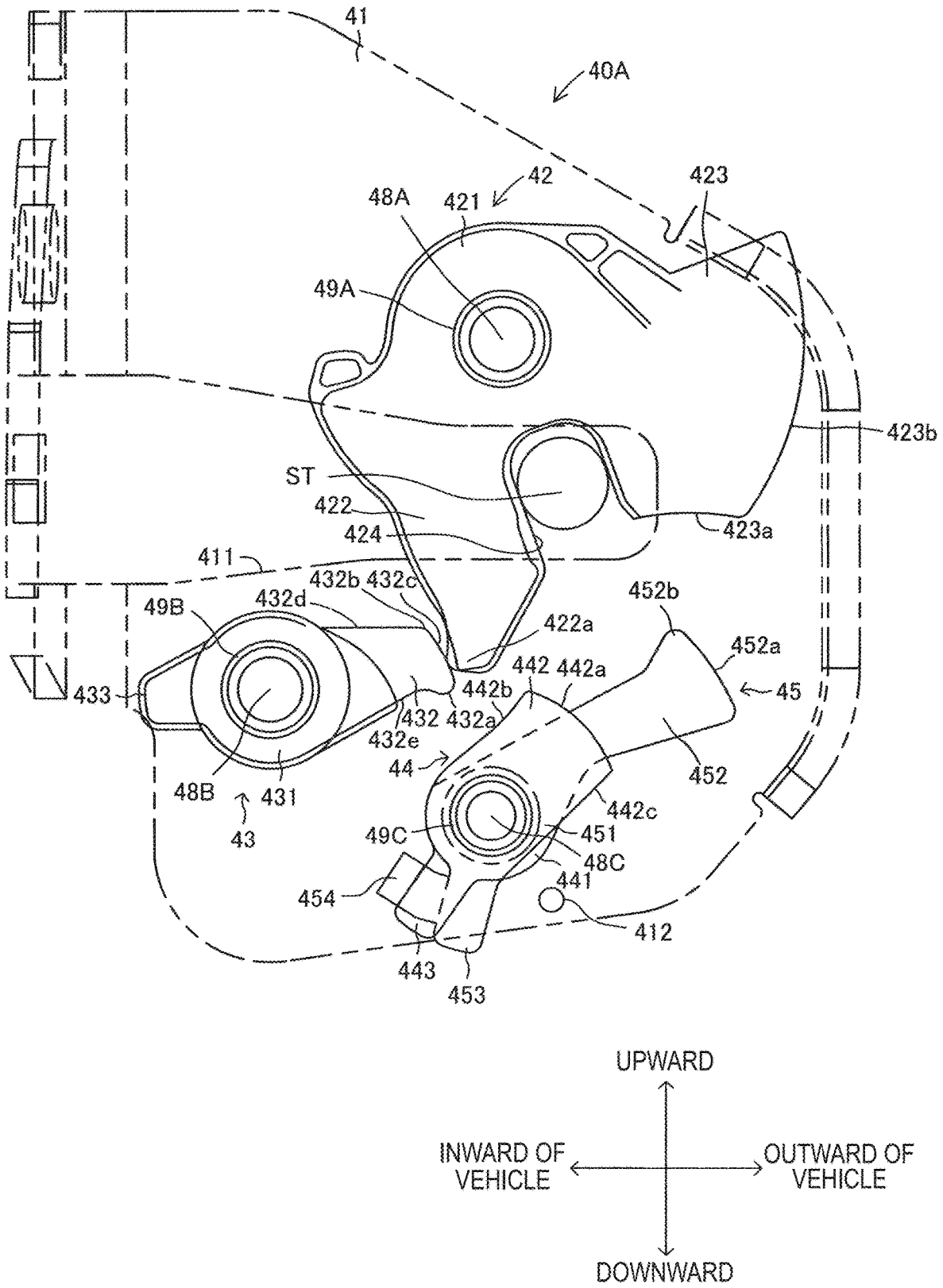
FIG. 12 is a rear view of the opening/closing mechanism which illustrates a state where a block lever and a half latch lever of the opening/closing mechanism in the full latch state rotate in the clockwise direction.

FIG. 12 is a rear view of the opening/closing mechanism 40A which illustrates a state where the block lever 44 and the half latch lever 45 of the opening/closing mechanism 40A in the full latch state rotate in the clockwise direction. As illustrated in FIG. 12, the half latch lever 45 rotates in the clockwise direction from the operation position to the non-operation position. In this manner, the half latch lever 45 is retreated from the rotation region of the half latch claw portion 423. The block lever 44 rotates in the clockwise direction from the restriction position to the non-restriction position. In this manner, the second engagement arm 442 of the block lever 44 is located at a position disengaged from a lower position of the first engagement arm 432 of the pawl 43. In this manner, the pawl 43 rotates in the clockwise direction by receiving a biasing force input from the latch 42 and an elastic reaction force of a weather strip installed in a peripheral edge of the vehicle door 10. Even in a case where the pawl 43 is not rotated by the input load, a lift lever (not illustrated) connected to the third engagement arm 443 of the block lever 44 presses the connecting arm 433 of the pawl 43 in response to the rotation of the block lever 44. In this manner, the pawl 43 rotates in the clockwise direction. The lift lever has the same configuration as a third extension arm 764 of a block lift lever 76 illustrated in a fourth embodiment (to be described later).

In this way, if the pawl 43 rotates in the clockwise direction, the engagement protruding portion 422*a* disposed in the full latch claw portion 422 of the latch 42 and the engagement wall surface 432*c* formed the first engagement arm 432 of the pawl 43 disengage from each other. In this manner, the latch 42 rotates in the clockwise direction in accordance with the rotational biasing force of the latch return spring 49A. As described above, the half latch lever 45 is located at the non-operation position, and is retreated from the rotation region of the latch 42 (half latch claw portion 423). Accordingly, the rotation of the latch 42 in the clockwise direction is not restricted by the half latch lever 45. Therefore, the latch 42 is located again at the unlatch position. In this case, the striker ST can be separated from the striker holding recess portion 424 of the latch 42, and can move the striker entering groove in the vehicle outward direction. Accordingly, the vehicle door 10 can be opened.

The coupling piece 454 does not engage with the block lever 44 in a case where the block lever 44 rotates in the direction from the non-restriction position toward the restriction position when the half latch lever 45 is located at the operation position. That is, the rotation of the block lever 44 in the direction from the non-restriction position toward the restriction position is not hindered by the coupling piece 454. The coupling piece 454 is configured in this way. Accordingly, for example, the block lever 44 engages with the half latch lever located at the operation position in the half latch state. In this manner, the rotation of the block lever 44 is effectively prevented from being restricted in the direction from the non-restriction position toward the restriction position.

Second Embodiment

Figure 13:
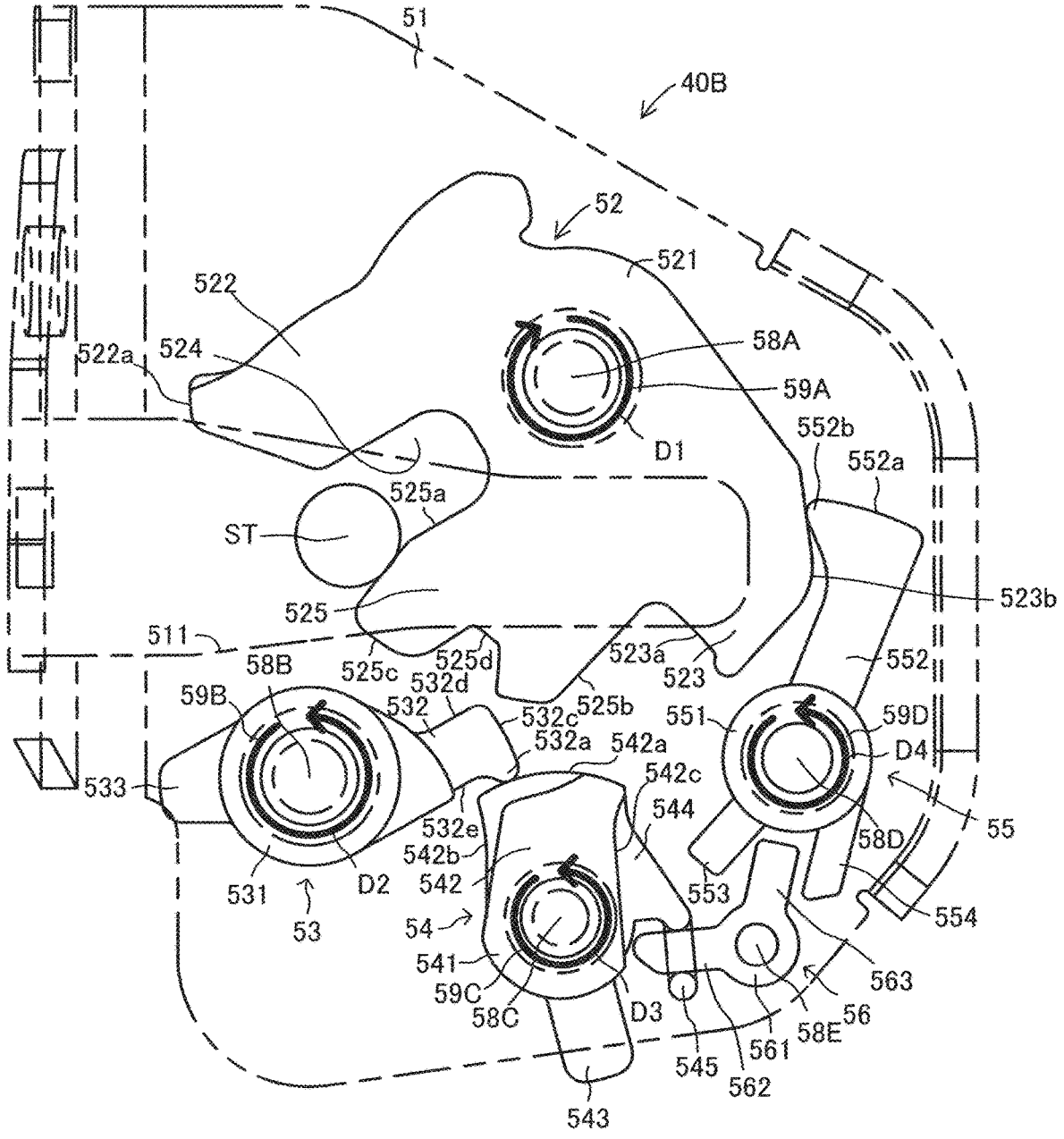
FIG. 13 is a rear view of an opening/closing mechanism according to a second embodiment.
Figure 13:
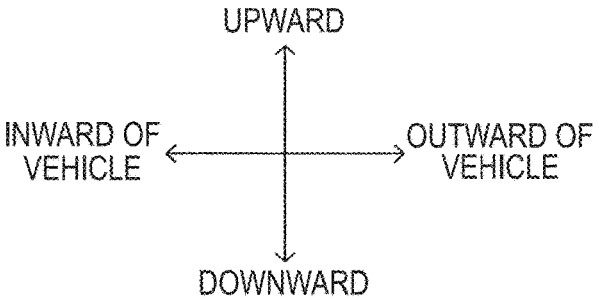

Next, an opening/closing mechanism according to a second embodiment will be described. FIG. 13 is a rear view of an opening/closing mechanism 40B according to the second embodiment. As illustrated in FIG. 13, the opening/closing mechanism 40B has a base member 51, a latch 52, a pawl 53, a block lever 54, a half latch lever 55, and a rotation transmission lever 56 serving as a rotation transmission mechanism.

The base member 51 supports various components of the opening/closing mechanism 40B. The base member 51 has a striker entering groove 511 having the same shape as the striker entering groove 411 formed in the base member 41 according to the first embodiment.

The base member 51 has a latch support shaft 58A, a pawl support shaft 58B, a block lever support shaft 58C, a half latch lever support shaft 58D, and a rotation transmission lever support shaft 58E. The support shafts respectively extend in the forward-rearward direction. The latch support shaft 58A is disposed at an upper position of the striker entering groove 511, and the other support shafts are disposed at lower positions of the striker entering groove 511. The pawl support shaft 58B is located on the side in the vehicle inward direction from the block lever support shaft 58C, and the block lever support shaft 58C is located on the side in the vehicle inward direction from the rotation transmission lever support shaft 58E. The half latch lever support shaft 58D is located above the rotation transmission lever support shaft 58E.

The latch 52 is rotatably supported by the latch support shaft 58A. Therefore, the latch 52 is supported by the base member 51 to be rotatable around the axis in the forward-rearward direction. The latch 52 has a support portion 521, a full latch claw portion 522, a half latch claw portion 523, and an intermediate claw portion 525. The support portion 521 configures a portion rotatably supported by the latch support shaft 58A. The full latch claw portion 522 and the intermediate claw portion 525 are bifurcated from the support portion 521 within the rotary plane of the latch 52, and extend in substantially the same direction. Therefore, a space is disposed between the full latch claw portion 522 and the intermediate claw portion 525, and a striker holding recess portion 524 is formed by the space.

The striker holding recess portion 524 is formed by a space surrounded with an inner wall surface of the full latch claw portion 522 and an inner wall surface of the intermediate claw portion 525 which face each other, and a bottom surface that connects base ends of the inner wall surfaces to each other. The striker holding recess portion 524 is open on an outer peripheral surface of the latch 52. Therefore, the full latch claw portion 522 and the intermediate claw portion 525 are formed across the striker holding recess portion 524. As will be understood from FIG. 13, the striker holding recess portion 524 is disposed at a position overlapping the striker entering groove 511 when viewed in the forward-rearward direction.

The full latch claw portion 522 is located forward in the rotation direction from the intermediate claw portion 525 in a case where the latch 52 rotates in the clockwise direction in FIG. 13. An engagement protruding portion 522*a* is formed in a tip portion of the full latch claw portion 522.

The intermediate claw portion 525 has an inner wall surface 525*a* which configures a portion of the wall surface of the striker holding recess portion 524 and which extends radially outward of the latch support shaft 58A from the support portion 521, an outer wall surface 525*b* which is located on a side opposite to the inner wall surface 525*a* and which extends in a direction substantially parallel to the inner wall surface 525*a*, and a tip wall surface 525*c* which defines a tip shape of the intermediate claw portion 525 by coupling the tip of the inner wall surface 525*a* and the tip of the outer wall surface 525*b* to each other. An outer shape of the intermediate claw portion 525 is defined by the wall surfaces. An engagement recessed portion 525*d* is formed on the tip wall surface 525*c* of the intermediate claw portion 525.

The half latch claw portion 523 is formed to protrude radially outward of the latch support shaft 58A from a base end portion of the outer wall surface 525*b* of the intermediate claw portion 525. The half latch claw portion 523 has a first engagement wall surface 523*a* which extends radially outward of the latch support shaft 58A from the base end of the outer wall surface 525*b* of the intermediate claw portion 525, and a second engagement wall surface 523*b* which configures a portion of the outer peripheral wall surface of the latch 52 and which is formed along the rotation direction of the latch 52 from a radially outer end of the first engagement wall surface 523*a*. An outer shape is defined by the wall surfaces.

A latch return spring 59A is attached to the latch support shaft 58A, and the latch return spring 59A biases the latch 52 in the clockwise direction indicated by an arrow D1 in FIG. 13. The latch 52 rotates in the clockwise direction by the rotational biasing force of the latch return spring 59A. However, the rotation is restricted by the latch 52 engaging with a latch stopper (not illustrated). The rotation position where the rotation of the latch 52 is restricted by the latch stopper is defined as the unlatch position. FIG. 13 illustrates the latch 52 located at the unlatch position.

The pawl 53 is rotatably supported by the pawl support shaft 58B. Therefore, the pawl 53 is supported by the base member 51 to be rotatable around the axis in the forward-rearward direction. The pawl 53 has a support portion 531, a first engagement arm 532, and a connecting arm 533, similarly to the pawl 43 according to the first embodiment. The configuration elements are the same as those according to the first embodiment, and thus, description thereof will be omitted. The first engagement arm 532 has an engagement wall surface 532*c*, an upper side wall surface 532*d*, and a lower side wall surface 532*e*, similarly to the first engagement arm 432 according to the first embodiment. An engagement protruding portion 532*a* protruding downward in FIG. 13 is formed in a boundary portion between the engagement wall surface 532*c* and the lower side wall surface 532*e*.

A pawl return spring 59B is attached to the pawl support shaft 58B, and the pawl return spring 59B biases the pawl 53 in the counterclockwise direction indicated by an arrow D2 in FIG. 13. The rotation of the pawl 53 in the counterclockwise direction by the rotational biasing force of the pawl return spring 59B is restricted by the pawl 53 engaging with a pawl stopper (not illustrated) disposed in the base member 51. The rotation position where the rotation of the pawl 53 is restricted by the pawl stopper is defined as the engagement position. FIG. 13 illustrates the pawl 53 located at the engagement position. The engagement position is the rotation position where the pawl 53 enters the rotation region of the full latch claw portion 522 of the latch 52 out of the rotation positions of the pawl 43.

The block lever 54 is rotatably supported by the block lever support shaft 58C. Therefore, the block lever 54 is supported by the base member 51 to be rotatable around the axis in the forward-rearward direction. The block lever 54 has a support portion 541, a second engagement arm 542, and a connecting arm 543. The second engagement arm 542 has an abutting wall surface 542*a*, a vehicle interior side wall surface 542*b*, and a vehicle exterior side wall surface 542*c*, similarly to the second engagement arm 442 according to the first embodiment. The configurations of the support portion 541 and the second engagement arm 542 are the same as the support portion 441 and the second engagement arm 442 which are included in the block lever 44 according to the first embodiment, and thus, specific description thereof will be omitted. The connecting arm 543 extends from the support portion 541 in a direction opposite to the extending direction of the second engagement arm 542. A lift lever (not illustrated) is connected to the connecting arm 543.

The block lever 54 according to the present embodiment further has a protruding portion 544 and an engagement piece 545. As illustrated in FIG. 13, the protruding portion 544 is formed to protrude outward of the vehicle in a triangular shape from the vehicle exterior side wall surface 542*c* of the second engagement arm 542. The engagement piece 545 extends downward from a protruding end of the protruding portion 544. The rotation transmission lever 56 (to be described later) engages with the engagement piece 545.

A block lever return spring 59C is attached to the block lever support shaft 58C. The block lever return spring 59C biases the block lever 54 in the counterclockwise direction indicated by an arrow D3 in FIG. 13. The rotation of the block lever 54 in the counterclockwise direction by the rotational biasing force of the block lever return spring 59C is restricted by the block lever 54 engaging with a block lever stopper (not illustrated) disposed in the base member 51. The rotation position where the rotation of the block lever 54 is restricted by the block lever stopper is defined as the restriction position. FIG. 13 illustrates the block lever 54 located at the restriction position. The restriction position is the rotation position where the block lever 54 enters the rotation region of the first engagement arm 532 of the pawl 53 out of the rotation positions of the block lever 54.

The half latch lever 55 is rotatably supported by the half latch lever support shaft 58D. Therefore, the half latch lever 55 is supported by the base member 51 to be rotatable around the axis in the forward-rearward direction. In this way, the half latch lever 55 is rotatable around the axis of the rotary shaft (half latch lever support shaft 58D) different from the rotary shaft (block lever support shaft 58C) of the block lever 54. The half latch lever 55 has a support portion 551, a half latch arm 552, a first rotation arm 553, and a second rotation arm 554.

The support portion 551 configures a portion rotatably supported by the half latch lever support shaft 58D. The half latch arm 552 extends radially outward of the half latch lever support shaft 58D from the support portion 551. In FIG. 13, the half latch arm 552 extends outward of the vehicle and obliquely upward from the support portion 551. The half latch arm 552 has a half latch engagement wall surface 552*a* and an engagement protruding portion 552*b*. The half latch engagement wall surface 552*a* includes a tip wall surface of the half latch arm 552. The engagement protruding portion 552*b* is formed to protrude in a direction from the half latch engagement wall surface 552*a* toward the latch 52.

The first rotation arm 553 and the second rotation arm 554 of the half latch lever 55 extend from the support portion 551 in a direction substantially opposite to the extending direction of the half latch arm 552. The first rotation arm 553 and the second rotation arm 554 extend to face each other from the support portion 551 at a predetermined interval. Therefore, a space is formed between the first rotation arm 553 and the second rotation arm 554.

A half latch lever return spring 59D is attached to the half latch lever support shaft 58D. The half latch lever return spring 59D biases the half latch lever 55 in the counterclockwise direction indicated by an arrow D4 in FIG. 13. Here, when the latch 52 is located at the unlatch position, as illustrated in FIG. 13, the engagement protruding portion 552*b* of the half latch arm 552 of the half latch lever 55 engages with the second engagement wall surface 523*b* of the latch 52. In this manner, the rotation of the half latch lever 55 in the counterclockwise direction is restricted.

The rotation transmission lever 56 is rotatably supported by the rotation transmission lever support shaft 58E. Therefore, the rotation transmission lever 56 is supported by the base member 51 to be rotatable around the axis in the forward-rearward direction. The rotation transmission lever 56 has a support portion 561, a first arm 562, and a second arm 563. The support portion 561 configures a portion rotatably supported by the rotation transmission lever support shaft 58E. The first arm 562 and the second arm 563 extend radially outward of the rotation transmission lever support shaft 58E in two mutually different directions from the support portion 561. An angle formed between the axis of the first arm 562 and the axis of the second arm 563 is approximately 120° in an example illustrated in FIG. 13.

In FIG. 13, the first arm 562 extends in the vehicle inward direction from the support portion 561 toward the block lever 54. As illustrated in FIG. 13, the engagement piece 545 of the block lever 54 is coupled to the first arm 562 extending toward the block lever 54. The engagement piece 545 is coupled to the first arm 562 across a side wall of the first arm 562. Therefore, the engagement piece 545 can move in the axial direction of the first arm 562, but cannot move in other directions. That is, the engagement piece 545 is coupled to the first arm 562 to be movable in the axial direction of the first arm 562 and to be immovable in other directions.

The second arm 563 extends obliquely upward from the support portion 561 toward the half latch lever 55, and a tip side portion thereof is located in a space between the first rotation arm 553 and the second rotation arm 554 of the half latch lever 55. In FIG. 13, the first rotation arm 553 is located on the left side of the second arm 563, and the second rotation arm 554 is located on the right side of the second arm 563.

The rotation transmission lever 56 is located between the block lever 54 and the half latch lever 55 in the above-described manner. Accordingly, for example, if the block lever 54 rotates in the clockwise direction in FIG. 13, the first arm 562 of the rotation transmission lever 56 coupled to the block lever 54 is pressed downward in FIG. 13. Therefore, the rotation transmission lever 56 rotates in the counterclockwise direction. If the rotation transmission lever 56 rotates in the counterclockwise direction, the second arm 563 of the rotation transmission lever 56 moves close to the first rotation arm 553 of the half latch lever 55, eventually abuts on the first rotation arm 553, and presses the first rotation arm 553 in the vehicle inward direction. In this manner, the half latch lever 55 rotates in the clockwise direction. For example, if the block lever 54 rotates in the counterclockwise direction in FIG. 13, the first arm 562 of the rotation transmission lever 56 is pulled upward in FIG. 13. Therefore, the rotation transmission lever 56 rotates in the clockwise direction. If the rotation transmission lever 56 rotates in the clockwise direction, the second arm 563 of the rotation transmission lever 56 moves close to the second rotation arm 554 of the half latch lever 55, eventually abuts on the second rotation arm 554, and presses the second rotation arm 554 in the vehicle outward direction. In this manner, the half latch lever 55 rotates in the counterclockwise direction. In this way, the rotation transmission lever 56 has a role of transmitting the rotation of one of the levers 55 and 56 to the other so that the block lever 54 and the half latch lever 55 rotate in the same direction. When the second arm 563 of the rotation transmission lever 56 is located in a space region between the first rotation arm 553 and the second rotation arm 554 of the half latch lever 55, the rotation transmission lever 55 does not abut on the half latch lever 55. In this case, the rotation transmission lever 56 does not play the above-described role, and the half latch lever 55 and the block lever 54 can rotate independently of each other.

An operation of the opening/closing mechanism 40B having the above-described configuration will be described.

When the vehicle door 10 is open, the operation state of the opening/closing mechanism 40B is as illustrated in FIG. 13. In this case, the latch 52 is located at the unlatch position. The pawl 53 is rotationally restricted at the engagement position illustrated in FIG. 13 in a state of engaging with the pawl stopper. The block lever 54 is rotationally restricted at the restriction position illustrated in FIG. 13 in a state of engaging with the block lever stopper. When the block lever 54 is located at the restriction position illustrated in FIG. 13, the second engagement arm 542 of the block lever 54 is located below the first engagement arm 532 of the pawl 53. The rotation transmission lever 56 is located at the rotation position so that the engagement state with the engagement piece 545 of the block lever 54 can be maintained by the first arm 562. As described above, the half latch lever 55 is located at a position engaging with the second engagement wall surface 523*b* of the latch 52 located at the unlatch position. In this case, both the first rotation arm 553 and the second rotation arm 554 of the half latch lever 55 are not in contact with the second arm 563 of the rotation transmission lever 56 located therebetween. The operation state of the opening/closing mechanism 40B as illustrated in FIG. 13 is the unlatch state.

If the vehicle door 10 performs the closing operation, the striker ST disposed in the vehicle body enters the striker entering groove 511 of the base member 51, and further, moves the striker entering groove 511 in the vehicle outward direction. The striker ST is eventually received by the striker holding recess portion 524 of the latch 52. In this manner, the striker ST is held by the latch 52.

If the closing operation of the vehicle door 10 is progressively performed and the striker ST moves the striker entering groove 511 in the vehicle outward direction, the latch 52 is pressed by the striker ST, and rotates in the counterclockwise direction in FIG. 13 against the rotational biasing force of the latch return spring 59A.

Due to the rotation of the above-described latch 52 in the counterclockwise direction, the engagement position between the second engagement wall surface 523*b* of the half latch claw portion 523 of the latch 52 and the engagement protruding portion 552*b* of the half latch arm 552 engaging therewith is shifted to the tip side of the second engagement wall surface 523*b*. When the above-described engagement position exceeds the tip of the second engagement wall surface 523*b*, both of these disengage from each other.

Figure 14:
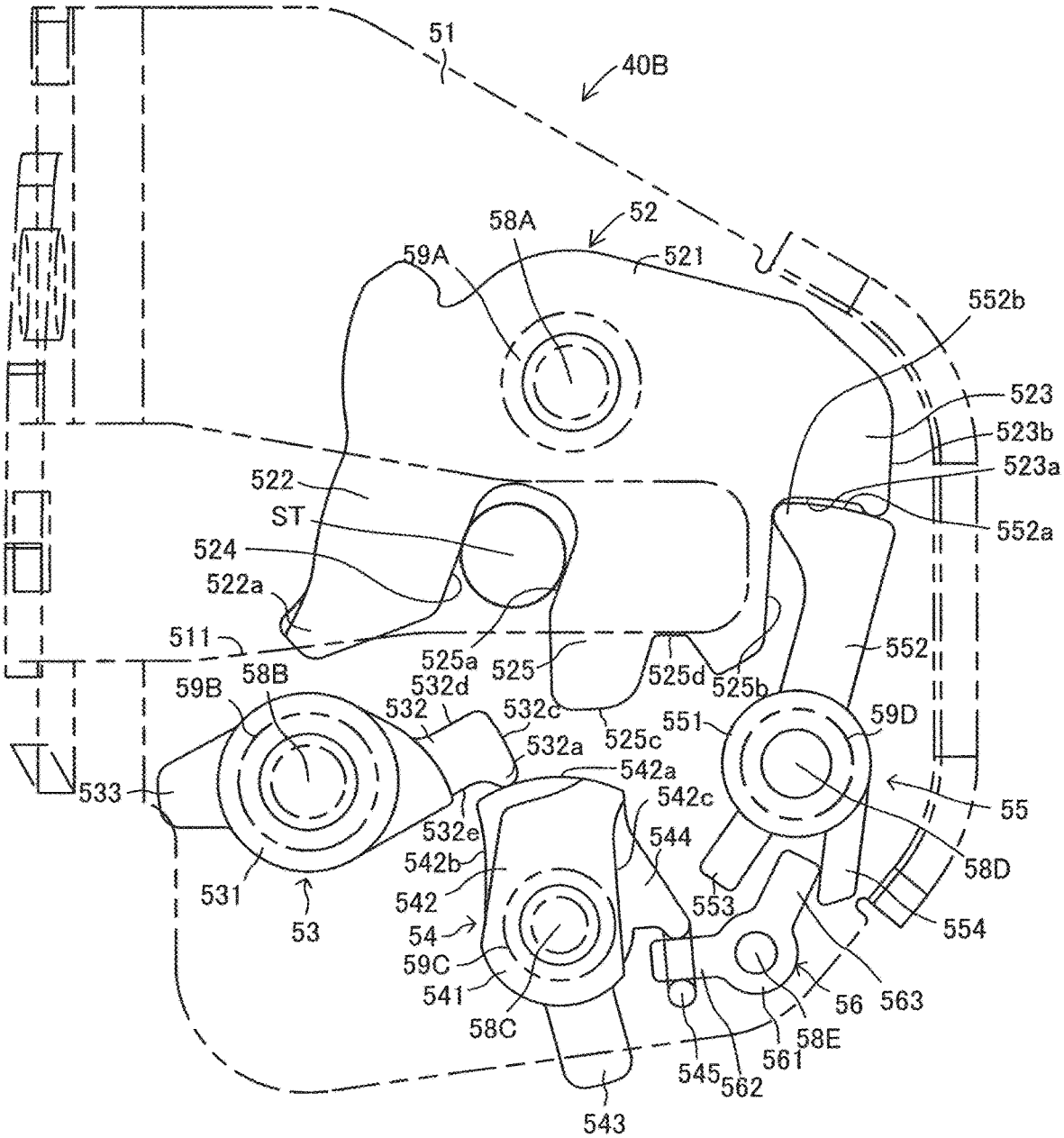
FIG. 14 is a rear view of the opening/closing mechanism which illustrates a half latch arm located at an operation position.

FIG. 14 is a rear view of the opening/closing mechanism 40B which illustrates a state immediately after the engagement protruding portion 552*b* of the half latch arm 552 and the second engagement wall surface 523*b* of the half latch claw portion 523 disengage from each other during the closing operation of the vehicle door 10. If the engagement protruding portion 552*b* of the half latch arm 552 and the second engagement wall surface 523*b* disengage from each other, the half latch lever 55 rotates in the counterclockwise direction due to the rotational biasing force of the half latch lever return spring 59D. As illustrated in FIG. 14, the engagement protruding portion 552*b* of the half latch arm 552 engages with the outer wall surface 525*b* of the intermediate claw portion 525 of the latch 52, thereby restricting the rotation of the half latch lever 55. In this case, the half latch engagement wall surface 552*a* of the half latch arm 552 is located to face the first engagement wall surface 523*a* of the half latch claw portion 523 of the latch 52. The rotation position of the latch 52 where the first engagement wall surface 523*a* of the half latch claw portion 523 faces the half latch engagement wall surface 552*a* is defined as the half latch position.

When the operation state of the opening/closing mechanism 40B is the operation state illustrated in FIG. 14, in a case where the closing operation of the vehicle door 10 is completed, the striker ST stops moving, and the latch 52 tries to rotate in the clockwise direction (direction toward the unlatch position) in accordance with the rotational biasing force of the latch return spring 59A. However, the rotation is restricted since the half latch engagement wall surface 552*a* of the half latch lever 55 engages with the first engagement wall surface 523*a* of the half latch claw portion 523. In this way, when the latch 52 is located at the half latch position, the half latch lever 55 according to the present embodiment engages with the half latch claw portion 523. In this manner, the half latch lever 55 can be located at the position (operation position) inside the operation region which is the rotation region where the rotation of the latch is restricted in the direction toward the unlatch position, that is, the region where the latch 52 enters the rotation region of the half latch claw portion 523. As illustrated in FIG. 14, the operation state of the opening/closing mechanism 40B where the rotation of the latch 52 in the clockwise direction (direction toward the unlatch position) is restricted at the half latch position by the half latch lever 55 located at the operation position is called the half latch state. When in the half latch state, the vehicle door 10 is brought into a so-called half closed state. In this case, the vehicle door 10 is closed in a slightly open state compared to a fully closed state, and the closed state is maintained.

The pawl 53 is located at the engagement position while the operation state of the opening/closing mechanism 40B is switched from the unlatch state to the half latch state. If the operation state of the opening/closing mechanism 40B is switched from the unlatch state to the half latch state, the first rotation arm 553 and the second rotation arm 554 of the half latch lever 55 rotate in the counterclockwise direction from the position illustrated in FIG. 13. However, during the time, the rotation arms do not come into contact with the second arm 563 of the rotation transmission lever 56 located therebetween.

Figure 15:
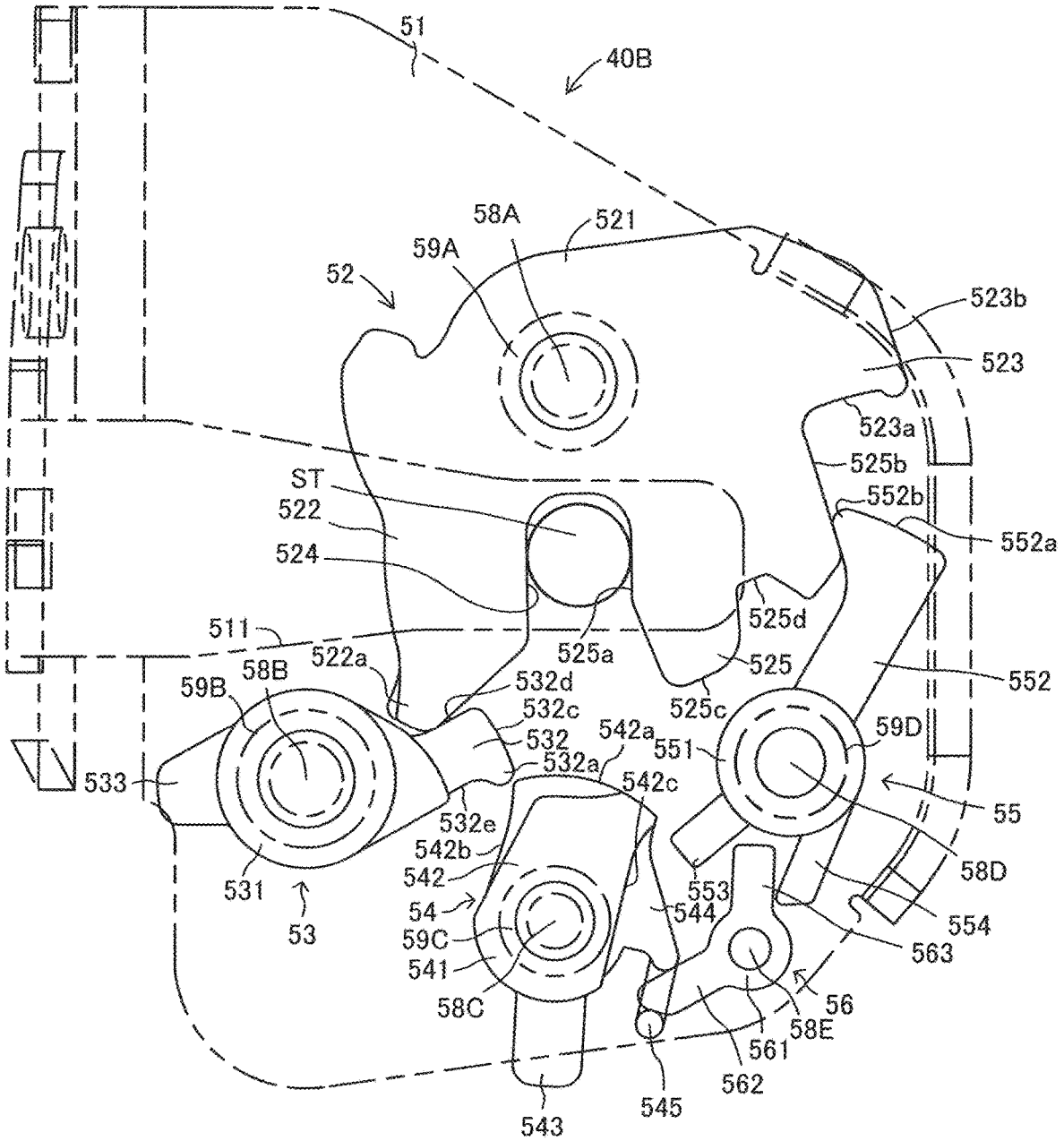
FIG. 15 is a rear view of the opening/closing mechanism which illustrates a state where a striker is further moved in a vehicle outward direction from a state illustrated in FIG. 14.

FIG. 15 is a rear view of the opening/closing mechanism 40B which illustrates a state where the vehicle door 10 further performs the closing operation and the striker ST moves in the vehicle outward direction from the state illustrated in FIG. 14. As illustrated in FIG. 15, if the striker ST further moves in the vehicle outward direction, the latch 52 further rotates in the counterclockwise direction. Then, the half latch engagement wall surface 552*a* of the half latch arm 552 is separated from the first engagement wall surface 523*a* of the half latch claw portion 523. The engagement position between the engagement protruding portion 552*b* of the half latch arm 552 and the outer wall surface 525*b* of the intermediate claw portion 525 of the latch 52 is shifted to the tip side of the intermediate claw portion 525. Due to the rotation of the latch 52 in the counterclockwise direction, the intermediate claw portion 525 moves to be shaken to the side in the vehicle outward direction around the latch support shaft 58A. Accordingly, the engagement position between the outer wall surface 525*b* of the intermediate claw portion 525 and the engagement protruding portion 552*b* of the half latch arm 552 also moves toward the side in the vehicle outward direction. The engagement position moves in the vehicle outward direction in this way. Accordingly, the half latch lever 55 rotates in the clockwise direction so that a tip side of the half latch arm 552 moves outward of the vehicle.

Therefore, the half latch lever 55 rotates in the clockwise direction from the rotation position illustrated in FIG. 14. In this case, the half latch lever 55 rotates in the clockwise direction from the position illustrated in FIG. 14, inside the rotation region, that is, the operation region where the half latch lever 55 enters the rotation region of the half latch claw portion 523. The clockwise direction of the half latch lever 55 from the position illustrated in FIG. 14 is a direction in which the half latch lever 55 is retreated from the rotation region of the half latch claw portion 523. If the rotation region in which the half latch lever 55 is retreated from the rotation region of the half latch claw portion 523 out of the rotation regions of the half latch lever 50 is defined as the non-operation region, when the latch 52 rotates in the direction from the half latch position to the full latch position (to be described later), the half latch lever 55 rotates in the direction toward the non-operation region inside the operation region.

If the half latch lever 55 rotates in the clockwise direction from the position illustrated in FIG. 14, the second rotation arm 554 of the half latch lever 55 moves in a direction close to the second arm 563 of the rotation transmission lever 56, and the second rotation arm 554 abuts on the second arm 563. Thereafter, the half latch lever 55 further rotates in the clockwise direction. In this manner, the rotation transmission lever 56 is pressed by the second rotation arm 554 of the half latch lever 55 in the second arm 563, and rotates in the counterclockwise direction. If the rotation transmission lever 56 rotates in the counterclockwise direction, the engagement piece 545 of the block lever 54 coupled to the first arm 562 of the rotation transmission lever 56 is pressed downward to be pulled by the first arm 562. The engagement piece 545 of the block lever 54 is pressed downward. Accordingly, the block lever 54 rotates in the clockwise direction from the restriction position against the rotational biasing force of the block lever return spring 59C, and reaches non-restriction position. FIG. 15 illustrates the block lever 54 located at the non-restriction position. The non-restriction position is the rotation position where the block lever 54 is retreated from the rotation region of the first engagement arm 532 of the pawl 43 out of the rotation positions of the block lever 54. In this way, the block lever 54 is rotatable between the restriction position where the block lever 54 enters the rotation region of the pawl and the non-restriction position where the block lever 54 is retreated from the rotation region of the pawl.

The latch 52 rotates in the counterclockwise direction. In this manner, the engagement protruding portion 522*a* of the full latch claw portion 522 of the latch 52 moves close to the pawl 53, and eventually, the engagement protruding portion 522*a* of the full latch claw portion 522 comes into contact with the first engagement arm 532 of the pawl 53. FIG. 15 illustrates a state where the engagement protruding portion 522*a* of the full latch claw portion 522 abuts on the upper side wall surface 532*d* of the first engagement arm 532 of the pawl 53. If the latch 52 further rotates in the counterclockwise direction from the state illustrated in FIG. 15, the first engagement arm 532 of the pawl 53 is pressed by the full latch claw portion 522, and rotates in the clockwise direction. In this manner, as in the first embodiment, the pawl 53 rotates from the engagement position to the disengagement position which is the rotation position where the pawl 53 is retreated from the rotation region of the full latch claw portion 522. In this way, the pawl 53 is rotatable from the engagement position where the pawl 53 enters the rotation region of the full latch claw portion 522 to the disengagement position where the pawl 53 is retreated from the rotation region of the full latch claw portion 522. When the pawl 53 rotates from the engagement position to the disengagement position as described above, the first engagement arm 532 of the pawl 53 rotates downward from the position illustrated in FIG. 15. However, when the pawl 53 and the full latch claw portion 522 abut on each other, the block lever 54 rotates in the clockwise direction. Accordingly, the block lever 54 moves to a position separated from the lower position of the pawl 53, that is, the non-restriction position where the block lever 54 is retreated from the rotation region of the pawl 53. That is, the block lever 54 is located at the non-restriction position when the pawl 53 rotates in the direction from the engagement position toward the disengagement position. Therefore, the rotation of the above-described pawl 53 is not hindered by the second engagement arm 542 of the block lever 54.

If the vehicle door 10 further performs the closing operation and the striker ST moves in the vehicle outward direction from the state illustrated in FIG. 15, the contact position between the engagement protruding portion 522*a* of the full latch claw portion 522 of the latch 52 and the upper side wall surface 532*d* of the first engagement arm 532 of the pawl 53 is shifted to the tip side of the first engagement arm 532, and eventually, the full latch claw portion 522 and the first engagement arm 532 of the pawl 53 disengage from each other. Then, the pawl 53 is completely pressed by the full latch claw portion 522. The pawl 53 rotates in the counterclockwise direction in accordance with the rotational biasing force of the pawl return spring 59B, and returns to the engagement position.

When the full latch claw portion 522 of the latch 52 is located at the position separated from the first engagement arm 532 of the pawl 53, the vehicle door 10 is in substantially the fully closed state. Therefore, the striker ST stops moving, and the latch 52 tries to rotate in the clockwise direction in accordance with the rotational biasing force of the latch return spring 59A. In this way, the engagement protruding portion 522*a* disposed in the full latch claw portion 522 of the latch 52 rotationally biased in the clockwise direction engages with the engagement wall surface 532*c* disposed in the first engagement arm 532 of the pawl 53 located at the engagement position. In this manner, the rotation of the latch 52 in the clockwise direction by the rotational biasing force of the latch return spring 59A is restricted. In this way, the position of the latch 52 whose rotation is restricted by the pawl 53 located at the engagement position is defined as the full latch position. In this way, the latch 52 can rotate in the rotation region between the unlatch position and the full latch position, and the striker ST moves in the vehicle outward direction in response to the closing operation of the vehicle door 10. In this manner, the latch 52 rotates from the unlatch position to the full latch position.

The operation state of the opening/closing mechanism 40B in which the rotation of the latch 52 in the clockwise direction at the full latch position is restricted by the pawl 53 located at the engagement position is called the full latch state. In the full latch state, the vehicle door 10 is in a fully closed state. In the full latch state, the latch return spring 59A rotationally biases the latch 52 in the clockwise direction from the full latch position toward the unlatch position.

Figure 16:
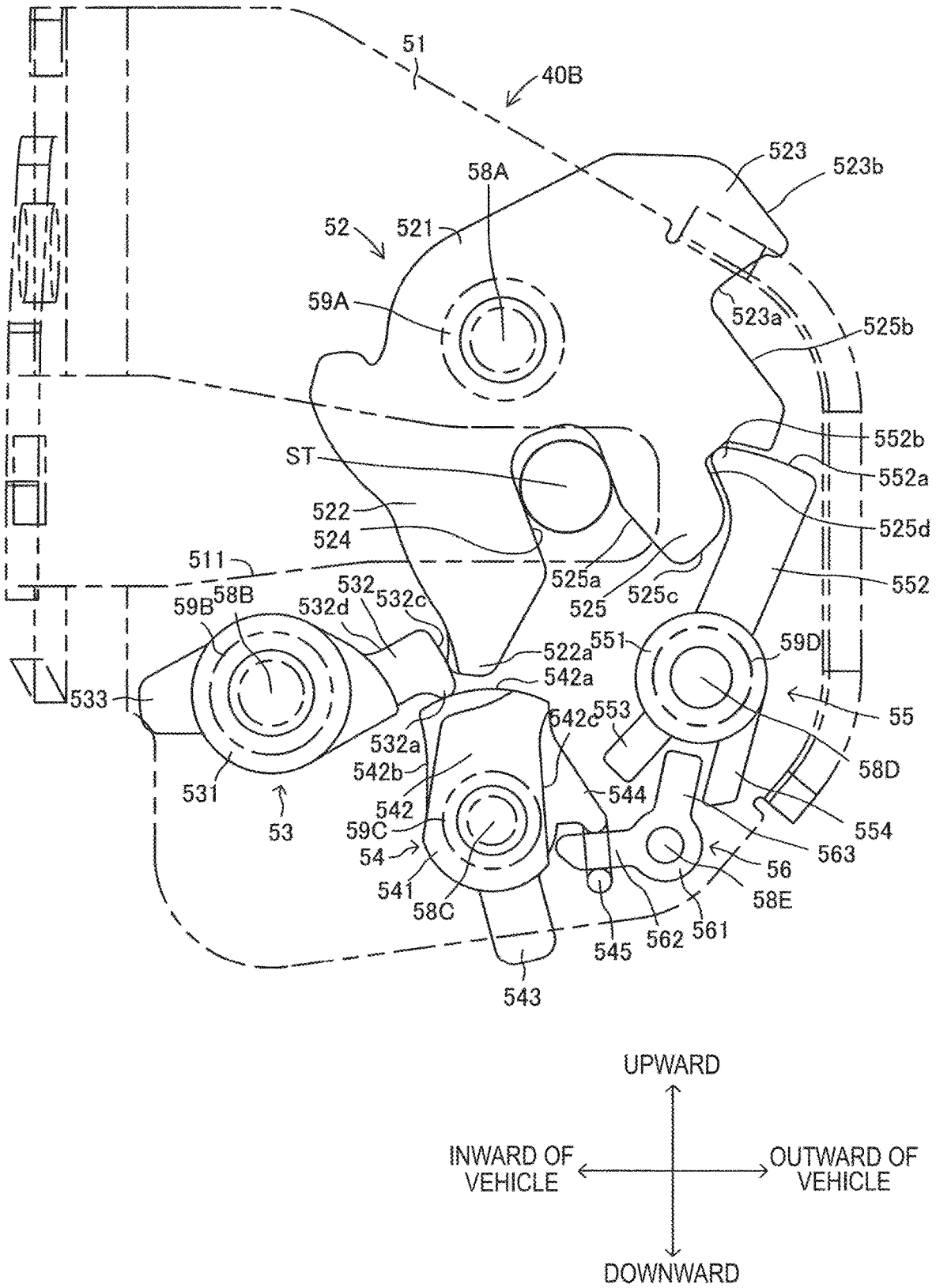
FIG. 16 is a rear view of the opening/closing mechanism in the full latch state.

FIG. 16 is a rear view of the opening/closing mechanism 40B in the full latch state. When the operation state of the opening/closing mechanism 40B is the full latch state illustrated in FIG. 16, the latch 52 located at the full latch position holds the striker ST so that the striker ST cannot be released. The pawl 53 rotates from the disengagement position to the engagement position, and is rotationally restricted at the engagement position. The half latch arm 552 of the half latch lever 55 is rotationally restricted by the engagement protruding portion 552*b* engaging with the engagement recessed portion 525*d* disposed on the tip wall surface 525*c* of the intermediate claw portion 525. Here, when the half latch arm 552 engages with the engagement recessed portion 525*d* of the intermediate claw portion 525, the half latch lever 55 rotates in the counterclockwise direction in accordance with the rotational biasing force of the half latch lever return spring 59D. In response to the rotation, the second rotation arm 554 of the half latch lever 55 rotates in the counterclockwise direction from the rotation position illustrated in FIG. 15. Accordingly, the second arm 563 of the rotation transmission lever 56 and the second rotation arm 554 of the half latch lever 55 disengage from each other. In this manner, the rotation transmission lever 56 can rotate independently of the half latch lever 55, and the block lever 54 coupled to the first arm 562 of the rotation transmission lever 56 no longer receives the rotational biasing force from the half latch lever 55. Therefore, the block lever 54 rotates in the counterclockwise direction in accordance with the rotational biasing force of the block lever return spring 59C. In this manner, the block lever 54 rotates from the non-restriction position to the restriction position, and is rotationally restricted at the restriction position. In this case, the second engagement arm 542 of the block lever 54 is hidden under the first engagement arm 532 of the pawl 53 located at the engagement position. In this way, when the pawl 53 rotates from the disengagement position to the engagement position and is located at the engagement position, the block lever 54 rotates from the non-restriction position to the restriction position.

When in the full latch state, due to the biasing force applied from the latch 52, the pawl 53 receives a force in the direction against the rotational biasing force of the pawl return spring 59B, that is, a rotating force acting in the clockwise direction. In this manner, the first engagement arm 532 of the pawl 53 tries to rotate around the pawl support shaft 58B so that the tip side faces downward in FIG. 16. On the other hand, in the full latch state illustrated in FIG. 16, the block lever 54 located at the restriction position is hidden under the first engagement arm 532 of the pawl 53 located at the engagement position. Therefore, the rotation of the first engagement arm 532 is restricted since the engagement protruding portion 532*a* of the first engagement arm 532 abuts on the abutting wall surface 542*a* of the second engagement arm 542 of the block lever 54. In this way, the pawl 53 restricts the rotation of the latch 52, and the block lever 54 restricts the rotation of the pawl 53.

Figure 17:
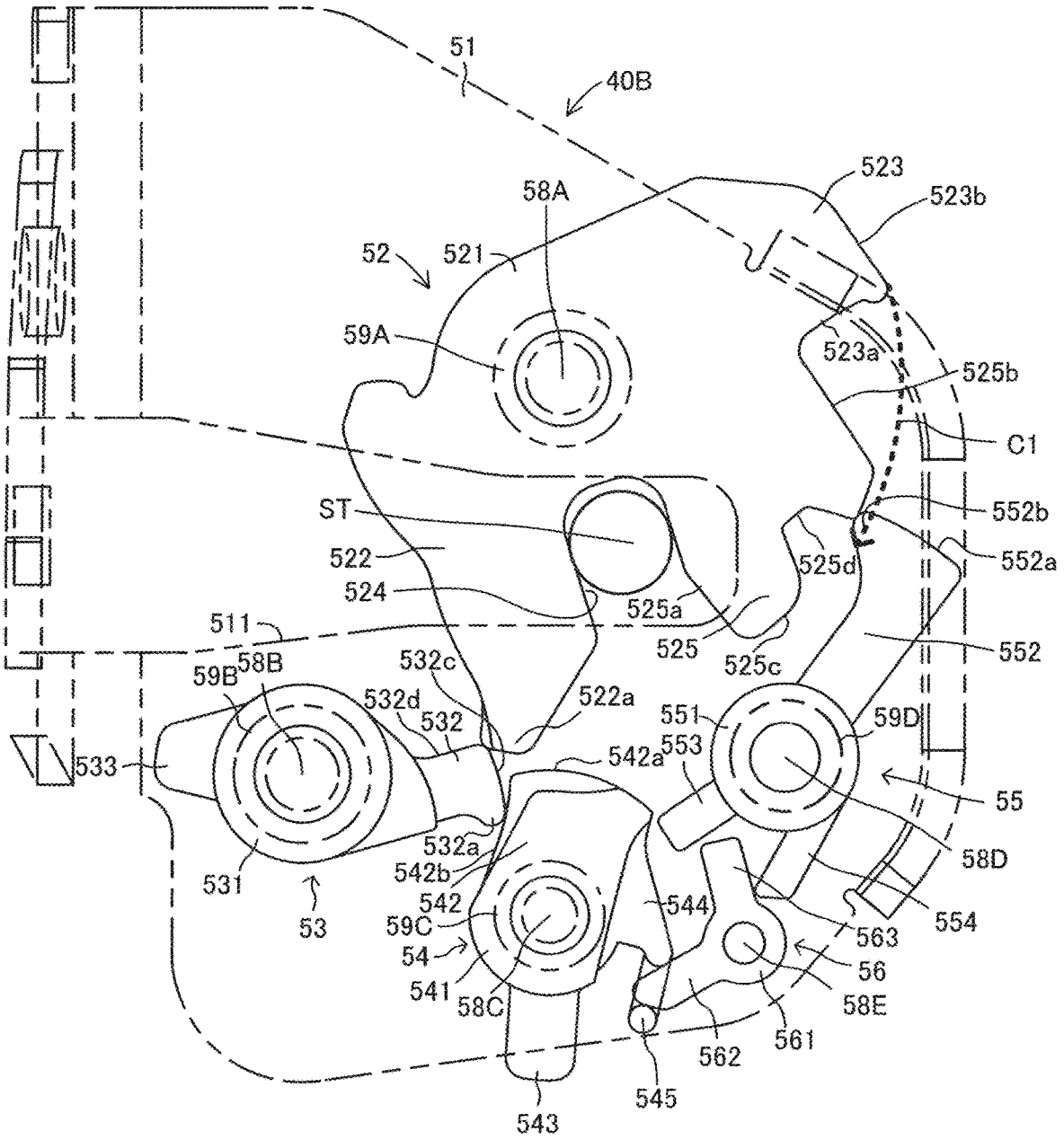
FIG. 17 is a rear view of the opening/closing mechanism in the pseudo latch state.
Figure 17:
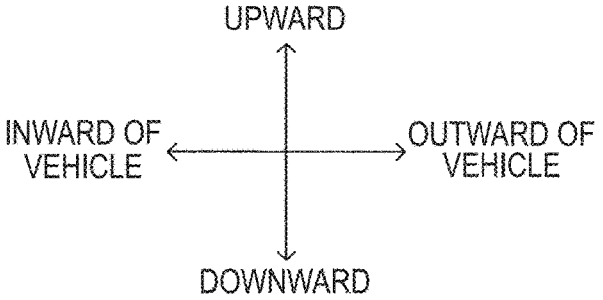

In the opening/closing mechanism 40B according to the present embodiment, there is also a possibility that the operation state may fall into the pseudo latch state. FIG. 17 is a rear view of the opening/closing mechanism 40B in which the operation state is the pseudo latch state. When in the pseudo latch state, the engagement protruding portion 522*a* of the latch 52 engages with an upper portion of the engagement wall surface 532*c* of the pawl 53. The second engagement arm 542 of the block lever 54 is not hidden under the first engagement arm 532 of the pawl 53, and the vehicle interior side wall surface 542*b* of the second engagement arm 542 of the block lever 54 engages with the engagement wall surface 532*c* of the first engagement arm 532 the pawl 53. This engagement state occurs since the pawl 53 engages with the latch 52 before reaching the normal engagement position illustrated in FIG. 16 and the block lever 54 engages with the pawl 53 before reaching the normal restriction position illustrated in FIG. 16.

When in the pseudo latch state, the rotation position of the latch 52 is a position slightly rotated in the clockwise direction from the full latch position. Accordingly, the half latch arm 552 of the half latch lever 55 is rotationally restricted in a state of engaging with the tip wall surface 525*c* at a position immediately in front of a position where the half latch arm 552 enters the engagement recessed portion 525*d* formed on the tip wall surface 525*c* of the intermediate claw portion 525 of the latch 52 when in the full latch state. Here, as described above, when the latch 52 rotates in the direction from the half latch position toward the full latch position, the half latch lever 55 rotates in the direction toward the non-operation region inside the operation region. That is, while the latch 52 located from the half latch position to the full latch position, the half latch lever 55 rotates in the direction toward the non-operation region inside the operation region. The rotation position of the latch 52 when in the pseudo latch state is the rotation position between the half latch position and the full latch position. Accordingly, when in the pseudo latch state, the half latch lever 55 partially enters the rotation region of the half latch claw portion 523 whose rotation locus is defined by a broken line arrow C1 in FIG. 17, and is located at the rotation position. That is, the rotation position of the half latch lever 55 when in the pseudo latch state is the operation position inside the operation region where the rotation of the latch 52 in the direction toward the unlatch position is restricted by partially engaging with the half latch claw portion 523 located at the half latch position.

When in the pseudo latch state, in a case where the latch 52 and the pawl 53 disengage from each other and the latch 52 rotates in the clockwise direction due to the rotational biasing force of the latch return spring 59A, the latch 52 is rotationally restricted at the half latch position by engaging with the half latch arm 552 located at the operation position. That is, the operation state of the opening/closing mechanism 40B is changed to the half latch state. Therefore, the closed state of the vehicle door 10 is maintained. In this way, according to the present embodiment, the vehicle door 10 can also be effectively prevented from being opened due to the pseudo latch state.

If the pseudo latch state is released, in response to the rotation of the latch 52 in the unlatch direction (counterclockwise direction), the half latch lever 55 rotates in the counterclockwise direction while sliding on the outer wall surface 525*b* of the intermediate claw portion 525 due to the rotational biasing force of the half latch lever return spring 59D. Therefore, when the latch 52 is located from the pseudo latch position (rotation position when in the pseudo latch state) to the half latch position, as illustrated in FIG. 14, a substantially entire surface of the half latch engagement wall surface 552*a* of the half latch lever 55 is brought into a state of engaging with the first engagement wall surface 523*a* of the half latch claw portion 523.

Figure 18:
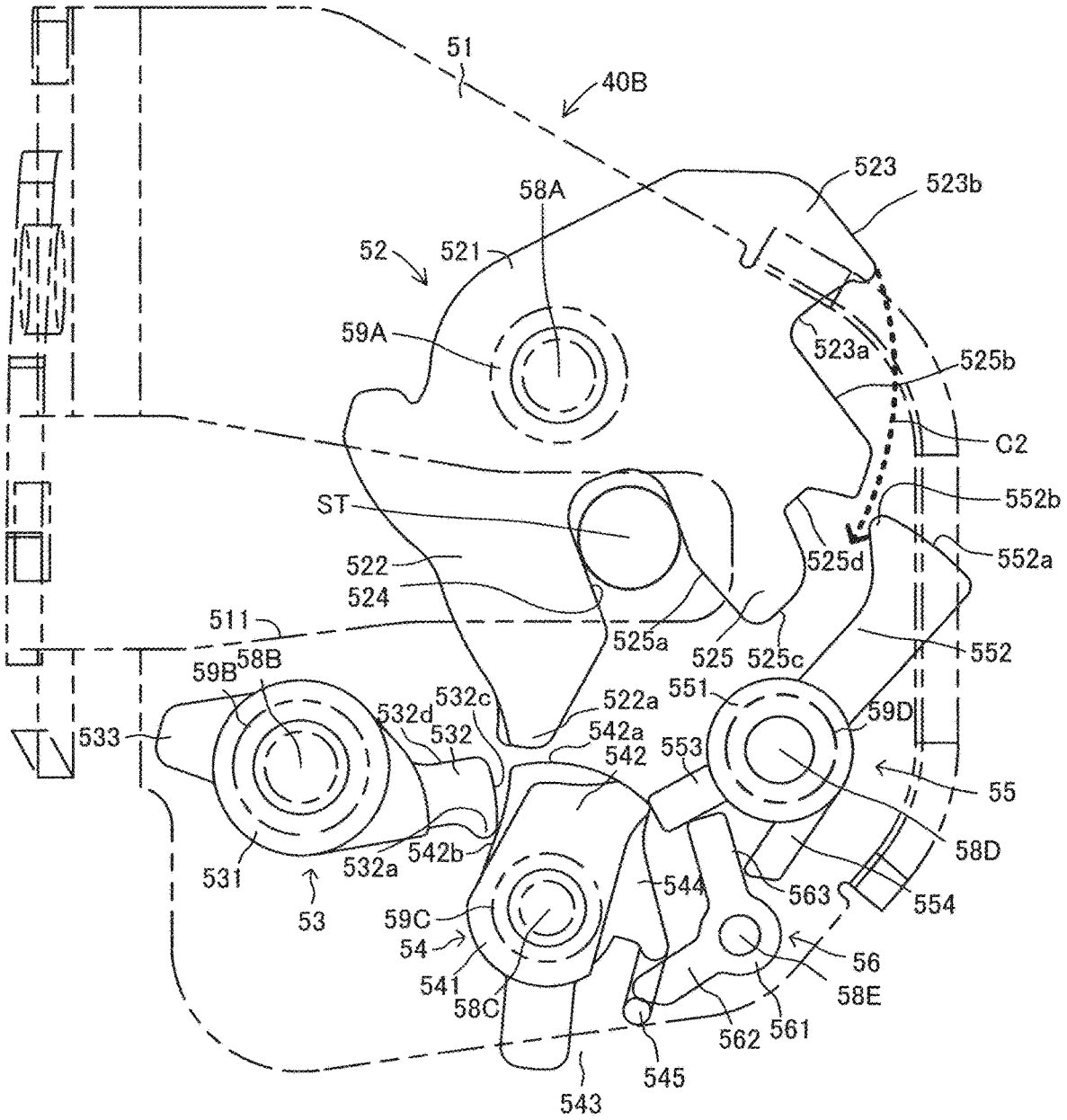
FIG. 18 is a rear view of the opening/closing mechanism which illustrates a state where the block lever rotates in the clockwise direction from a restriction position toward a non-restriction position illustrated in FIG. 16.
Figure 18:
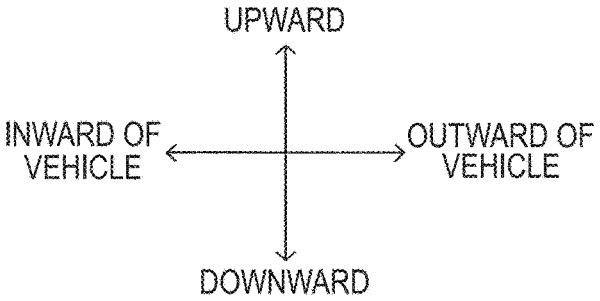

In a case where the vehicle door 10 in the fully closed state is opened, the door outside handle 17 or the door inside handle disposed in the vehicle door 10 is rotated from the initial position to the opening position. In this manner, the operation lever is operated inside the locking/unlocking mechanism 30 of the vehicle door lock device 20, and the block lever 54 rotates in the clockwise direction from the restriction position toward the non-restriction position illustrated in FIG. 16. FIG. 18 is a rear view of the opening/closing mechanism 40B which illustrates a state where the block lever 54 rotates in the clockwise direction from the restriction position toward the non-restriction position illustrated in FIG. 16. As illustrated in FIG. 18, if the block lever 54 rotates in the clockwise direction, the second engagement arm 542 of the block lever 54 is separated from the first engagement arm 532 of the pawl 53. In this manner, the pawl 53 rotates in the clockwise direction by receiving the biasing force input from the latch 52 and the elastic reaction force of the weather strip installed in the peripheral edge of the vehicle door 10. Even in a case where the pawl 53 is not rotated by the input load, a lift lever (not illustrated) presses the connecting arm 533 of the pawl 53 in response to the rotation of the block lever 54. In this manner, the pawl 53 rotates in the clockwise direction. The lift lever has the same configuration as a third extension arm 764 of a block lift lever 76 illustrated in the fourth embodiment (to be described later).

The block lever 54 rotates in the clockwise direction. In this manner, the first arm 562 of the rotation transmission lever 56 coupled to the engagement piece 545 of the block lever 54 is pressed downward. In this manner, the rotation transmission lever 56 rotates in the counterclockwise direction. The second arm 563 of the rotation transmission lever 56 abuts on the first rotation arm 553 of the half latch lever 55 by the rotation of the rotation transmission lever 56 in the counterclockwise direction. In this state, the rotation transmission lever 56 further rotates in the counterclockwise direction. Accordingly, the half latch lever 55 rotates in the clockwise direction. In this manner, as illustrated in FIG. 18, the half latch lever 55 rotates to a position (non-operation position) inside the non-operation region which is the rotation region where the half latch lever 55 is retreated from the rotation region of the half latch claw portion 523 whose rotation locus is defined by a broken line arrow C2. In this way, the half latch lever 55 can rotate between the operation position inside the operation region and the non-operation position inside the non-operation region. The rotation transmission lever 56 transmits the rotation of the block lever 54 to the half latch lever 55 so that the half latch lever 55 rotates in the direction from the operation position toward the non-operation position due to the rotational force in a case where the block lever 54 rotates from the restriction position to the non-restriction position.

The pawl 53 rotates in the clockwise direction. Accordingly, the engagement protruding portion 522*a* disposed in the full latch claw portion 522 of the latch 52 and the engagement wall surface 532*c* formed in the first engagement arm 532 of the pawl 53 disengage from each other. In this manner, the latch 52 rotates in the clockwise direction in accordance with the rotational biasing force of the latch return spring 59A. As described above, the half latch lever 55 is located at the non-operation position where the half latch lever 55 is retreated from the rotation region of the half latch claw portion 523. Accordingly, the rotation of the latch 52 in the clockwise direction is not hindered by the half latch lever 55. Therefore, the latch 52 is located again at the unlatch position. In this case, the striker ST can be separated from the striker holding recess portion 524 of the latch 52, and move the striker entering groove 511 in the vehicle outward direction. Accordingly, the vehicle door 10 can be opened.

In this way, according to the present embodiment, while the latch 52 rotates from the half latch position to the full latch position when the vehicle door 10 is closed, the half latch lever 55 rotates in the direction toward the non-operation region inside the operation region. That is, the half latch lever 55 is located at the operation position when the rotation position of the latch 52 during the closing operation of the vehicle door 10 is located at the rotation position between the half latch position and the full latch position. Therefore, even when in the pseudo latch state, the half latch lever 55 is located at the operation position. In a case where the pseudo latch state is released, the latch 52 engages with the half latch lever 55 located at the operation position. Accordingly, the vehicle door is prevented from being opened.

Third Embodiment

Figure 19:
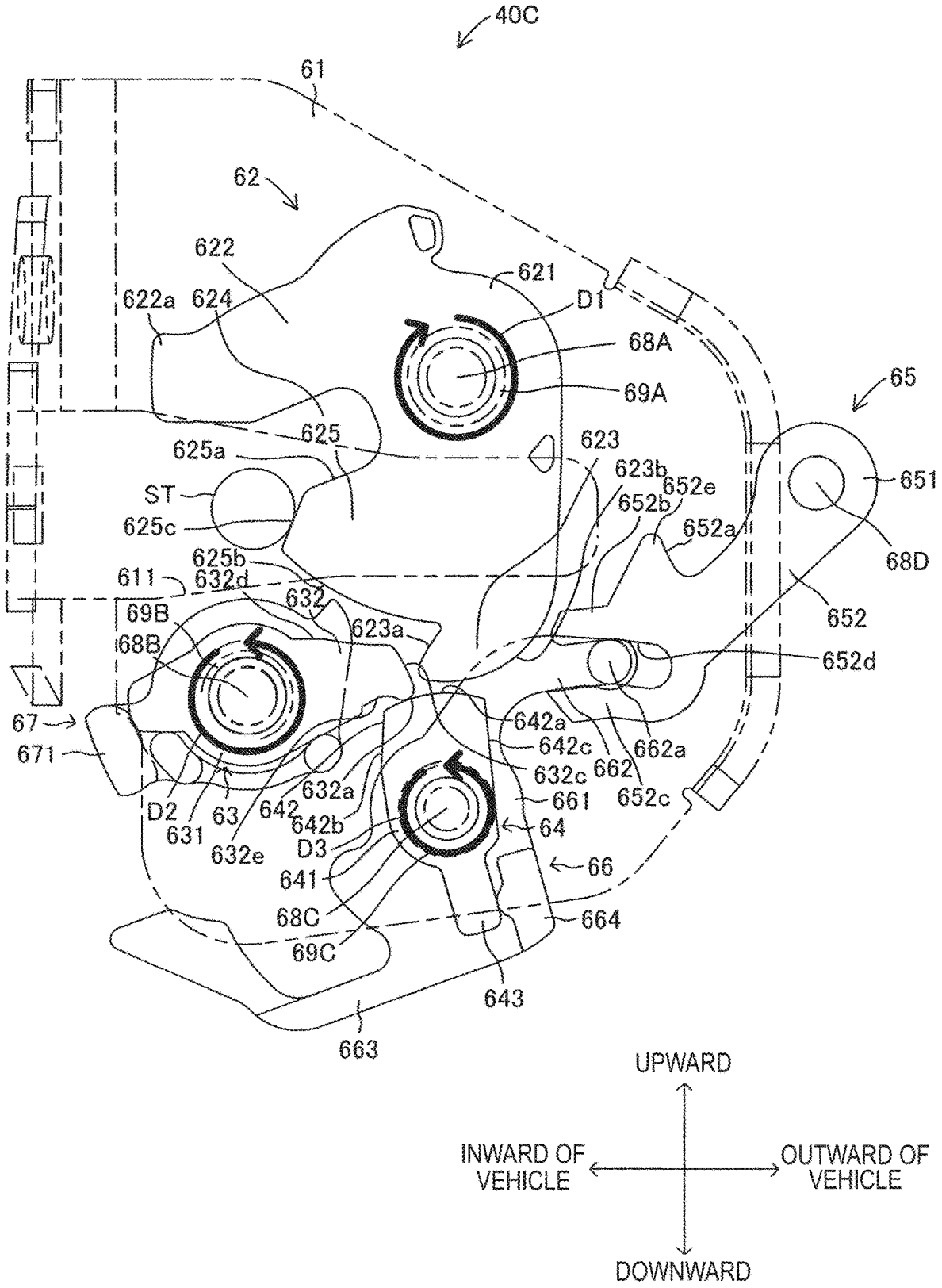
FIG. 19 is a rear view of an opening/closing mechanism according to a third embodiment.

Next, an opening/closing mechanism according to a third embodiment will be described. FIG. 19 is a rear view of an opening/closing mechanism 40C according to the third embodiment. As illustrated in FIG. 19, the opening/closing mechanism 40C has a base member 61, a latch 62, a pawl 63, a block lever 64, a half latch lever 65, a block lift lever 66, and a pawl lift lever 67.

The base member 61 supports various components of the opening/closing mechanism 40C. The base member 61 has a striker entering groove 611 having the same shape as the striker entering groove 411 formed in the base member 41 according to the first embodiment.

The base member 61 has a latch support shaft 68A, a pawl support shaft 68B, and a block lever support shaft 68C. The support shafts respectively extend in the forward-rearward direction. The latch support shaft 68A is disposed at an upper position of the striker entering groove 611, and the pawl support shaft 68B and the block lever support shaft 68C are disposed at lower positions of the striker entering groove 611. The pawl support shaft 68B is located on the side in the vehicle inward direction from the block lever support shaft 68C.

A half latch lever support shaft 68D is disposed in an auxiliary bracket (not illustrated) extending in the vehicle outward direction from the base member 61. The half latch lever support shaft 68D also extends in the forward-rearward direction. The half latch lever support shaft 68D is located at substantially the same position as the striker entering groove 611 in the upward-downward direction position, and is disposed at an outward position of the vehicle from the latch support shaft 68A and the striker entering groove 611.

The latch 62 is rotatably supported by the latch support shaft 68A. Therefore, the latch 62 is supported by the base member 61 to be rotatable around the axis in the forward-rearward direction. The latch 62 has a support portion 621, a full latch claw portion 622, a half latch claw portion 623, and an intermediate claw portion 625. The support portion 621 configures a portion rotatably supported by the latch support shaft 68A. The full latch claw portion 622 and the intermediate claw portion 625 are bifurcated from the support portion 621 within the rotary plane of the latch 62, and extend in substantially the same direction. Therefore, a space is disposed between the full latch claw portion 622 and the intermediate claw portion 625, and a striker holding recess portion 624 is formed by the space.

The striker holding recess portion 624 is formed by a space surrounded with an inner wall surface of the full latch claw portion 622 and an inner wall surface of the intermediate claw portion 625 which face each other, and a bottom surface that connects base ends of the inner wall surfaces to each other. The striker holding recess portion 624 is open on an outer peripheral surface of the latch 62. Therefore, the full latch claw portion 622 and the intermediate claw portion 625 are formed across the striker holding recess portion 624. As will be understood from FIG. 19, the striker holding recess portion 624 is disposed at a position overlapping the striker entering groove 611 when viewed in the forward-rearward direction.

The full latch claw portion 622 is located forward in the rotation direction from the intermediate claw portion 625 in a case where the latch 62 rotates in the clockwise direction in FIG. 19. An engagement protruding portion 622*a* is formed in a tip portion of the full latch claw portion 622.

The intermediate claw portion 625 has an inner wall surface 625*a* which configures a portion of the wall surface of the striker holding recess portion 624 and which extends radially outward of the latch support shaft 68A from the support portion 621, a tip wall surface 625*c* which extends obliquely downward in the vehicle inward direction in FIG. 19 from an extended end of the inner wall surface 625*a*, and an outer wall surface 625*b* which extends in a curved shape in the vehicle inward direction from a lower end of the tip wall surface 625*c*. An outer shape thereof is defined by the wall surfaces. The outer wall surface 625*b* is formed in an arc shape around the latch support shaft 68A.

The half latch claw portion 623 is formed to protrude from a base end portion of the outer wall surface 625*b* of the intermediate claw portion 625. The half latch claw portion 623 has a first engagement wall surface 623*a* which extends from the base end of the outer wall surface 625*b* of the intermediate claw portion 625, and a second engagement wall surface 623*b* which configures a portion of the outer peripheral wall surface of the latch 62 and which is formed along the rotation direction of the latch 62 from the extended end of the first engagement wall surface 623*a*. An outer shape thereof is defined by the wall surfaces.

A latch return spring 69A is attached to the latch support shaft 68A, and the latch return spring 69A biases the latch 62 in the clockwise direction indicated by an arrow D1 in FIG. 19. The latch 62 rotates in the clockwise direction due to the rotational biasing force of the latch return spring 69A. However, the rotation is restricted by the latch 62 engaging with a latch stopper (not illustrated). The rotation position where the rotation of the latch 62 is restricted by the latch stopper is defined as the unlatch position. FIG. 19 illustrates the latch 62 located at the unlatch position.

The pawl 63 is rotatably supported by the pawl support shaft 68B. Therefore, the pawl 63 is supported by the base member 61 to be rotatable around the axis in the forward-rearward direction. The pawl 63 has a support portion 631 and a first engagement arm 632, similarly to the pawl 43 according to the first embodiment. The configuration elements are the same as those according to the first embodiment, and thus, description thereof will be omitted. The first engagement arm 632 has an engagement wall surface 632*c*, an upper side wall surface 632*d*, and a lower side wall surface 632*e*, similarly to the first engagement arm 432 according to the first embodiment. An engagement protruding portion 632*a* protruding downward in FIG. 19 is formed in a boundary portion between the engagement wall surface 632*c* and the lower side wall surface 632*e*.

The pawl lift lever 67 is rotatably supported by the pawl support shaft 68B. The pawl lift lever 67 is coupled to the pawl 63 so that the pawl support shaft 68B can rotate integrally with the pawl 63. In the present embodiment, the pawl lift lever 67 is supported by the pawl support shaft 68B to overlap the pawl 63 on a front side of the pawl 63. The pawl lift lever 67 has a connecting arm 671 which extends in the vehicle inward direction in FIG. 19 from the pawl support shaft 68B. The connecting arm 671 has the same function as the connecting arm 433 of the pawl 43 according to the first embodiment.

A pawl return spring 69B is attached to the pawl support shaft 68B, and the pawl return spring 69B biases the pawl 63 in the counterclockwise direction indicated by an arrow D2 in FIG. 19. The rotation of the pawl 63 in the counterclockwise direction by the rotational biasing force of the pawl return spring 69B is restricted by the pawl 63 engaging with a pawl stopper (not illustrated) disposed in the base member 61. The rotation position of the pawl 63 whose rotation is restricted by the pawl stopper is defined as the engagement position. FIG. 19 illustrates the pawl 63 located at the engagement position. The engagement position is the rotation position where the pawl 63 enters the rotation region of the full latch claw portion 622 of the latch 62 out of the rotation positions of the pawl 63.

The block lever 64 is rotatably supported by the block lever support shaft 68C. Therefore, the block lever 64 is supported by the base member 61 to be rotatable around the axis in the forward-rearward direction. The block lever 64 has a support portion 641, a second engagement arm 642, and a connecting arm 643. The second engagement arm 642 has an abutting wall surface 642*a*, a vehicle interior side wall surface 642*b*, and a vehicle exterior side wall surface 642*c*, similarly to the second engagement arm 442 according to the first embodiment. The configurations of the support portion 641 and the second engagement arm 642 are the same as the support portion 441 and the second engagement arm 442 which are included in the block lever 44 according to the first embodiment, and thus, specific description thereof will be omitted. The connecting arm 643 extends from the support portion 641 in a direction opposite to the extending direction of the second engagement arm 642.

The block lift lever 66 is rotatably supported together with the block lever 64 by the block lever support shaft 68C. Therefore, the block lift lever 66 is supported by the base member 61 to be rotatable around the axis in the forward-rearward direction. In the present embodiment, the block lift lever 66 is supported by the block lever support shaft 68C to overlap the block lever 64 on the front side of the block lever 64. The block lift lever 66 has a support portion 661, a first extension arm 662, and a second extension arm 663. The support portion 661 configures a portion rotatably supported by the block lever support shaft 68C. The first extension arm 662 is formed to extend while being curved in the vehicle outward direction from the upper side of the support portion 661 in FIG. 19. An engagement pin 662*a* is disposed in the extended end of the first extension arm 662. The engagement pin 662*a* extends rearward from the tip portion of the first extension arm 662. The second extension arm 663 is formed to extend in the vehicle outward direction from the lower side of the support portion 661 in FIG. 19 and so that the extended end side is bent upward.

The block lift lever 66 has an engagement protruding portion 664. The engagement protruding portion 664 is formed to protrude rearward from the lower portion of the support portion 661 of the block lift lever 66, and to protrude in the direction toward the connecting arm 643 of the block lever 64.

A block lever return spring 69C is attached to the block lever support shaft 68C, and the block lever return spring 69C biases the block lever 64 and the block lift lever 66 in the counterclockwise direction indicated by an arrow D3 in FIG. 19. The rotation of the block lever 64 in the counterclockwise direction by the rotational biasing force of the block lever return spring 69C is restricted by the block lever 64 engaging with a block lever stopper (not illustrated) disposed in the base member 61. The rotation position of the block lever 64 whose rotation is restricted by the block lever stopper is defined as the restriction position. FIG. 19 illustrates the block lever 64 located at the restriction position. The restriction position is the rotation position where the block lever 64 enters the rotation region of the first engagement arm 632 of the pawl 63 out of the rotation positions of the block lever 64.

The half latch lever 65 is rotatably supported by the half latch lever support shaft 68D. Therefore, the half latch lever 65 is supported by the base member 61 to be rotatable around the axis in the forward-rearward direction. As illustrated in FIG. 19, the half latch lever 65 can rotate around the axis of the rotary shaft (half latch lever support shaft 68D) different from the rotary shaft (block lever support shaft 68C) of the block lever 64. The half latch lever 65 has a support portion 651 and a half latch arm 652. The support portion 651 configures a portion rotatably supported by the half latch lever support shaft 68D. The half latch arm 652 extends in the direction from the support portion 651 toward the block lift lever 66.

The first tip piece 652*b* and the second tip piece 652*c* which are bifurcated are formed in the tip of the half latch arm 652. The engagement groove 652*d* is formed by a space between the first tip piece 652*b* and the second tip piece 652*c*. The engagement groove 652*d* is open in the tip of the half latch arm 652, and extends to be curved in the vehicle outward direction in FIG. 19 from an opening end thereof. An engagement protruding portion 652*e* is formed to protrude upward in FIG. 19 from the vicinity of the base end of the first tip piece 652*b*. The half latch engagement wall surface 652*a* is formed by the wall surface facing the half latch lever support shaft 68D out of the wall surfaces configuring the engagement protruding portion 652*e*.

The engagement pin 662*a* disposed in the extended end of the first extension arm 662 of the block lift lever 66 engages with the engagement groove 652*d* of the half latch arm 652. Therefore, the first extension arm 662 of the half latch arm 652 and the block lift lever 66 engage with each other in the respective tip portions. Here, as described above, the block lift lever 66 is rotationally biased in the counterclockwise direction in FIG. 19 by the rotational biasing force of the block lever return spring 69C. Accordingly, the rotational biasing force is transmitted to the half latch arm 652. In this manner, the tip portion of the half latch arm 652 is pulled in the vehicle inward direction in FIG. 19. The tip portion of the half latch arm 652 is pulled in the vehicle inward direction. Accordingly, the half latch lever 65 is rotationally biased in the clockwise direction around the half latch lever support shaft 68D. The rotation of the half latch lever 65 in the clockwise direction is restricted by the engagement between the engagement pin 662*a* and the engagement groove 652*d*. In this case, the rotation of the block lift lever 66 in the counterclockwise direction is also restricted by the above-described engagement. In this way, both the levers restrict the rotation of the other lever. FIG. 19 illustrates the rotation position of both the levers in which both the levers are rotationally restricted and balanced. When the half latch lever 65 is located at the position illustrated in FIG. 19, the first tip piece 652*b* of the half latch arm 652 is located close to the second engagement wall surface 623*b* of the half latch claw portion 623 of the latch 62 from the side in the vehicle outward direction.

An operation of the opening/closing mechanism 40C having the above-described configuration will be described. When the vehicle door 10 is open, an operation state of the opening/closing mechanism 40C is as illustrated in FIG. 19. In this case, the latch 62 is located at the unlatch position. The pawl 63 is rotationally restricted at the engagement position illustrated in FIG. 19 in a state of engaging with the pawl stopper. The block lever 64 is rotationally restricted at the restriction position illustrated in FIG. 19 in a state of engaging with the block lever stopper. When the block lever 64 is located at the restriction position illustrated in FIG. 19, the second engagement arm 642 of the block lever 64 is located below the first engagement arm 632 of the pawl 63. As described above, the half latch lever 65 and the block lift lever 66 are rotationally restricted at the position where the rotation of both the levers rotated by the rotational biasing force of the block lever return spring 69C is restricted by the engagement between the engagement pin 662*a* and the engagement groove 652*d*. The operation state of the opening/closing mechanism 40C as illustrated in FIG. 19 is the unlatch state.

If the vehicle door 10 performs the closing operation, the striker ST disposed in the vehicle body enters the striker entering groove 611 of the base member 61, and further, moves the striker entering groove 611 in the vehicle outward direction. The striker ST is eventually received by the striker holding recess portion 624 of the latch 62. In this manner, the striker ST is held by the latch 62.

If the closing operation of the vehicle door 10 is progressively performed and the striker ST moves the striker entering groove 611 in the vehicle outward direction, the latch 62 is pressed by the striker ST, and rotates in the counterclockwise direction in FIG. 19 against the rotational biasing force of the latch return spring 69A.

Figure 20:
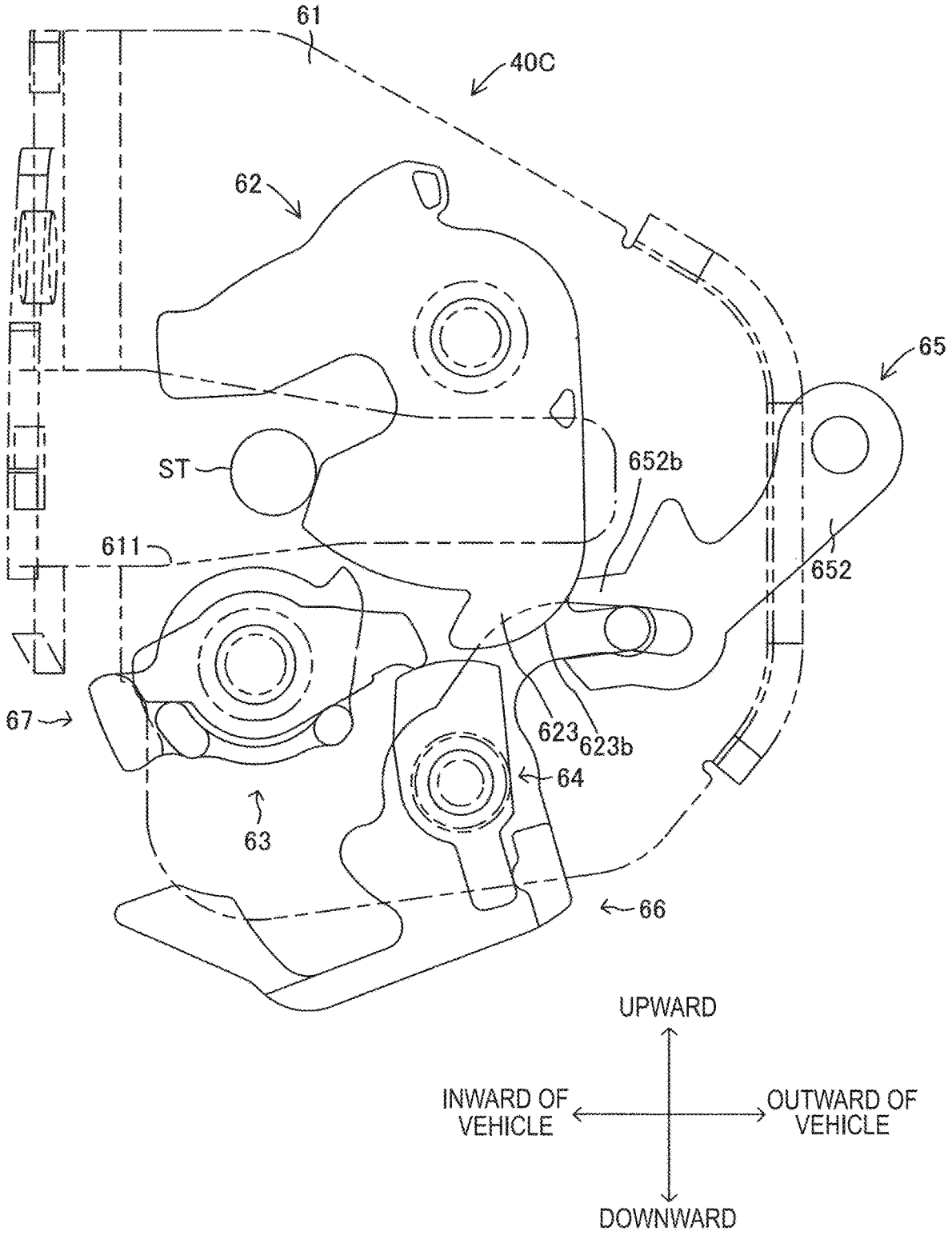
FIG. 20 is a rear view of the opening/closing mechanism which illustrates a state where the latch progressively rotates in the counterclockwise direction from a state illustrated in FIG. 19.
Figure 21:
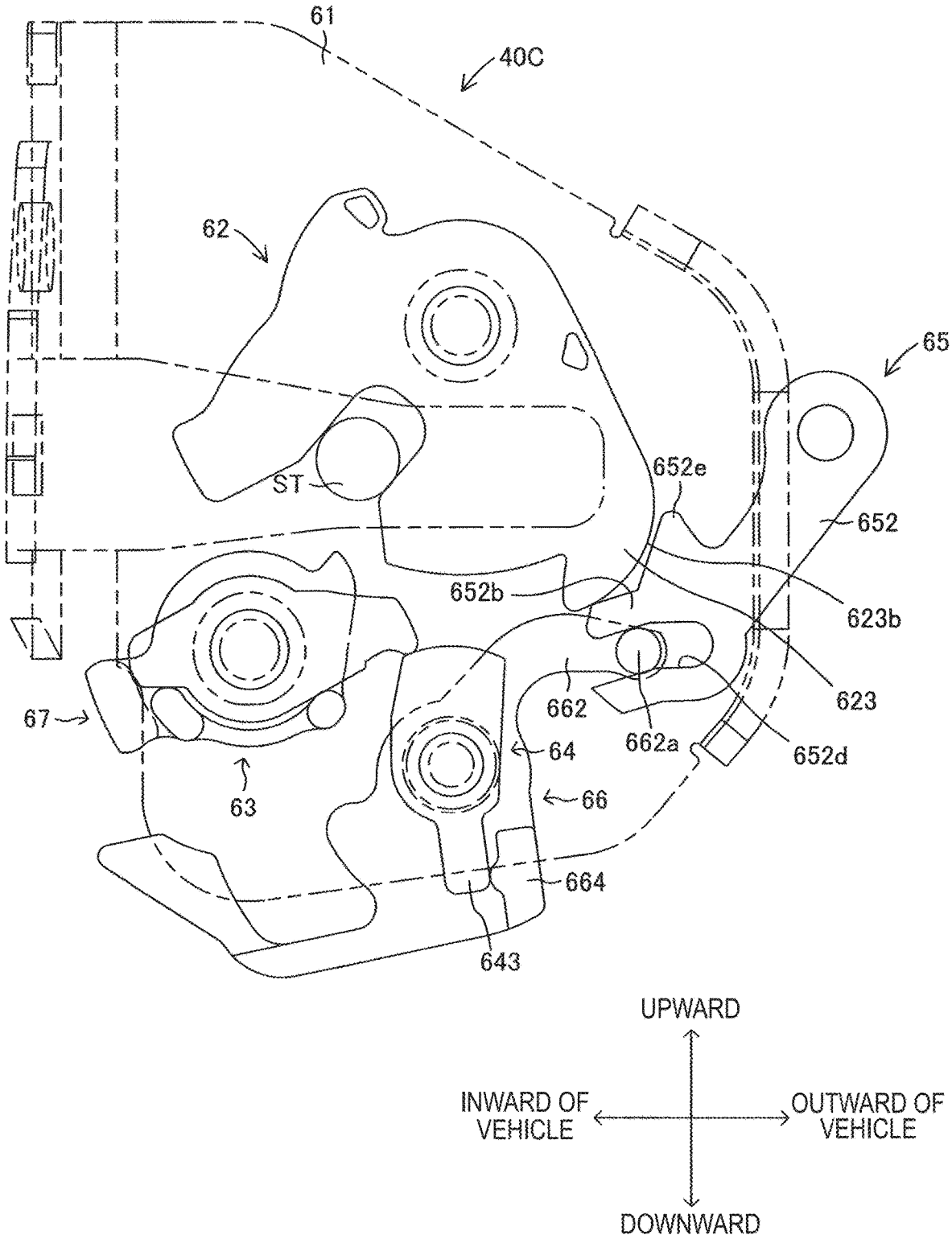
FIG. 21 is a rear view of the opening/closing mechanism which illustrates a state where the half latch lever is rotated in the counterclockwise direction by the latch.

The latch 62 rotates in the counterclockwise direction. Accordingly, the second engagement wall surface 623*b* of the half latch claw portion 623 of the latch 62 moves close to the first tip piece 652*b* of the half latch arm 652. As illustrated in FIG. 20, the first tip piece 652*b* eventually comes into contact with the second engagement wall surface 623*b*. If the latch 62 further rotates in the counterclockwise direction, the first tip piece 652*b* of the half latch arm 652 moves in the vehicle outward direction to be pressed by the latch 62. In this manner, the half latch lever 65 rotates in the counterclockwise direction. FIG. 21 is a rear view of the opening/closing mechanism 40C which illustrates a state where the half latch lever 65 is rotated in the counterclockwise direction by the latch 62.

As illustrated in FIG. 21, if the half latch lever 65 rotates in the counterclockwise direction, the engagement protruding portion 652*e* protruding from the base end of the first tip piece 652*b* of the half latch arm 652 moves close to the second engagement wall surface 623*b* of the half latch claw portion 623 of the latch 62, and engages with the second engagement wall surface 623*b*. If the half latch lever 65 rotates in the counterclockwise direction, the block lift lever 66 engaging with the engagement groove 652*d* of the half latch lever 65 by using the engagement pin 662*a* is pulled by the half latch lever 65 while maintaining the engagement between the engagement groove 652*d* and the engagement pin 662*a*. Therefore, the block lift lever 66 rotates in the clockwise direction. In this case, the engagement pin 662*a* slides inside the engagement groove 652*d* while maintaining the engagement with the engagement groove 652*d*. If the block lift lever 66 rotates in the clockwise direction, the engagement protruding portion 664 of the block lift lever 66 comes into contact with the connecting arm 643 of the block lever 64, and presses the connecting arm 643 in the vehicle inward direction. Therefore, the block lever 64 rotates together with the block lift lever 66 in the clockwise direction from the restriction position.

Figure 22:
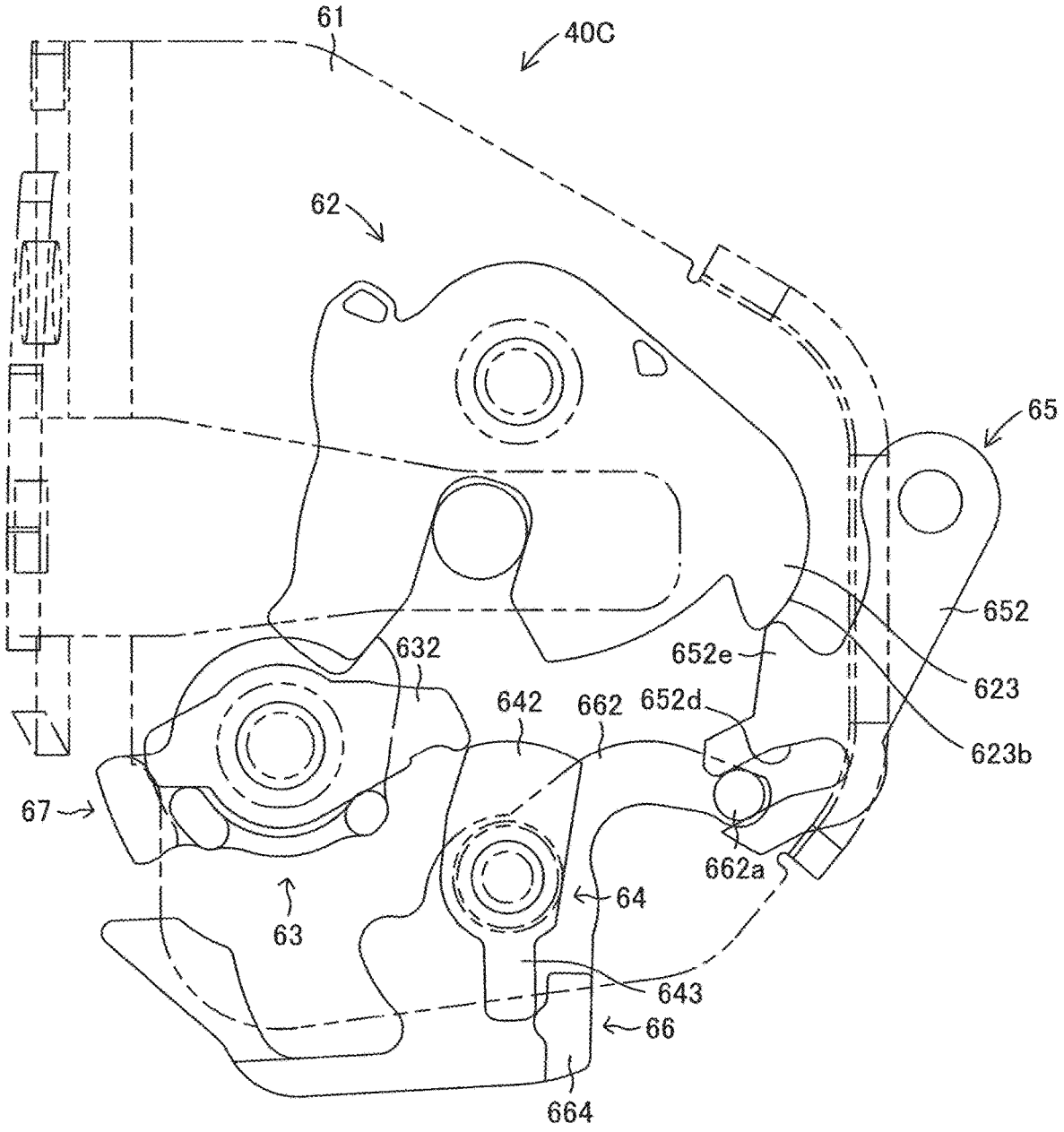
FIG. 22 is a rear view of the opening/closing mechanism which illustrates a state where the latch progressively rotates in the counterclockwise direction from a state illustrated in FIG. 21.

FIG. 22 is a rear view of the opening/closing mechanism 40C which illustrates a state where the latch 62 progressively rotates in the counterclockwise direction from the state illustrated in FIG. 21. As can be understood from the comparison between FIGS. 21 and 22, if the latch 62 further rotates in the clockwise direction, the engagement position between the engagement protruding portion 652*e* of the half latch arm 652 and the second engagement wall surface 623*b* of the half latch claw portion 623 of the latch 62 is shifted to the tip side of the half latch claw portion 623. The half latch arm 652 further rotates in the counterclockwise direction. In response to the rotation, the block lift lever 66 further rotates in the clockwise direction. In conjunction with the rotation of the block lift lever 66 in the clockwise direction, the block lever 64 engaging with the engagement protruding portion 664 of the block lift lever 66 in the connecting arm 643 also further rotates in the clockwise direction. Therefore, the block lever 64 rotates from the restriction position illustrated in FIG. 19 to the non-restriction position illustrated in FIG. 22. At the non-restriction position, the second engagement arm 642 of the block lever 64 is located at a position separated downward of the first engagement arm 632 of the pawl 63. This position is a position where the block lever 64 is retreated from the rotation region of the pawl 63. That is, the block lever 64 is rotatable between the restriction position where the block lever 64 enters the rotation region of the pawl 63 and the non-restriction position where the block lever 64 is retreated from the rotation region of the pawl 63.

If the latch 62 further rotates in the clockwise direction from the position illustrated in FIG. 22, the engagement position between the engagement protruding portion 652*e* of the half latch arm 652 and the second engagement wall surface 623*b* of the half latch claw portion 623 of the latch 62 further moves to the tip side of the half latch claw portion 623, and eventually, the engagement protruding portion 652*e* of the half latch arm 652 exceeds the tip of the second engagement wall surface 623*d*. In this manner, both of these disengage from each other.

Figure 23:
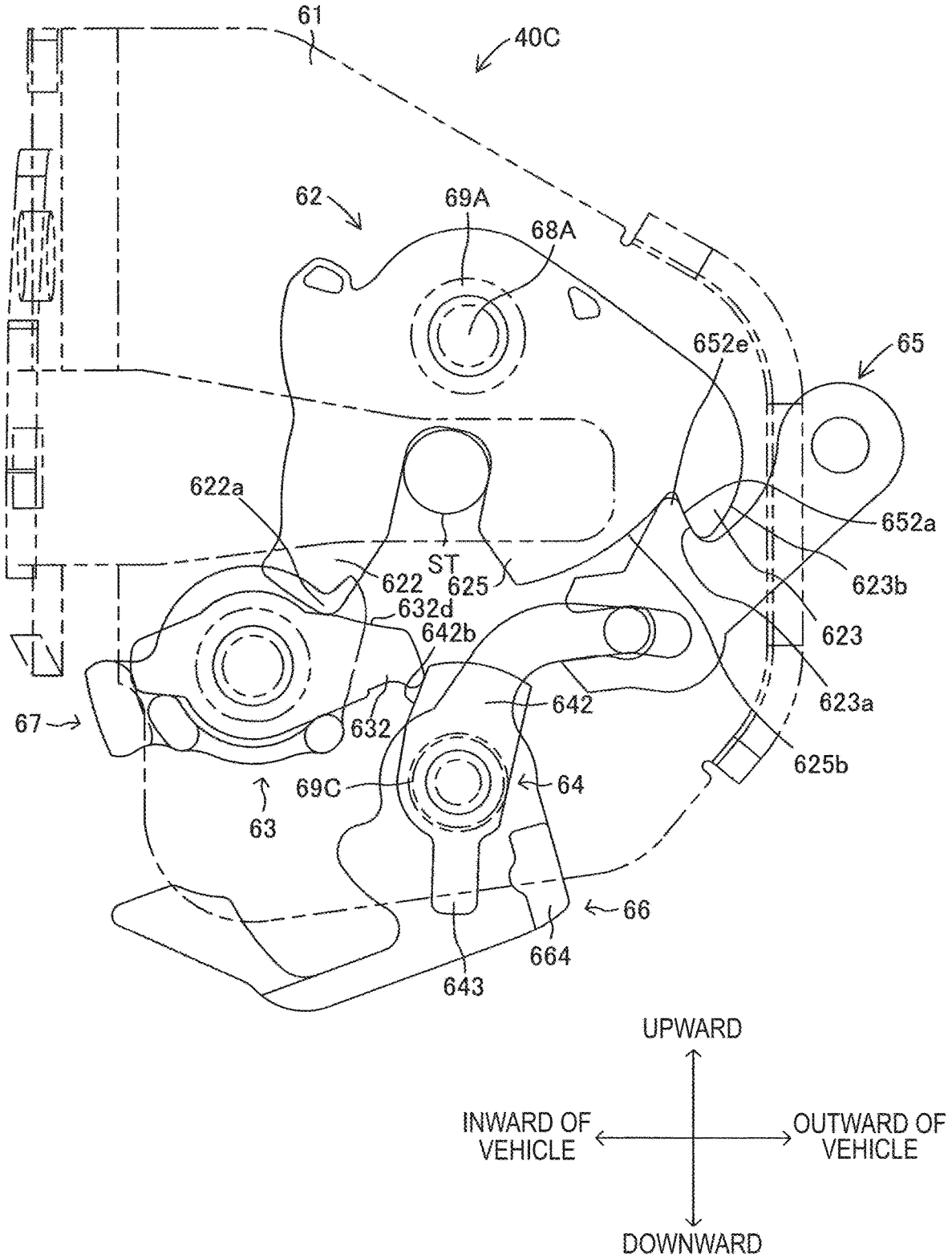
FIG. 23 is a rear view of the opening/closing mechanism in a half latch state.

FIG. 23 is a rear view of the opening/closing mechanism 40*c* which illustrates a state immediately after the engagement protruding portion 652*e* of the half latch arm 652 and the second engagement wall surface 623*b* of the half latch claw portion 623 disengage from each other during the closing operation of the vehicle door. If the engagement protruding portion 652*e* of the half latch arm 652 and the second engagement wall surface 623*b* disengage from each other, the half latch lever 65 rotates in the clockwise direction due to the rotational biasing force of the block lever return spring 69C which is transmitted via the block lift lever 66. As illustrated in FIG. 23, the rotation of the half latch lever 65 is restricted since the engagement protruding portion 652*e* of the half latch arm 652 engages with the outer wall surface 625*b* of the intermediate claw portion 625 of the latch 62. In this case, the half latch engagement wall surface 652*a* of the half latch arm 652 is located to face the first engagement wall surface 623*a* of the half latch claw portion 623 of the latch 62. The rotation position of the latch 62 where the first engagement wall surface 623*a* of the half latch claw portion 623 faces the half latch engagement wall surface 652*a* is defined as the half latch position. In this case, the engagement protruding portion 652*e* of the half latch lever 65 is located at a position where the engagement protruding portion 652*e* can enter the rotation region of the half latch claw portion 623 so as to engage with the half latch claw portion 623.

When the operation state of the opening/closing mechanism 40C is in the state illustrated in FIG. 23, in a case where the closing operation of the vehicle door 10 is completed, the striker ST stops moving, and the latch 62 tries to rotate in the clockwise direction (direction toward the unlatch position) in accordance with the rotational biasing force of the latch return spring 69A. However, the rotation is restricted since the first engagement wall surface 623*a* of the half latch claw portion 623 engages with the half latch engagement wall surface 652*a* of the half latch lever 65. In this way, when the latch 62 is located at the half latch position, the half latch lever 65 according to the present embodiment enters the rotation region of the half latch claw portion 623, and engages with the half latch claw portion 623. In this manner, the half latch lever 65 can rotate at the position (operation position) inside the operation region which is the rotation region where the rotation of the latch 62 in the direction toward the unlatch position is restricted. As illustrated in FIG. 23, the operation state of the opening/closing mechanism 40C in which the rotation of the latch 62 in the clockwise direction (direction toward the unlatch position) at the half latch position is restricted by the half latch lever 65 located at the operation position is called the half latch state. When in the half latch state, the vehicle door 10 is brought into a so-called half closed state. In this case, the vehicle door 10 is closed in a slightly open state compared to a fully closed state, and the closed state is maintained.

Before reaching the half latch state, the rotation of the latch 62 in the counterclockwise direction causes the engagement protruding portion 622*a* of the full latch claw portion 622 of the latch 62 to move close to the pawl 63. Immediately before reaching the half latch state, the engagement protruding portion 622*a* of the full latch claw portion 622 comes into contact with the first engagement arm 632 of the pawl 63. FIG. 23 illustrates a state where the engagement protruding portion 622*a* of the full latch claw portion 622 abuts on the upper side wall surface 632*d* of the first engagement arm 632 of the pawl 63. As illustrated in FIG. 23, if the latch 62 rotates in the counterclockwise direction after the engagement protruding portion 622*a* of the full latch claw portion 622 abuts on the first engagement arm 632 of the pawl 63, the pawl 63 is pressed by the full latch claw portion 622, and rotates in the clockwise direction from the engagement position toward the disengagement position where the pawl 63 is retreated from the rotation region of the full latch claw portion 622. In this case, the first engagement arm 632 of the pawl 63 rotates downward. However, when the pawl 63 and the full latch claw portion 622 abut on each other, as illustrated in FIG. 23, the block lever 64 rotates from the restriction position in the clockwise direction. Accordingly, the block lever 64 moves to a position separated from the lower position of the pawl 63, that is, the non-restriction position where the block lever 64 is retreated from the rotation region of the pawl 63. That is, the block lever 64 is located at the non-restriction position when the pawl 63 rotates in the direction from the engagement position toward the disengagement position. Therefore, the rotation of the above-described pawl 63 is not hindered by the second engagement arm 642 of the block lever 64.

When reaching the half latch state, the half latch lever 65 rotates in the clockwise direction as will be understood from a change in the rotation position of the half latch lever 65 illustrated in FIGS. 22 to 23. However, in this case, the block lift lever 66 engaging with the half latch lever 65 rotates in the counterclockwise direction due to the rotational biasing force of the block lever return spring 69C. On the other hand, the block lever 64 is pressed by the pawl 63 since the first engagement arm 632 of the pawl 63 enters the vehicle interior side wall surface 642*b*. Accordingly, the block lever 64 cannot rotate in the counterclockwise direction. Therefore, in the half latch state, as illustrated in FIG. 23, the engagement protruding portion 664 of the block lift lever 66 is separated from the connecting arm 643 of the block lever 64.

Figure 24:
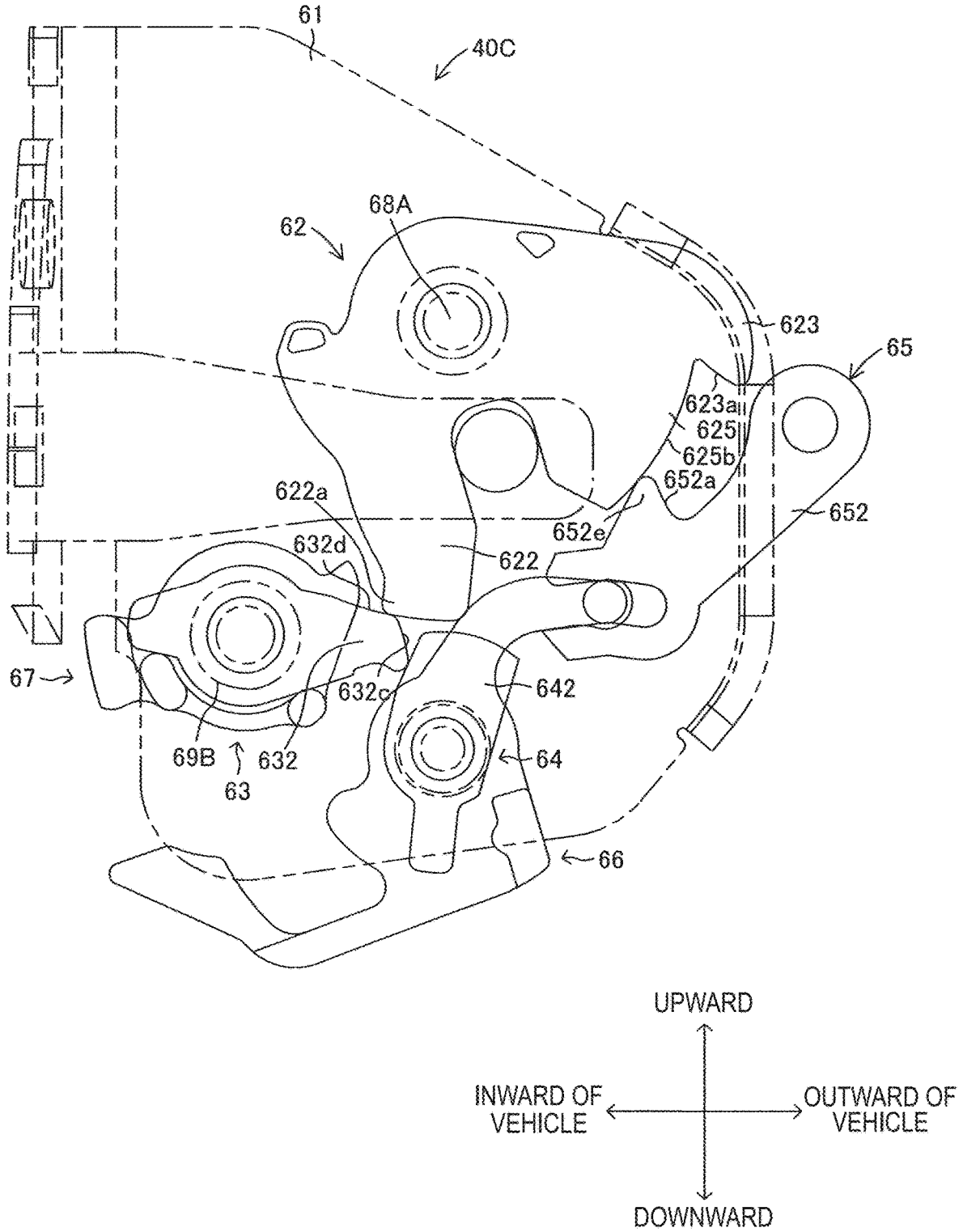
FIG. 24 is a rear view of the opening/closing mechanism which illustrates a state where the latch further rotates in the counterclockwise direction from a state illustrated in FIG. 23.

FIG. 24 is a rear view of the opening/closing mechanism 40C which illustrates a state where the vehicle door 10 further performs the closing operation from the state illustrated in FIG. 23, in response to the closing operation, the striker ST moves in the vehicle outward direction, and the latch 62 further rotates in the counterclockwise direction. As illustrated in FIG. 24, if the latch 62 further rotates in the counterclockwise direction, the half latch engagement wall surface 652*a* of the half latch arm 652 is separated from the first engagement wall surface 623*a* of the half latch claw portion 623. The engagement position between the engagement protruding portion 652*e* of the half latch arm 652 and the outer wall surface 625*b* of the intermediate claw portion 625 of the latch 62 is shifted to the tip side of the intermediate claw portion 625. Here, the outer wall surface 625*b* of the intermediate claw portion 625 is formed in an arc shape around the rotation center (latch support shaft 68A) of the latch 62. Even in a case where the latch 62 rotates, the radial position of the outer wall surface 625*b* is not changed. Therefore, the half latch lever 65 engaging with the outer wall surface 625*b* slides on the outer wall surface 625*b* without changing the rotation position, that is, while the rotation position is located at the operation position.

The first engagement arm 632 of the pawl 63 is pressed by the full latch claw portion 622, and rotates in the clockwise direction. In this manner, similarly to the first embodiment, the pawl 63 moves from the engagement position to the disengagement position which is the rotation position where the pawl 63 is retreated from the rotation region of the full latch claw portion 622. In this way, the pawl 63 is rotatable from the engagement position where the pawl 63 enters the rotation region of the full latch claw portion 622 to the disengagement position where the pawl 63 is retreated from the rotation region of the full latch claw portion 622.

If the vehicle door 10 further performs the closing operation from the state illustrated in FIG. 24 and the striker ST moves in the vehicle outward direction, the contact position between the engagement protruding portion 622*a* of the full latch claw portion 622 of the latch 62 and the upper side wall surface 632*d* of the first engagement arm 632 of the pawl 63 is further shifted to the tip side of the first engagement arm 632. Eventually, the full latch claw portion 622 and the first engagement arm 632 of the pawl 63 disengage from each other. Then, the pawl 63 is completely pressed by the full latch claw portion 622. The pawl 63 rotates in the counterclockwise direction in accordance with the rotational biasing force of the pawl return spring 69B, and returns to the engagement position.

When the full latch claw portion 622 of the latch 62 is located at the position separated from the first engagement arm 632 of the pawl 63, the vehicle door 10 is in substantially the fully closed state. Therefore, the striker ST stops moving, and the latch 62 tries to rotate in the clockwise direction in accordance with the rotational biasing force of the latch return spring 69A. The engagement protruding portion 622*a* disposed in the full latch claw portion 622 of the latch 62 rotationally biased in the clockwise direction engages with the engagement wall surface 632*c* disposed in the first engagement arm 632 of the pawl 63 located at the engagement position. In this manner, the rotation of the latch 62 in the clockwise direction by the rotational biasing force of the latch return spring 69A is restricted. In this way, the position of the latch 62 whose rotation is restricted by the pawl 63 located at the engagement position is defined as the full latch position. In this way, the latch 62 can rotate in the rotation region between the unlatch position and the full latch position, and the striker ST moves in the vehicle outward direction in response to the closing operation of the vehicle door 10. In this manner, the latch 62 rotates from the unlatch position to the full latch position.

The operation state of the opening/closing mechanism 40C in which the rotation of the latch 62 in the clockwise direction at the full latch position is restricted by the pawl 63 located at the engagement position is called the full latch state. In the full latch state, the vehicle door 10 is in a fully closed state. In the full latch state, the latch return spring 69A rotationally biases the latch 62 in the clockwise direction from the full latch position toward the unlatch position.

Figure 25:
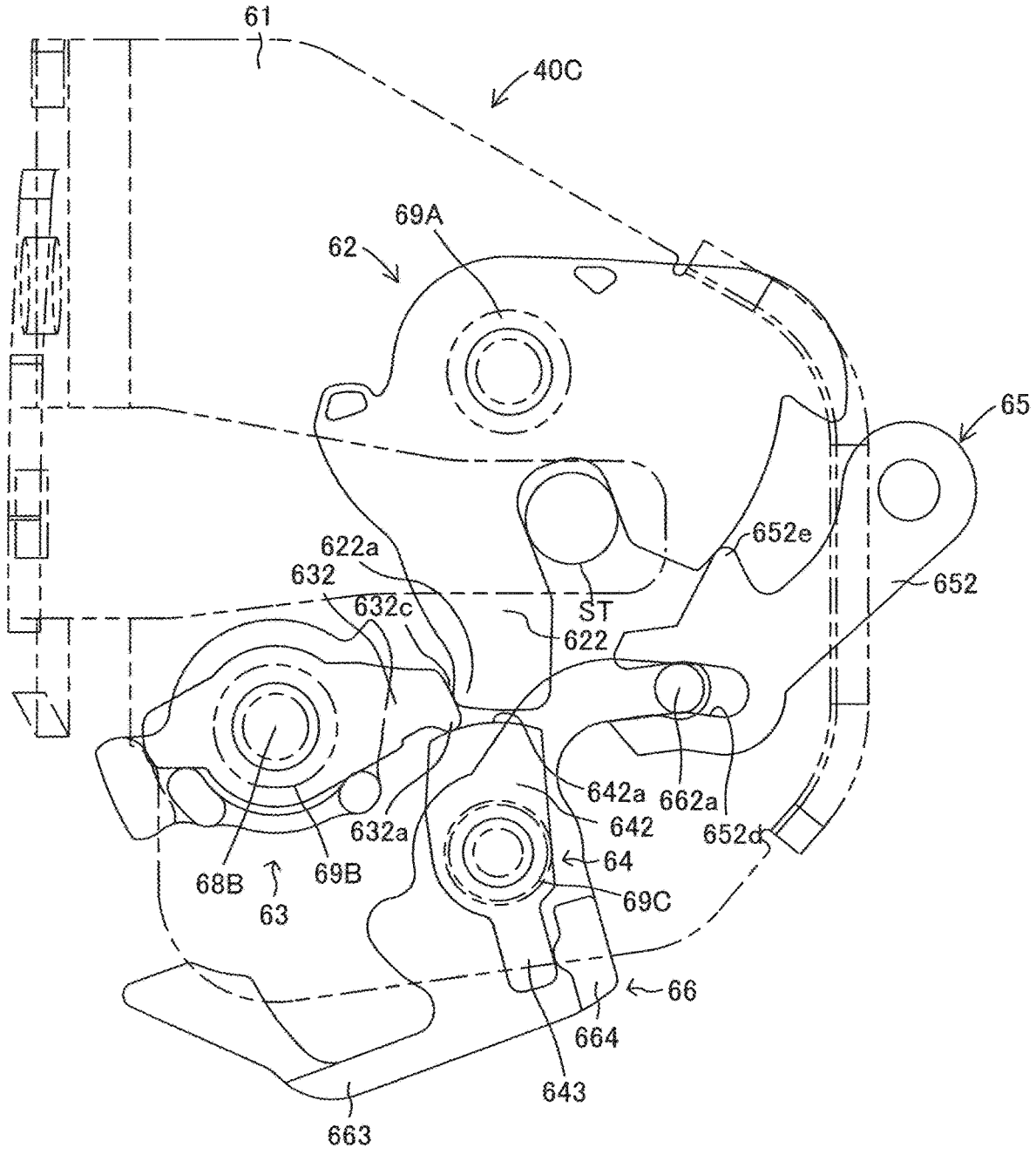
FIG. 25 is a rear view of the opening/closing mechanism in the full latch state.

FIG. 25 is a rear view of the opening/closing mechanism 40C in the full latch state. When the operation state of the opening/closing mechanism 40C is the full latch state illustrated in FIG. 25, the latch 62 located at the full latch position holds the striker ST so that the striker ST cannot be released. The pawl 63 rotates from the disengagement position to the engagement position, and is rotationally restricted at the engagement position. The half latch arm 652 of the half latch lever 65 maintains a state where the engagement protruding portion 652*e* engages with the outer wall surface of the intermediate claw portion 525. That is, even when in the full latch state, the half latch lever 65 is located at the operation position.

When in the full latch state, the block lever 64 can rotate in the counterclockwise direction since the pawl 63 rotates to the engagement position. Therefore, the block lever 64 rotates in the counterclockwise direction in accordance with the rotational biasing force of the block lever return spring 69C. In this manner, the block lever 64 rotates from the non-restriction position to the restriction position, and is rotationally restricted at the restriction position. At this time, the second engagement arm 642 of the block lever 64 is hidden under the first engagement arm 632 of the pawl 63 located at the engagement position. In this way, when the block lever 64 rotates from the disengagement position to the disengagement position and is located at the engagement position, the pawl 63 rotates from the non-restriction position to the restriction position.

When in the full latch state, due to the biasing force applied from the latch 62, the pawl 63 receives a force in the direction against the rotational biasing force of the pawl return spring 69B, that is, a rotating force acting in the clockwise direction. In this manner, the first engagement arm 632 of the pawl 63 tries to rotate around the pawl support shaft 68B so that the tip side faces downward in FIG. 25. On the other hand, in the full latch state illustrated in FIG. 25, the block lever 64 located at the restriction position is hidden under the first engagement arm 632 of the pawl 63 located at the engagement position. Therefore, the rotation of the first engagement arm 632 is restricted since the engagement protruding portion 632*a* of the first engagement arm 632 abuts on the abutting wall surface 642*a* of the second engagement arm 642 of the block lever 64. In this way, the pawl 63 restricts the rotation of the latch 62, and the block lever 64 restricts the rotation of the pawl 63.

Figure 26:
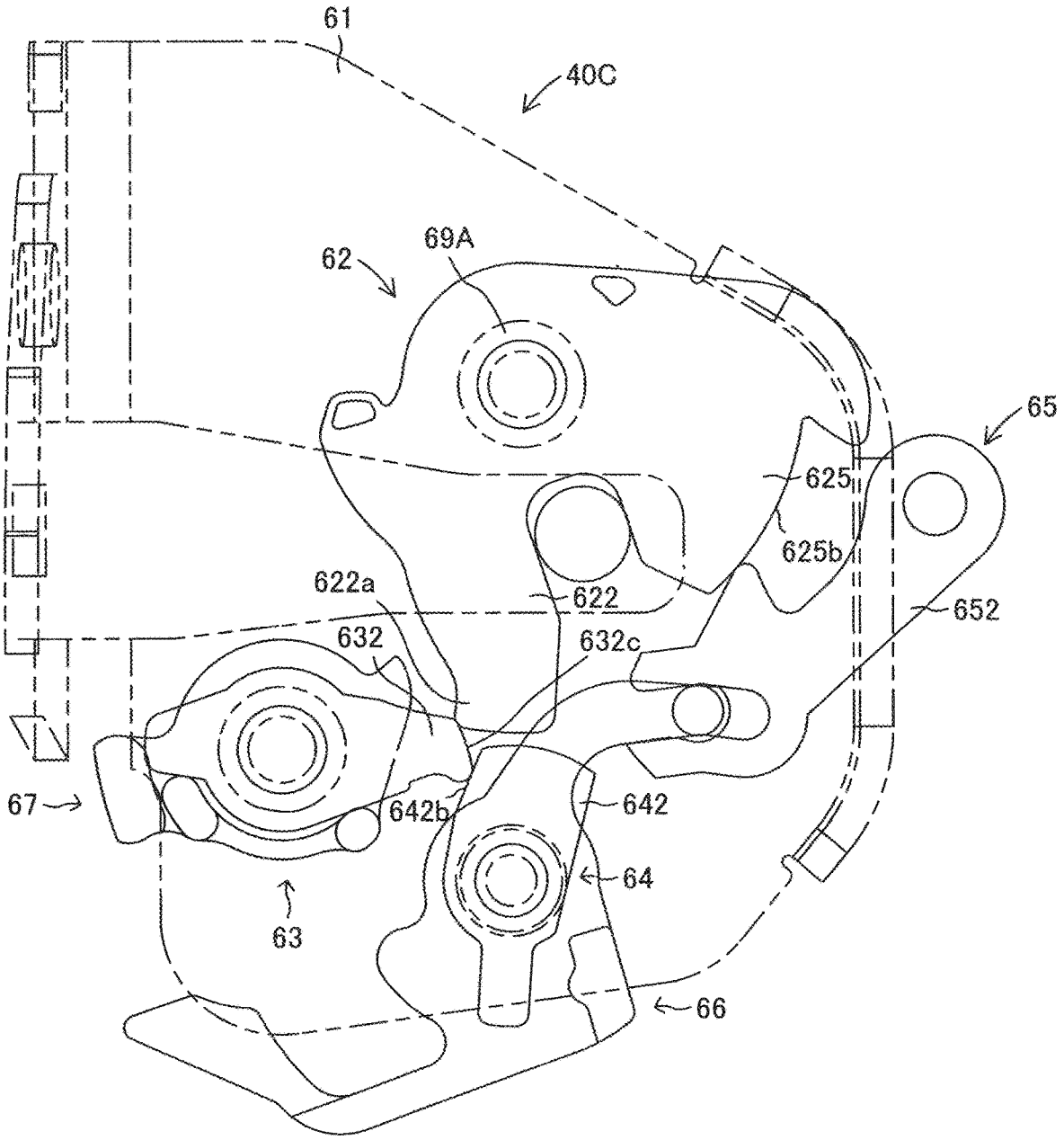
FIG. 26 is a rear view of the opening/closing mechanism in the pseudo latch state.

In the opening/closing mechanism 40C according to the present embodiment, there is also a possibility that the operation state may fall into the pseudo latch state. FIG. 26 is a rear view of the opening/closing mechanism 40C in which the operation state is the pseudo latch state. When in the pseudo latch state, the engagement protruding portion 622*a* of the full latch claw portion 622 of the latch 62 engages with an upper portion of the engagement wall surface 632*c* of the first engagement arm 632 of the pawl 63. The second engagement arm 642 of the block lever 64 is not hidden under the first engagement arm 632 of the pawl 63, and the vehicle interior side wall surface 642*b* of the second engagement arm 642 of the block lever 64 engages with the engagement wall surface 632*c* of the first engagement arm 632 the pawl 63. This engagement state occurs since the pawl 63 engages with the latch 62 before reaching the normal engagement position illustrated in FIG. 25 and the block lever 64 engages with the pawl 63 before reaching the normal restriction position illustrated in FIG. 25.

When in the pseudo latch state, the rotation position of the latch 62 is a position slightly rotated in the clockwise direction from the full latch position. That is, the rotation position of the latch 62 when in the pseudo latch state is the rotation position between the half latch position and the full latch position. Here, during a period from the half latch state to the full latch state, the half latch lever 65 maintains a state of engaging with the outer wall surface 625*b* of the intermediate claw portion 625. The outer wall surface 625*b* of the intermediate claw portion 625 is formed in an arc shape around the rotation center of the latch 62. Accordingly, the rotation position of the half latch lever 65 engaging therewith is not changed even if the latch 62 rotates. Therefore, during the period from the half latch state to the full latch state, the half latch lever 65 is located at the rotation position when in the half latch state, that is, the operation position illustrated in FIG. 23. Accordingly, even when in the pseudo latch state, the half latch lever 65 is located at the operation position.

Therefore, in a case where the latch 62 and the pawl 63 disengage from each other when in the pseudo latch state and the latch 62 rotates in the clockwise direction due to the rotational biasing force of the latch return spring 69A, the latch 62 Is rotationally restricted at the half latch position by engaging with the half latch arm 652 located at the operation position. That is, the operation state of the opening/closing mechanism 40C is changed to the half latch state. Therefore, the closed state of the vehicle door 10 is maintained. In this way, according to the present embodiment, the vehicle door 10 can also be effectively prevented from being opened due to the pseudo latch state.

Figure 27:
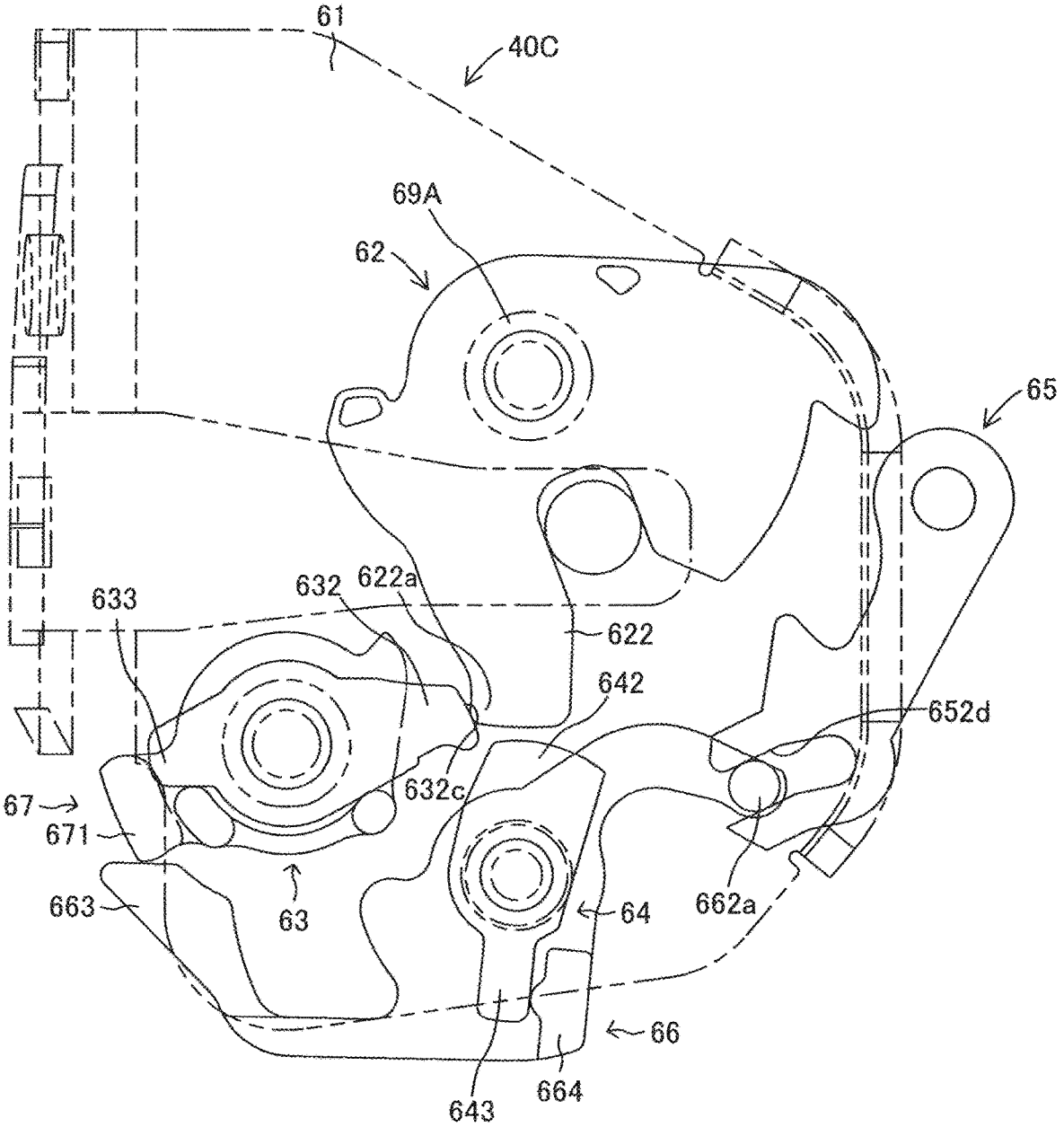
FIG. 27 is a rear view of the opening/closing mechanism which illustrates a state where the block lift lever rotates in the clockwise direction from a position illustrated in FIG. 25.

In a case where the vehicle door 10 in the fully closed state is opened, the door outside handle 17 or the door inside handle disposed in the vehicle door 10 is rotated from the initial position to the opening position. In this manner, the operation lever is operated inside the locking/unlocking mechanism 30 of the vehicle door lock device 20, and the block lift lever 66 rotates in the clockwise direction from the restriction position illustrated in FIG. 25. FIG. 27 is a rear view of the opening/closing mechanism 40C which illustrates a state where the block lift lever 66 rotates in the clockwise direction from the position illustrated in FIG. 25. As illustrated in FIG. 27, if the block lift lever 66 rotates in the clockwise direction from the restriction position, the block lever 64 engaging with the engagement protruding portion 664 of the block lift lever 66 in the connecting arm 643 rotates in the clockwise direction. In this manner, the block lever 64 rotates from the restriction position to the non-restriction position. In a case where the block lever 64 reaches the non-restriction position, the second engagement arm 642 of the block lever 64 is separated from the first engagement arm 632 of the pawl 63. The pawl 63 rotates in the clockwise direction by receiving the biasing force input from the latch 62 and the elastic reaction force of the weather strip installed in the peripheral edge of the vehicle door 10. Even in a case where the pawl 63 is not rotated by the input load, the second extension arm 663 of the block lift lever 66 presses the connecting arm 671 of the pawl lift lever 67. In this manner, the pawl 63 rotates in the clockwise direction.

Due to the rotation of the pawl 63 in the clockwise direction, the engagement protruding portion 622*a* of the full latch claw portion 622 of the latch 62 and the engagement wall surface 632*c* formed on the first engagement arm 632 of the pawl 63 disengage from each other. In this manner, the latch 62 rotates in the clockwise direction in accordance with the rotational biasing force of the latch return spring 69A. Therefore, the latch 62 is located at the unlatch position. In this case, the striker ST can be separated from the striker holding recess portion 624 of the latch 62, and can move the striker entering groove 611 in the vehicle outward direction. Accordingly, the vehicle door 10 can be opened.

If the block lift lever 66 rotates in the clockwise direction from the position illustrated in FIG. 25, the engagement position between the engagement pin 662*a* of the block lift lever 66 and the engagement groove 652*d* of the half latch arm 652 moves outward of the vehicle. In this manner, the half latch lever 65 moves in the counterclockwise direction while maintaining the engagement between the engagement pin 662*a* and the engagement groove 652*d*. Therefore, as illustrated in FIG. 27, the half latch lever 65 is located at the position (non-operation position) inside the non-operation region which is a region where the half latch lever 65 is retreated from the rotation region of the half latch claw portion 623. In this way, the half latch lever 65 moves to the non-operation position. Accordingly, when the restriction of the latch 62 located at the full latch position is released and the latch 62 rotates from the full latch position to the unlatch position, the rotation of the latch 62 in the clockwise direction is not hindered by the half latch lever 65.

As described above, in a case where the block lift lever 66 rotates in the clockwise direction when in the full latch state, the block lever 64 also rotates integrally with the block lift lever 66, and reaches the non-restriction position from the restriction position. In this case, the half latch lever 65 engaging with the block lift lever 66 rotates in the clockwise direction, and reaches the non-operation position from the operation position. That is, the rotation of the block lever 64 rotating integrally with the block lift lever 66 is transmitted to the half latch lever 65 so that the half latch lever 65 rotates in the direction from the operation position toward the non-operation position in a case where the block lever 64 rotates from the restriction position to the non-restriction position. According to the present embodiment, this transmission mechanism is achieved by the engagement between the engagement pin 662*a* of the block lift lever 66 and the engagement groove 652*d* of the half latch lever 65. Therefore, the engagement pin 662*a* and the engagement groove 652*d* correspond to the rotation transmission mechanism according to the embodiments disclosed here.

In this way, according to the present embodiment, while the latch 62 rotates from the half latch position to the full latch position when the vehicle door 10 is closed, the half latch lever 65 is located at the operation position. Therefore, even when in the pseudo latch state, the half latch lever 65 is located at the operation position. In a case where the pseudo latch state is released, the latch 62 engages with the half latch lever 65 located at the operation position, thereby preventing the vehicle door 10 from being opened.

According to the present embodiment, a configuration is adopted so that the half latch lever 65 engages with the block lift lever 66 and the block lift lever 66 engages with the block lever 64. Accordingly, the half latch lever 65 rotates in response to the rotation of the block lever 64 or the block lift lever 66. Therefore, the biasing member (half latch lever return spring) for rotationally biasing the half latch lever 65 can be omitted. The rotation transmission lever included in the opening/closing mechanism 40B according to the above-described second embodiment can be omitted.

Fourth Embodiment

Next, an opening/closing mechanism included in a vehicle door lock device according to a fourth embodiment will be described. The opening/closing mechanisms according to the first embodiment to the third embodiment are configured to reliably switch the operation state of the opening/closing mechanism to the half latch state in a case where the pawl and the latch disengage from each other when the operation state is the pseudo latch state. Here, the reason that the opening/closing mechanism falls into the pseudo latch state or the completely fixed state is examined as follows. Before the rotation position of the latch reaches the full latch position during the closing operation of the vehicle door, for example, as illustrated in FIG. 7 or 8, the engagement wall surface 432*c* of the first engagement arm 432 of the pawl 43 comes into contact with the vehicle interior side wall surface 442*b* of the second engagement arm 442 of the block lever 44, thereby generating a frictional force at the contact portion therebetween. In a case where the frictional force is strong, the frictional force affects the rotational operation of the pawl 43. Here, in a case illustrated in FIG. 7 or 8, an application direction of the force input from the block lever 44 to the pawl 43 at the above-described contact portion is close to a direction from the above-described contact point toward the axis of the pawl support shaft 48B which is the rotation center of the pawl 43. Therefore, most of the force input to the pawl 43 turns into a normal force of the frictional force. As a result, there is a possibility that a strong frictional force may be generated. In a case where the pawl 43 and the block lever 44 are made of metal, the coefficient of friction increases. Due to this factor, the strong frictional force is generated, and affects the subsequent rotational operation of the pawl 43. As a result, in some cases, the pawl 43 may not smoothly rotate. Since the pawl 43 does not smoothly rotate, the pawl 43 and the latch 42 engage with each other before the pawl 43 reaches the normal engagement position. In this manner, the opening/closing mechanism falls into the pseudo latch state as illustrated in FIG. 9, or falls into the completely fixed state.

Therefore, the pseudo latch state or the completely fixed state can be avoided by reducing the frictional force generated by the contact between the pawl and the block lever during the closing operation of the vehicle door. In the present embodiment, the vehicle door lock device having a configuration that can avoid the pseudo latch state or the completely fixed state will be described by focusing on the above-described point.

Figure 28:
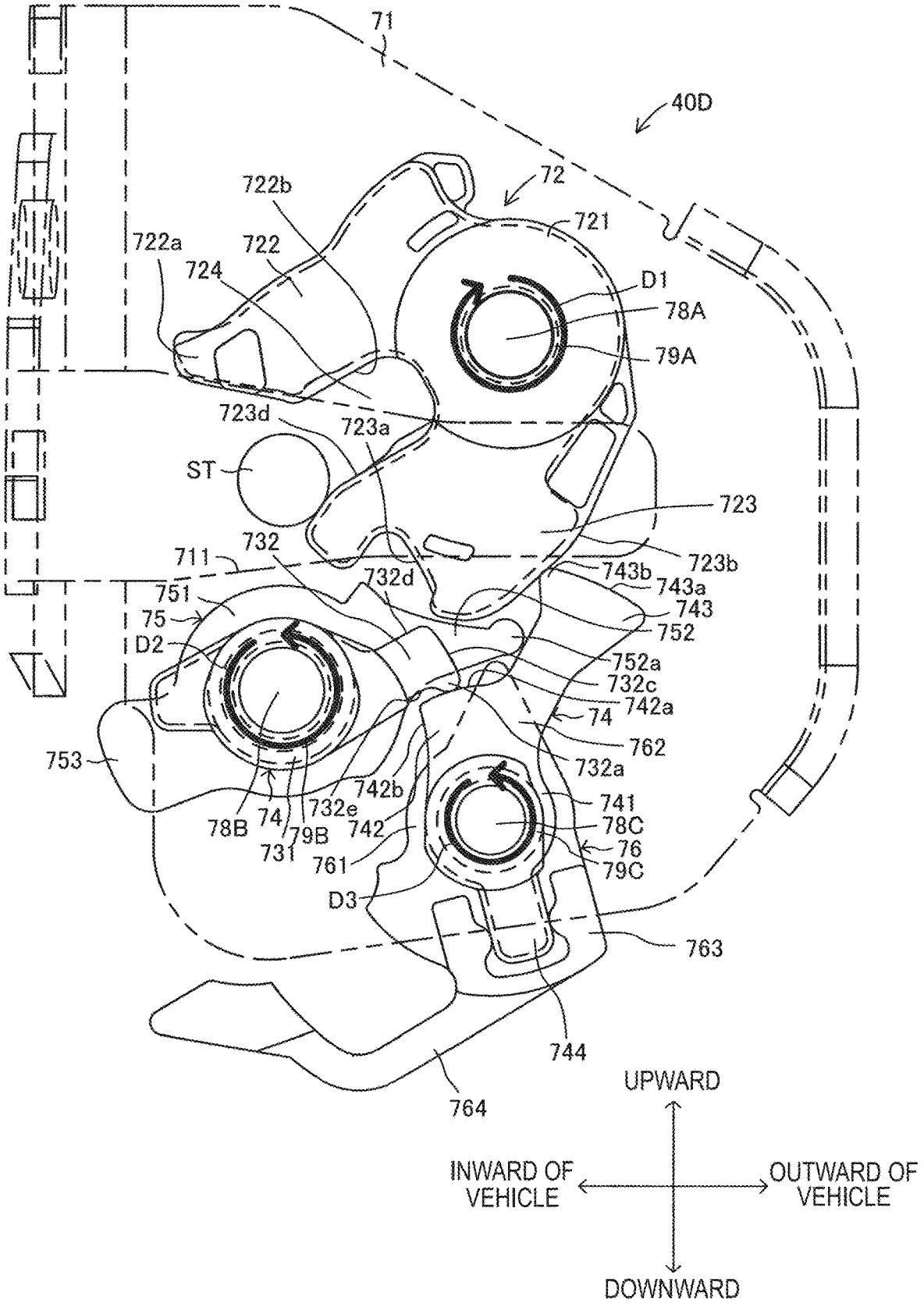
FIG. 28 is a rear view of an opening/closing mechanism included in a vehicle door lock device according to a fourth embodiment.

FIG. 28 is a rear view of an opening/closing mechanism 40D included in a vehicle door lock device 20 according to the present embodiment. As illustrated in FIG. 28, the opening/closing mechanism 40D has a base member 71, a latch 72, a pawl 73, a block lever 74, a pawl lift lever 75, and a block lift lever 76.

The base member 71 supports various components of the opening/closing mechanism 40D. The base member 71 has a striker entering groove 711 having the same shape as the striker entering groove 411 formed in the base member 41 according to the first embodiment.

The base member 71 has a latch support shaft 78A, a pawl support shaft 78B, and a block lever support shaft 78C. The support shafts respectively extend in the forward-rearward direction. The latch support shaft 78A is disposed at an upper position of the striker entering groove 711, and the pawl support shaft 78B and the block lever support shaft 78C are disposed at lower positions of the striker entering groove 711. The pawl support shaft 78B is disposed on the side in the vehicle inward direction from the block lever support shaft 78C.

The latch 72 is rotatably supported by the latch support shaft 78A disposed in the base member 71. Therefore, the latch 72 is supported by the base member 71 to be rotatable around the axis in the forward-rearward direction. The latch 72 has a support portion 721, a full latch claw portion 722, and a half latch claw portion 723. The support portion 721 configures a portion rotatably supported by the latch support shaft 78A. The full latch claw portion 722 and the half latch claw portion 723 are bifurcated from the support portion 721 within the rotary plane of the latch 72, and extend in substantially the same direction. Therefore, a space is disposed between the full latch claw portion 722 and the half latch claw portion 723, and a striker holding recess portion 724 is formed by the space.

The striker holding recess portion 724 is formed by a space surrounded with an inner wall surface 722*b* of the full latch claw portion 722 and an inner wall surface 723*d* of the half latch claw portion 723 which face each other, and a bottom surface that connects base ends of the inner wall surfaces to each other. The striker holding recess portion 724 is open on an outer peripheral surface of the latch 72. Therefore, the full latch claw portion 722 and the half latch claw portion 723 are formed across the striker holding recess portion 724. As will be understood from FIG. 28, the striker holding recess portion 724 is disposed at a position overlapping the striker entering groove 711 when viewed in the forward-rearward direction.

The full latch claw portion 722 is located forward in the rotation direction from the half latch claw portion 723 in a case where the latch 72 rotates in the clockwise direction in FIG. 28. An engagement protruding portion 722*a* is formed in a tip portion of the full latch claw portion 722.

The half latch claw portion 723 has a first engagement wall surface 723*a* and a second engagement wall surface 723*b*. The first engagement wall surface 723*a* is formed by a bottom surface of a recess portion formed on the tip wall surface of the half latch claw portion 723, and is formed as a wall surface substantially perpendicular to the extending direction of the half latch claw portion 723. The second engagement wall surface 723*b* configures a portion of the outer peripheral wall surface of the latch 72 which is a wall surface on a side opposite to the inner wall surface 723*d* of the half latch claw portion 723.

A latch return spring 79A is attached to the latch support shaft 78A, and the latch return spring 79A biases the latch 72 in the clockwise direction indicated by the arrow D1 in FIG. 28. The latch 72 rotates in the clockwise direction due to the rotational biasing force of the latch return spring 79A. However, the rotation is restricted by the latch 72 engaging with a latch stopper (not illustrated). The rotation position where the rotation of the latch 72 is restricted by the latch stopper is defined as the unlatch position. FIG. 28 illustrates the latch 72 located at the unlatch position.

The pawl 73 is rotatably supported by the pawl support shaft 78B. Therefore, the pawl 73 is supported by the base member 71 to be rotatable around the axis in the forward-rearward direction. The pawl 73 has a support portion 731 and a first engagement arm 732, similarly to the pawl 43 according to the above-described first embodiment. The configuration elements are the same as those of the support portion 431 and the first engagement arm 432 included in the pawl 43 according to the first embodiment, and thus, description thereof will be omitted. Similarly to the first engagement arm 432 according to the above-described first embodiment, the first engagement arm 732 has an engagement wall surface 732*c*, an upper side wall surface 732*d*, and a lower side wall surface 732*e*. An engagement protruding portion 732*a* protruding downward in FIG. 28 is formed in the boundary portion between the engagement wall surface 732*c* and the lower side wall surface 732*e*.

The pawl lift lever 75 is rotatably supported together with the pawl 73 by the pawl support shaft 78B. The pawl lift lever 75 is connected to the pawl 73 to be rotatable integrally with the pawl 73. The pawl lift lever 75 has a support portion 751, a first extension arm 752, and a connecting arm 753. The support portion 751 together with the support portion 731 of the pawl 73 configures a portion rotatably supported by the pawl support shaft 78B. The first extension arm 752 extends radially outward of the pawl support shaft 78B from the support portion 751. The extending direction of the first extension arm 752 is substantially the same as the direction in which the first engagement arm 732 of the pawl 73 extends from the support portion 731 of the pawl 73, and the first extension arm 752 is longer than the first engagement arm 732. Therefore, the base end portion of the first extension arm 752 is located to overlap the first engagement arm 732 of the pawl 73. On the other hand, the tip portion of the first extension arm 752 is located at a position separated from the pawl support shaft 78B compared to the tip portion of the first engagement arm 732 of the pawl 73. As illustrated in FIG. 28, the first extension arm 752 is formed in a tapered triangular shape, and the engagement protruding portion 752*a* is formed in a tip portion thereof. The connecting arm 753 of the pawl lift lever 75 extends in a direction opposite to the extending direction of the first extension arm 752 from the support portion 751. The pawl lift lever 75 may be formed of a resin material.

A pawl return spring 79B is attached to the pawl support shaft 78B, and the pawl return spring 79B biases the pawl 73 and the pawl lift lever 75 in the counterclockwise direction indicated by the arrow D2 in FIG. 28. The rotation of the pawl 73 and the pawl lift lever 75 in the counterclockwise direction is restricted by the pawl 73 engaging with a pawl stopper (not illustrated) disposed in the base member 71. The rotation position of the pawl 73 whose rotation is restricted by the pawl stopper is defined as the engagement position. FIG. 28 illustrates the pawl 73 located at the engagement position. The engagement position is the rotation position where the pawl 73 enters the rotation region of the full latch claw portion 722 of the latch 72 out of the rotation positions of the pawl 73.

The block lever 74 is rotatably supported by the block lever support shaft 78C. Therefore, the block lever 74 is supported by the base member 71 to be rotatable around the axis in the forward-rearward direction. The block lever 74 has a support portion 741, a second engagement arm 742, a half latch arm 743, and a connecting arm 744. The support portion 741 configures a portion rotatably supported by the block lever support shaft 78C. The second engagement arm 742 extends radially outward of the block lever support shaft 78C from the support portion 741. In FIG. 28, the second engagement arm 742 extends upward from the support portion 741. The half latch arm 743 extends from the tip portion of the second engagement arm 742. The connecting arm 744 extends from the support portion 741 in a direction opposite to the extending direction of the second engagement arm 742. In FIG. 28, the connecting arm 744 extends downward from the support portion 741.

The second engagement arm 742 of the block lever 74 has an abutting wall surface 742*a* and a vehicle interior side wall surface 742*b*. The abutting wall surface 742*a* includes the tip wall surface of the second engagement arm 742. In a case of being viewed in the direction illustrated in FIG. 28 (from the rear side), the abutting wall surface 742*a* is formed in an arc shape around the axis of the block lever support shaft 78C. The vehicle interior side wall surface 742*b* includes a wall surface extending toward the support portion 741 from the end portion on the side in the vehicle inward direction in both ends of the abutting wall surface 742*a*.

The half latch arm 743 extends from a portion of the abutting wall surface 742*a* of the second engagement arm 742 on the side in the vehicle outward direction. In FIG. 28, the half latch arm 743 extends obliquely upward from the abutting wall surface 742*a* to be inclined toward the side in the vehicle outward direction. The half latch arm 743 has a half latch engagement wall surface 743*a* and an engagement protruding portion 743*b*. The half latch engagement wall surface 743*a* includes the tip wall surface of the half latch arm 743. The engagement protruding portion 743*b* is formed to protrude from the half latch engagement wall surface 743*a* toward the latch 72.

The block lift lever 76 is rotatably supported together with the block lever 74 by the block lever support shaft 78C. The block lift lever 76 is connected to the block lever 74 to be rotatable integrally with the block lever 74. The block lift lever 76 may be formed of a resin material. The block lift lever 76 has a support portion 761, a second extension arm 762, a connecting portion 763, and a third extension arm 764.

Figure 29:
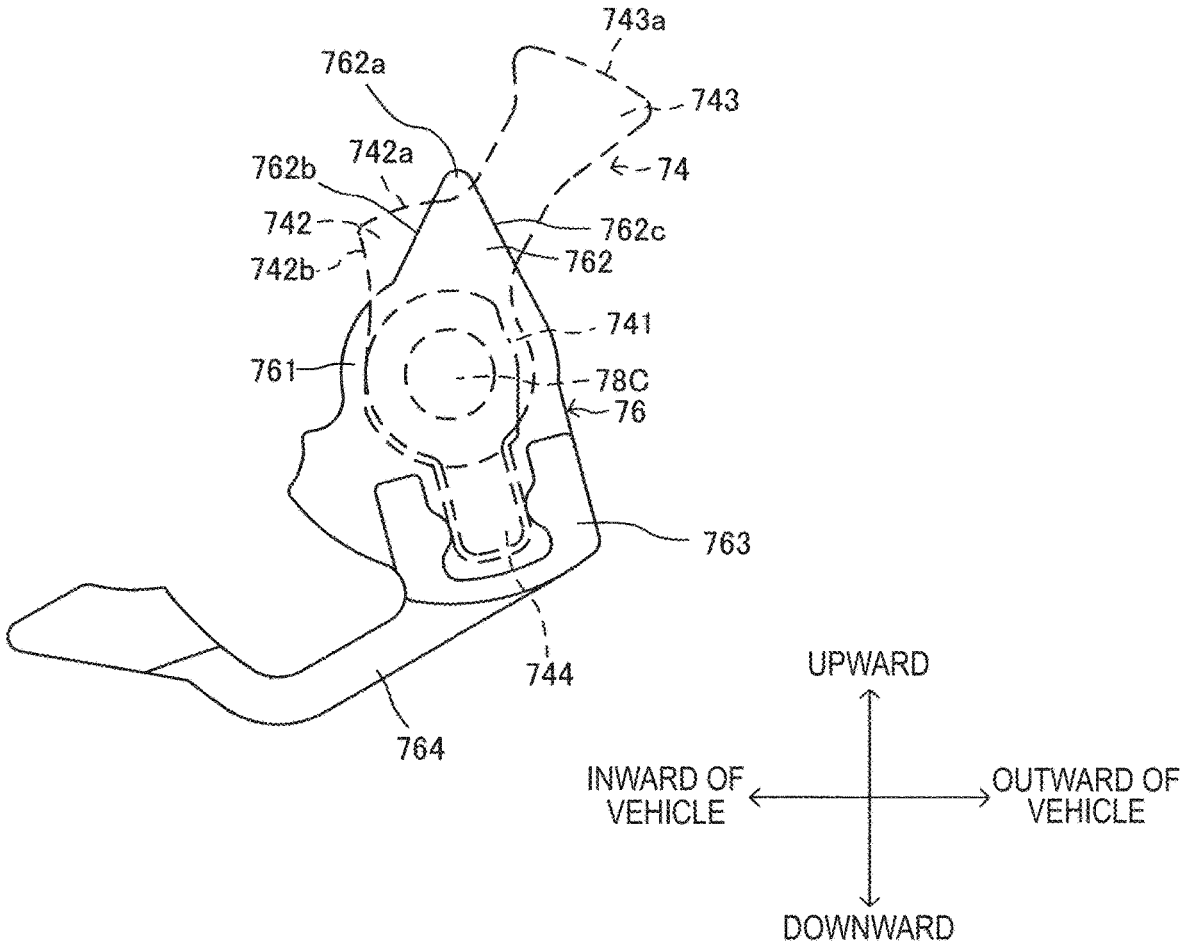
FIG. 29 is a rear view of the block lift lever.

FIG. 29 is a rear view of the block lift lever 76. In FIG. 29, the block lever 74 and the block lever support shaft 78C are illustrated by broken lines. As illustrated in FIGS. 28 and 29, the support portion 761 of the block lift lever 76 configures a portion rotatably supported by the block lever support shaft 78C. The second extension arm 762 extending in a tapered shape is disposed above the support portion 761. The second extension arm 762 is formed in an isosceles triangle shape. The second extension arm 762 formed in the isosceles triangle shape has an engagement protruding portion 762*a*, a first inclined surface 762*b*, and a second inclined surface 762*c*. The engagement protruding portion 762*a* is formed in the tip of the second extension arm 762. In FIGS. 28 and 29, the engagement protruding portion 762*a* is formed at an upper end portion of the second extension arm 762. The first inclined surface 762*b* extends to be inclined downward in the vehicle inward direction from the engagement protruding portion 762*a*, and the second inclined surface 762*c* extends to be inclined downward in the vehicle outward direction from the engagement protruding portion 762*a*. The engagement protruding portion 762*a* corresponds to an apex of the second extension arm 762 formed in the isosceles triangle shape, and the first inclined surface 762*b* and the second inclined surface 762*c* correspond to a pair of hypotenuses of the second extension arm 762 formed in the isosceles triangle shape. As can be understood from FIG. 28, the second extension arm 762 is located below the first extension arm 752 of the pawl lift lever 75.

The connecting portion 763 of the block lift lever 76 is disposed below the support portion 761, and is formed across the connecting arm 744 of the block lever 74 from both sides. Therefore, the block lift lever 76 is connected to the block lever 74 in the connecting portion 763, and the block lift lever 76 can rotate together with the block lever 74. The third extension arm 764 extends outward of the vehicle from the connecting portion 763. The third extension arm 764 is set to have dimensions so that the tip portion can abut on the connecting arm 753 of the pawl lift lever 75 when the block lever 74 and the block lift lever 76 rotate in the clockwise direction around the block lever support shaft 78C from the rotation position illustrated in FIG. 28.

As illustrated in FIG. 28, a block lever return spring 79C is attached to the block lever support shaft 78C. The block lever return spring 79C biases the block lever 74 and the block lift lever 76 in the counterclockwise direction indicated by the arrow D3 in FIG. 28. When the latch 72 is located at the unlatch position, as illustrated in FIG. 28, the engagement protruding portion 743*b* of the half latch arm 743 of the block lever 74 engages with the second engagement wall surface 723*b* formed in the half latch claw portion 723 of the latch 72. In this manner, the rotation of the block lever 74 and the block lift lever 76 in the counterclockwise direction is restricted. The rotation position of the block lever 74 in which the half latch arm 743 engages with the latch 72 located at the unlatch position in this way is defined as the restriction position. FIG. 28 illustrates the block lever 74 located at the restriction position. The restriction position is the rotation position where the block lever 74 enters the rotation region of the first engagement arm 732 of the pawl 73 out of the rotation positions of the block lever 74.

In the present embodiment, the latch 72, the pawl 73, and the block lever 74 rotate within a first rotary plane which is the same rotary plane, so that these can engage with each other. The pawl lift lever 75 and the block lift lever 76 rotate within a second rotary plane which is the same rotary plane, so that the first extension arm 752 of the pawl lift lever 75 and the second extension arm 762 of the block lift lever 76 can engage with each other. The first rotary plane and the second rotary plane are different from each other in the forward-rearward direction. Therefore, the pawl lift lever 75 and the block lift lever 76 which rotate within the second rotary plane do not engage with the latch 72, the pawl 73, and the block lever 74 which rotate within the first rotary plane.

An operation of the opening/closing mechanism 40D having the above-described configuration will be described. When the vehicle door 10 is open, an operation state of the opening/closing mechanism 40D is as illustrated in FIG. 28. In this case, the latch 72 is located at the unlatch position. The pawl 73 is located at the engagement position where the pawl 73 is rotationally restricted by the pawl stopper. The block lever 74 is located at the restriction position since the engagement protruding portion 743*b* of the half latch arm 743 engages with the second engagement wall surface 723*b* formed in the half latch claw portion 723 of the latch 72 located at the unlatch position. The operation state of the opening/closing mechanism 40D as illustrated in FIG. 28 is the unlatch state.

If the vehicle door 10 performs the closing operation, the striker ST disposed in the vehicle body enters the striker entering groove 711 of the base member 71, and further moves the striker entering groove 711 toward the side in the vehicle outward direction. The striker ST is eventually received by the striker holding recess portion 724 of the latch 72. In this manner, the striker ST is held by the latch 72.

If the closing operation of the vehicle door 10 is progressively performed and the striker ST further moves the striker entering groove 711 toward the side in the vehicle outward direction, while the latch 72 holds the striker ST, the latch 72 rotates in the counterclockwise direction in FIG. 28 against the rotational biasing force of the latch return spring 79A.

The above-described latch 72 rotates in the counterclockwise direction. Accordingly, the engagement position between the second engagement wall surface 723*b* of the half latch claw portion 723 of the latch 72 and the engagement protruding portion 743*b* of the half latch arm 743 of the block lever 74 engaging therewith is shifted to the tip side of the second engagement wall surface 723*b* (tip side of the half latch claw portion 723). When the above-described engagement position exceeds the tip of the second engagement wall surface 723*b*, both of these disengage from each other.

Figure 30:
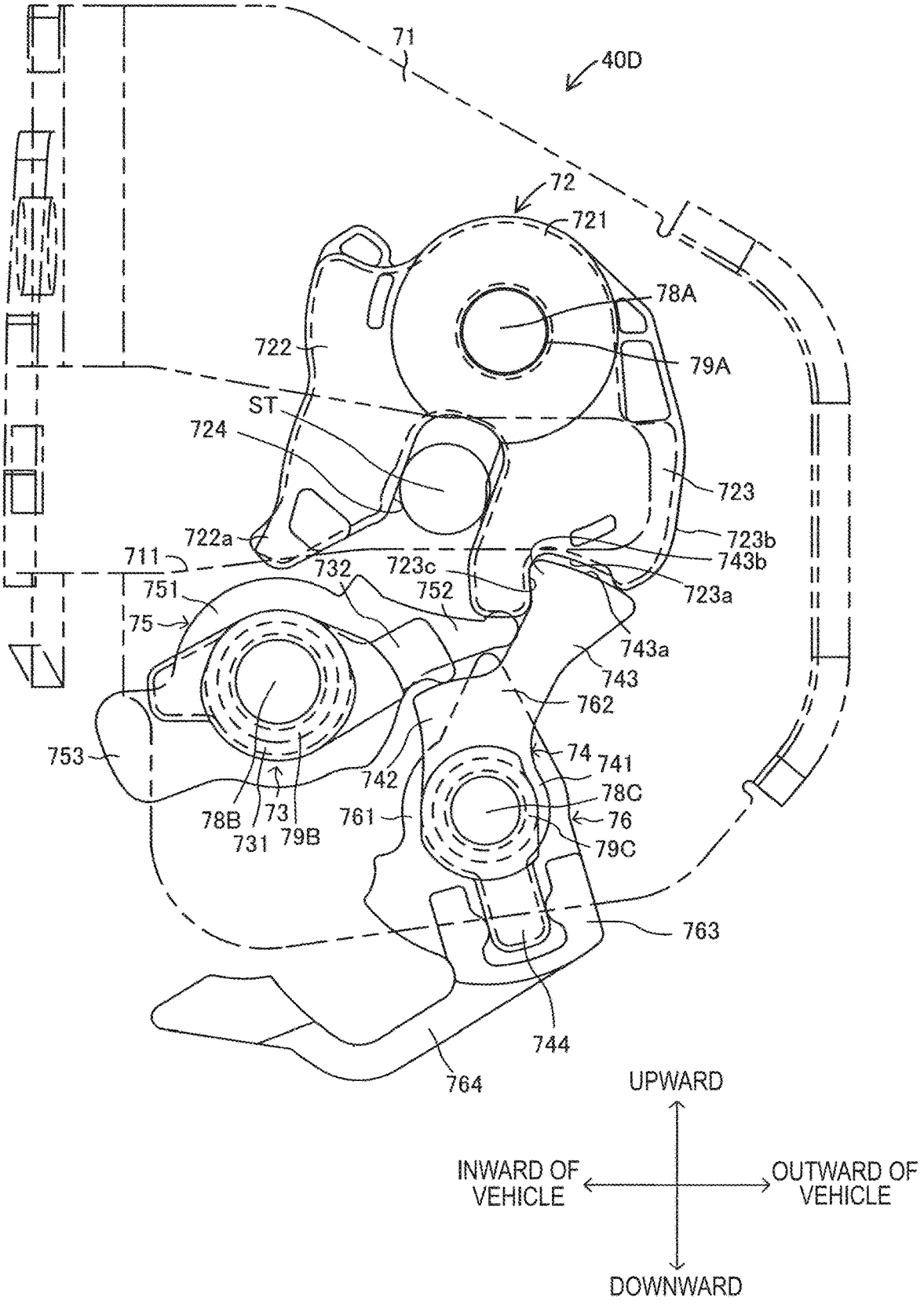
FIG. 30 is a rear view of the opening/closing mechanism which illustrates a state immediately after an engagement protruding portion of a half latch arm and a second engagement wall surface of a half latch claw portion disengage from each other.

FIG. 30 is a rear view of the opening/closing mechanism 40D which illustrates a state immediately after the engagement protruding portion 743*b* of the half latch arm 743 and the second engagement wall surface 723*b* of the half latch claw portion 723 disengage from each other. If the engagement protruding portion 743*b* of the half latch arm 743 and the second engagement wall surface 723*b* of the half latch claw portion 723 disengage from each other, the block lever 74 having the half latch arm 743 rotates in the counterclockwise direction due to the rotational biasing force of the block lever return spring 79C. As illustrated in FIG. 30, the engagement protruding portion 743*b* of the half latch arm 743 engages with a side wall 723*c* erected from the first engagement wall surface 723*a* of the half latch claw portion 723 of the latch 72. In this manner, the rotation of the block lever 74 is restricted. In this case, the half latch engagement wall surface 743*a* of the half latch arm 743 is located to face the first engagement wall surface 723*a* of the half latch claw portion 723 of the latch 72. The rotation position of the latch 72 where the first engagement wall surface 723*a* of the half latch claw portion 723 faces the half latch engagement wall surface 743*a* is defined as the half latch position.

In a case where the closing operation of the vehicle door 10 is completed when the operation state of the opening/closing mechanism 40D is as illustrated in FIG. 30, the striker ST stops moving, and the latch 72 tries to rotate in the clockwise direction in accordance with the rotational biasing force of the latch return spring 79A. However, the rotation is restricted since the half latch engagement wall surface 743*a* of the half latch arm 743 engages with the first engagement wall surface 723*a* of the half latch claw portion 723. The operation state of the opening/closing mechanism 40D in which the rotation of the latch 72 in the clockwise direction is restricted by the half latch arm 743 at the half latch position as illustrated in FIG. 30 is called the half latch state. When in the half latch state, the vehicle door 10 is brought into a so-called half closed state. In this case, the vehicle door 10 is closed in a slightly open state compared to a fully closed state, and the closed state is maintained.

Figure 31:
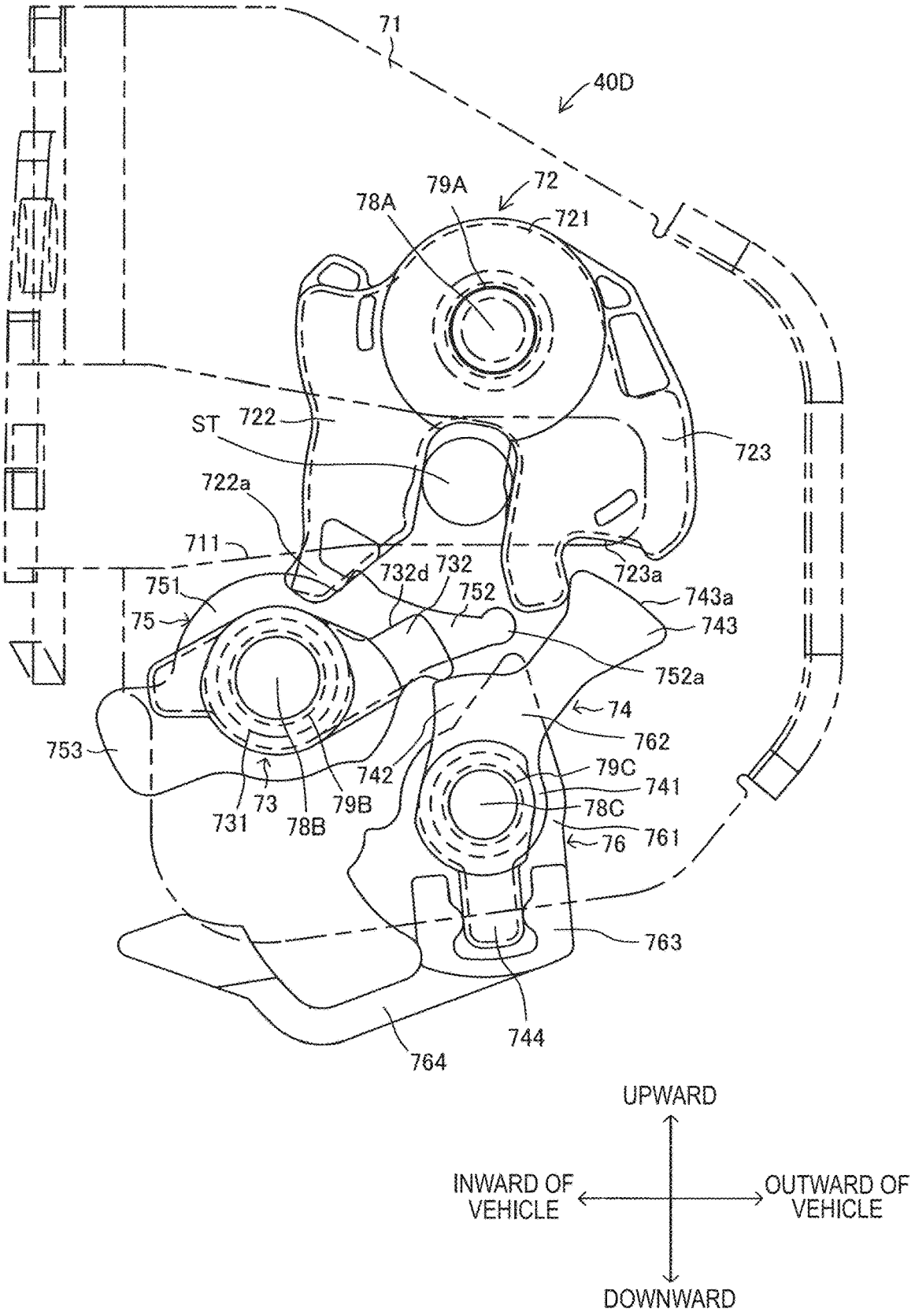
FIG. 31 is a rear view of the opening/closing mechanism which illustrates a state where a striker is further moved in the vehicle outward direction from a state illustrated in FIG. 30.

FIG. 31 is a rear view of the opening/closing mechanism 40D which illustrates a state where the vehicle door 10 performs the closing operation and the striker ST further moves in the vehicle outward direction from the state illustrated in FIG. 30. As illustrated in FIG. 31, if the striker ST further moves in the vehicle outward direction, the latch 72 further rotates in the counterclockwise direction. Then, the half latch engagement wall surface 743*a* of the half latch arm 743 is separated from the first engagement wall surface 723*a* of the half latch claw portion 723. Due to the rotation of the latch 72 in the counterclockwise direction, the half latch claw portion 723 moves to be shaken to the side in the vehicle outward direction. Accordingly, the engagement position between the half latch claw portion 723 and the half latch arm 743 also moves to the side in the vehicle outward direction. Therefore, the tip portion of the half latch arm 743 moves to the side in the vehicle outward direction. In this manner, the block lever 74 rotates in the clockwise direction from the restriction position.

Since the latch 72 rotates in the counterclockwise direction, the engagement protruding portion 722*a* of the full latch claw portion 722 of the latch 72 moves close to the pawl 73, and eventually, the engagement protruding portion 722*a* of the full latch claw portion 722 comes into contact with the upper side wall surface 732*d* of the first engagement arm 732 of the pawl 73.

Figure 32:
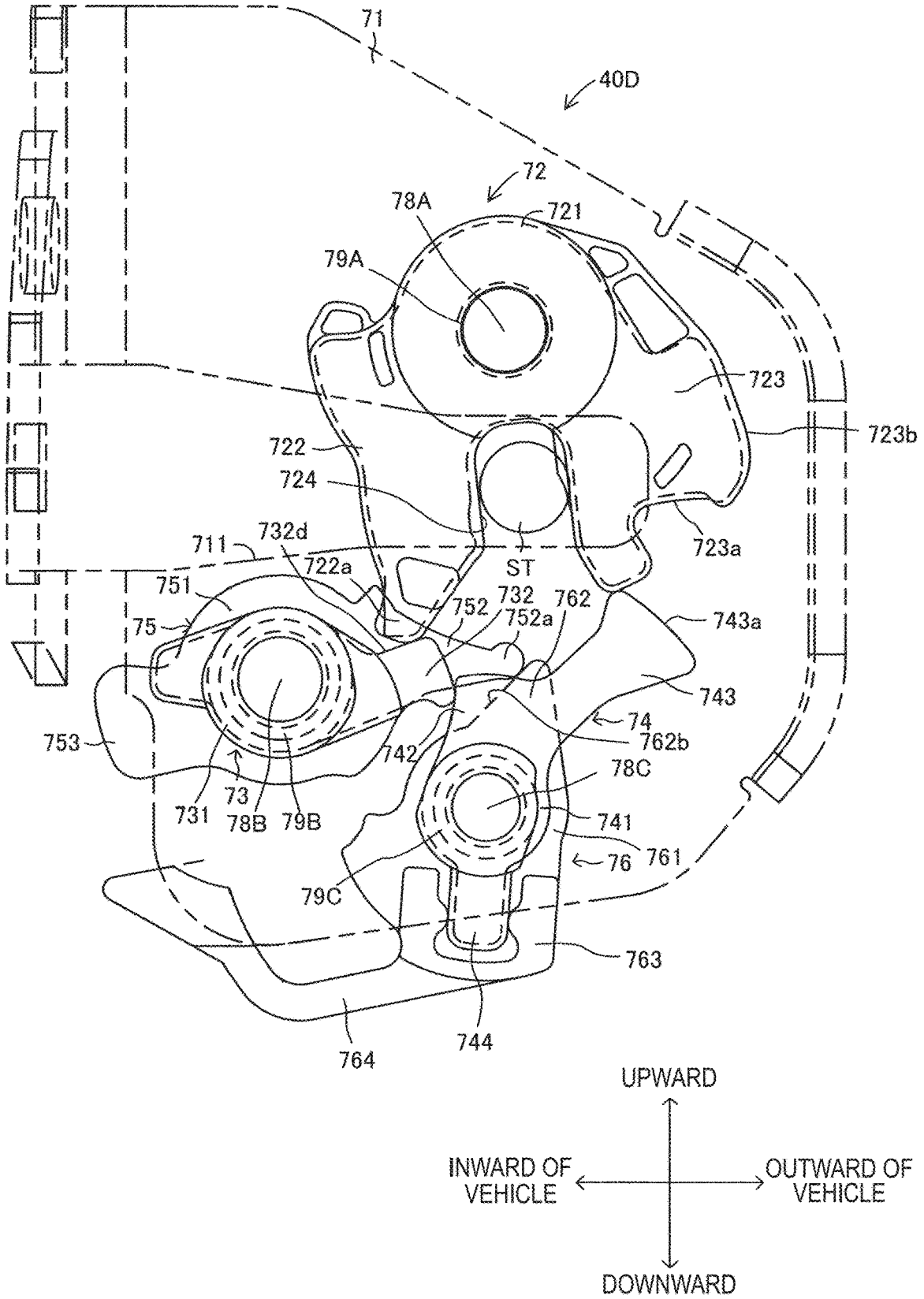
FIG. 32 is a rear view of the opening/closing mechanism which illustrates a state where an engagement protruding portion of a full latch claw portion abuts on an upper side wall surface of a first engagement arm of a pawl.

FIG. 32 is a rear view of the opening/closing mechanism 40D which illustrates a state where the engagement protruding portion 722*a* of the full latch claw portion 722 abuts on the upper side wall surface 732*d* of the first engagement arm 732 of the pawl 73. If the latch 72 further rotates in the counterclockwise direction from the state illustrated in FIG. 32, the first engagement arm 732 of the pawl 73 is pressed by the full latch claw portion 722, and rotates in the clockwise direction from the engagement position. In this manner, as in the first embodiment, the pawl 73 rotates from the engagement position to the disengagement position which is the rotation position where the pawl 73 is retreated from the rotation region of the full latch claw portion 722. In this way, the pawl 73 is rotatable from the engagement position where the pawl 73 enters the rotation region of the full latch claw portion 722 to the disengagement position where the pawl 73 is retreated from the rotation region of the full latch claw portion 722. When the pawl 73 rotates from the engagement position to the disengagement position as described above, the first engagement arm 732 of the pawl 73 rotates downward from the position illustrated in FIG. 32. However, when the pawl 73 and the full latch claw portion 722 abut on each other, the block lever 74 rotates in the clockwise direction. Accordingly, the block lever 74 moves to a position separated from the lower position of the pawl 73, that is, the non-restriction position where the block lever 74 is retreated from the rotation region of the pawl 73. That is, the block lever 74 is located at the non-restriction position when the pawl 73 rotates in the direction from the engagement position toward the disengagement position. Therefore, the rotation of the above-described pawl 73 is not hindered by the second engagement arm 742 of the block lever 74.

If the pawl 73 rotates in the clockwise direction, in response to the rotation, the pawl lift lever 75 also rotates in the clockwise direction. In this case, the engagement protruding portion 752*a* of the first extension arm 752 of the pawl lift lever 75 moves downward. Here, as can be understood from FIG. 31, before the pawl 73 and the full latch claw portion 722 engage with each other, the second extension arm 762 of the block lift lever 76 is located below the first extension arm 752 of the pawl lift lever 75. Therefore, the engagement protruding portion 752*a* of the first extension arm 752 moves downward as the pawl lift lever 75 rotates in the clockwise direction, and moves close to the second extension arm 762 of the block lift lever 76. When the full latch claw portion 722 presses the pawl 73 and the pawl 73 rotates toward the disengagement position, as illustrated in FIG. 32, the engagement protruding portion 752*a* of the first extension arm 752 of the pawl lift lever 75 abuts on the second extension arm 762 of the block lift lever 76. In this case, as can be understood from FIG. 32, the engagement protruding portion 752*a* of the pawl lift lever 75 abuts on the first inclined surface 762*b* of the second extension arm 762 of the block lift lever 76.

From the state illustrated in FIG. 32, the striker ST further moves in the vehicle outward direction, and the latch 72 rotates in the counterclockwise direction. Accordingly, the contact position between the engagement protruding portion 722*a* of the full latch claw portion 722 of the latch 72 and the upper side wall surface 732*d* of the first engagement arm 732 of the pawl 73 is shifted to the tip side of the first engagement arm 732, and eventually, the full latch claw portion 722 and the first engagement arm 732 of the pawl 73 disengage from each other. Then, the pawl 73 is completely pressed by the full latch claw portion 722. The pawl 73 rotates in the counterclockwise direction in accordance with the rotational biasing force of the pawl return spring 79B, and returns to the engagement position.

Figure 33:
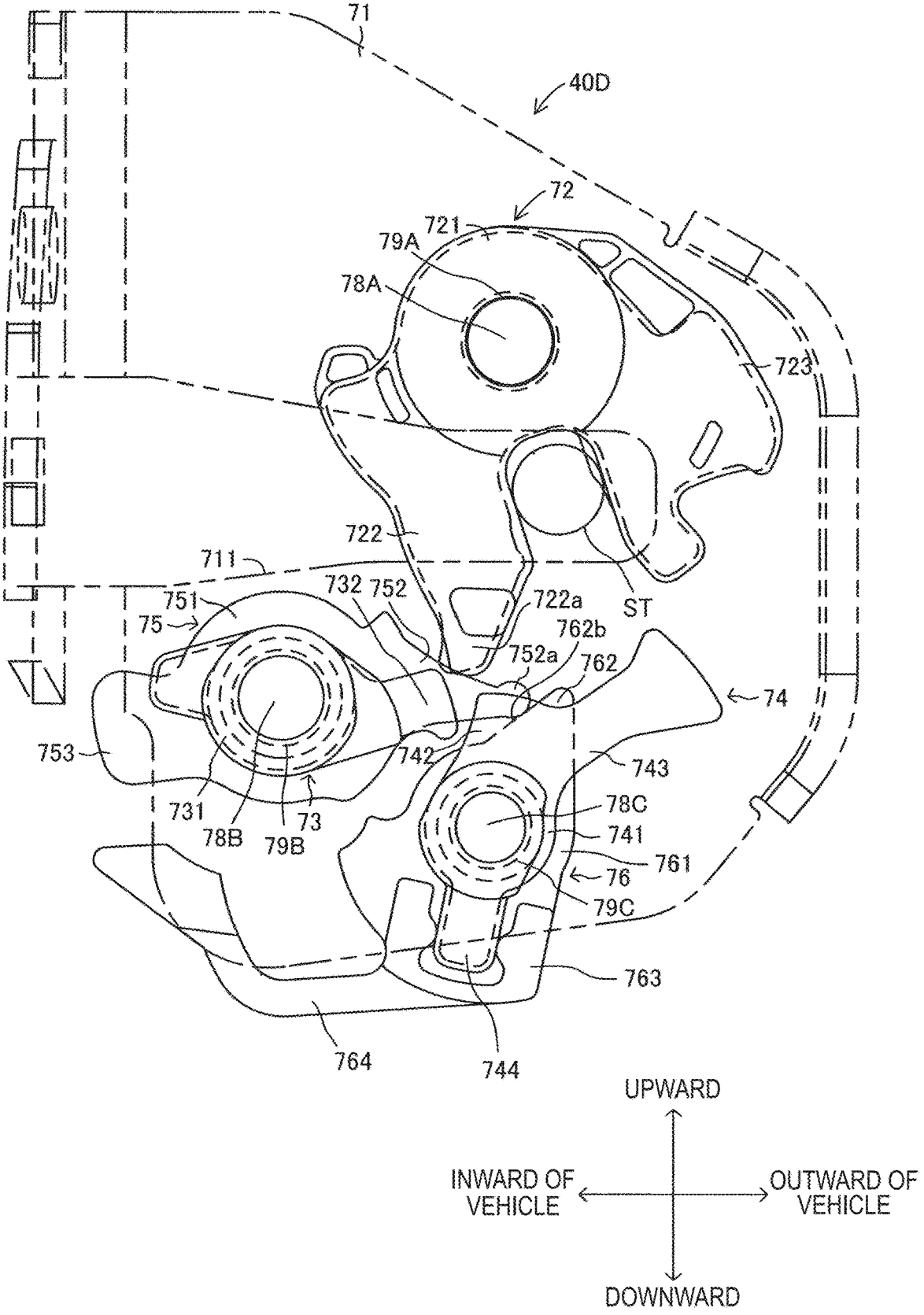
FIG. 33 is a rear view of the opening/closing mechanism which illustrates a state immediately after the full latch claw portion and the first engagement arm of the pawl disengage from each other.

FIG. 33 is a rear view of the opening/closing mechanism 40D which illustrates a state immediately after the full latch claw portion 722 and the first engagement arm 732 of the pawl 73 disengage from each other. The operation state of the opening/closing mechanism 40D illustrated in FIG. 33 shows a state after the disengagement and before the pawl 73 returns to the engagement position. In the state illustrated in FIG. 33, a state is maintained where the engagement protruding portion 752*a* of the first extension arm 752 of the pawl lift lever 75 abuts on the first inclined surface 762*b* of the second extension arm 762 of the block lift lever 76. Since the full latch claw portion 722 and the pawl 73 disengage from each other, the pawl 73 tries to rotate in the counterclockwise direction due to the rotational biasing force of the pawl return spring 79B. The half latch arm 743 of the block lever 74 is separated from the half latch claw portion 723 of the latch 72. Therefore, the block lever 74 and the block lift lever 76 receive the rotational biasing force generated by the block lever return spring 79C in the counterclockwise direction. The rotational biasing force is transmitted to the pawl lift lever 75 abutting on the second extension arm 762 of the block lift lever 76.

In a process where the operation state is changed from FIG. 32 to FIG. 33, the pawl lift lever 75 rotates in the clockwise direction in response to the rotation of the pawl 73 in the clockwise direction. In this manner, the second extension arm 762 of the block lift lever 76 abutting on the first extension arm 752 of the pawl lift lever 75 is pressed by the first extension arm 752, and rotates in the clockwise direction. In response to the rotation, the block lever 74 also rotates in the clockwise direction. Therefore, a distance increases between the first engagement arm 732 of the pawl 73 and the second engagement arm 742 of the block lever 74. As a result, the pawl 73 and the block lever 74 are not in contact with each other in the state illustrated in FIG. 33. Therefore, the frictional force generated by the contact between the pawl 73 and the block lever 74 is not generated.

On the other hand, as described above, in the state illustrated in FIG. 33, the pawl lift lever 75 rotating integrally with the pawl 73 abuts on the second extension arm 762 of the block lift lever 76 rotating integrally with the block lever 74 in the engagement protruding portion 752*a* of the first extension arm 752. Therefore, the pawl 73 receives the rotational biasing force of the block lever return spring 79C from the block lift lever 76 via the pawl lift lever 75.

Figure 34:
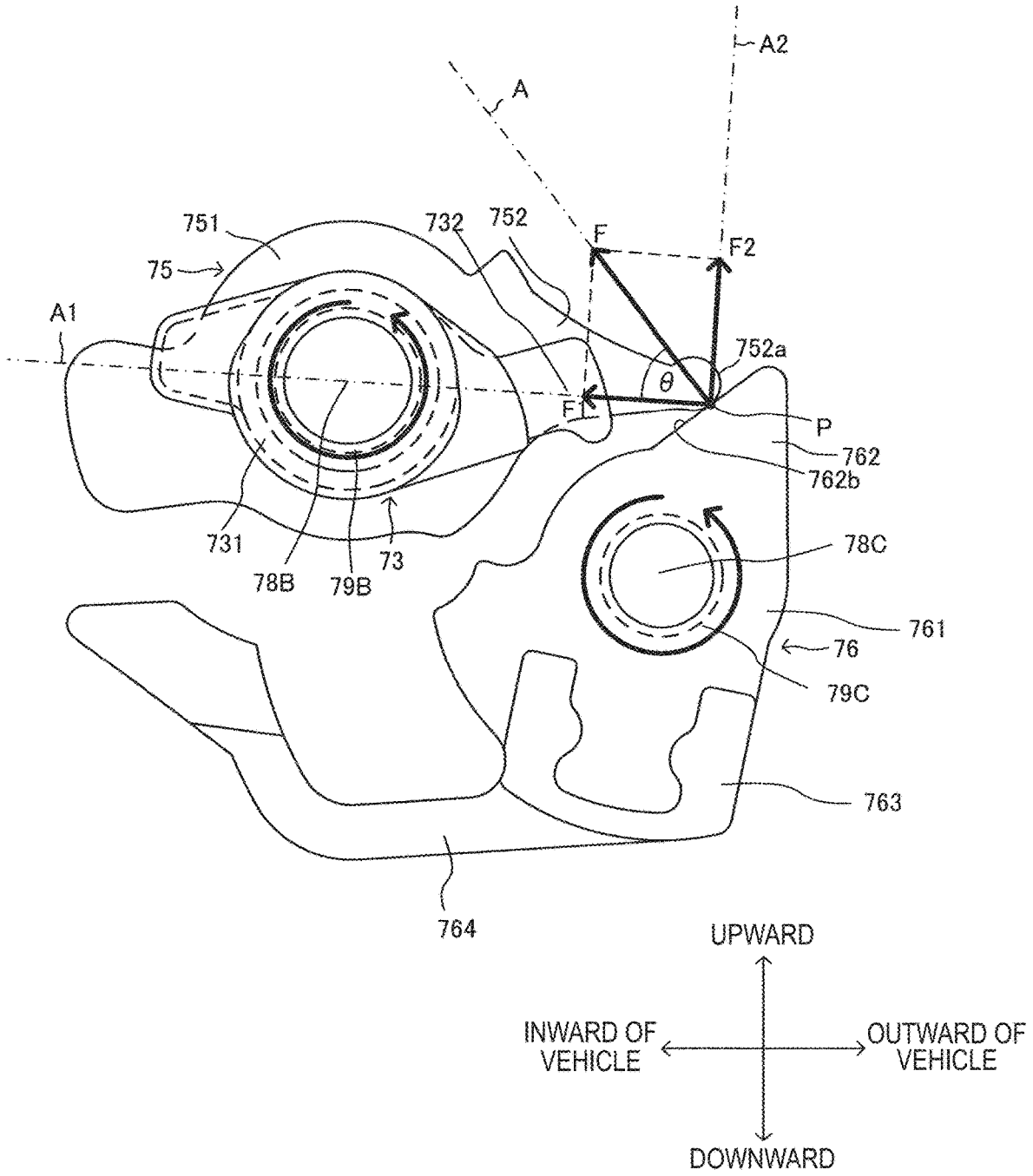
FIG. 34 is a view for describing a direction of a force received by the pawl in a state illustrated in FIG. 33 from the block lift lever.

FIG. 34 is a view for describing a direction of the biasing force received from the block lift lever 76 by the pawl 73 in the state illustrated in FIG. 33. In FIG. 34, a contact point between the engagement protruding portion 752*a* of the first extension arm 752 of the pawl lift lever 75 and the first inclined surface 762*b* of the second extension arm 762 of the block lift lever 76 is represented by a point P. A normal direction of the first inclined surface 762*b* at the contact point P is indicated by an arrow A in FIG. 34. The direction indicated by the arrow A is the direction of the force applied to the pawl 73 from the block lift lever 76. The direction indicated by the arrow A greatly deviates from the rotation center of the pawl 73 (axis of the pawl support shaft 78B).

A force F applied to the pawl 73 from the block lift lever 76 in which the application direction is indicated by the arrow A can be classified into a component force F1 applied from the contact point P to the rotation center of the pawl 73, that is, in a direction A1 toward the center of the pawl support shaft 78B, and a component force F2 applied in a direction A2 perpendicular to the component force F1.

The component force F1 generates the frictional force that hinders the rotational operation of the pawl 73. Therefore, in a case where the component force F1 is strong, there is a possibility that the pawl 73 may not smoothly rotate due to the frictional force. In the state illustrated in FIG. 34, the pawl 73 tries to rotate in the counterclockwise direction due to the rotational biasing force of the pawl return spring 79B. Therefore, in a case where the frictional force is strong, that is, in a case where the component force F1 is strong, the pawl 73 does not smoothly rotate in the counterclockwise direction. In this manner, there is an increasing possibility of the pseudo latch state or the completely fixed state. In this regard, according to the present embodiment, an angle θ formed between the application direction A1 of the component force F1 and the application direction A of the component force F is set to approximately 50°. Therefore, the component force F1 is weaker than the force F. Furthermore, the component force F2 is stronger than the component force F1. The component force F2 is a rotational driving force for rotating the pawl 73 in the counterclockwise direction. In this way, out of the force F applied to the pawl 73 from the block lift lever 76, the force F1 that hinders the rotation of the pawl 73 in the counterclockwise direction is weak. The force F2 that rotates the pawl 73 in the counterclockwise direction is stronger than the force F1 that hinders the rotation of the pawl 73 in the counterclockwise direction. Therefore, the component force F1 does not hinder the smooth rotation of the pawl 73, and the pawl 73 can smoothly rotate in the counterclockwise direction from the rotation positions illustrated in FIGS. 33 and 34. The pawl 73 separated from the latch 72 in this way and rotating in the counterclockwise direction is rotationally restricted at the engagement position engaging with the pawl stopper.

The above-described angle θ represents an angle at which the application direction (direction A in FIG. 34) of the biasing force (force F) of the block lever return spring 79C at the contact point P within the rotary plane between the pawl 73 and the block lever 74 is inclined with respect to the direction (direction A1 in FIG. 34) from the contact point P toward the rotation center of the pawl 73. Here, an inclination direction of the direction A with respect to the direction A1 is a direction including a component (component force F2) in which the force F applied in the direction A at the contact point P coincides with a direction of the pawl 73 rotating from the disengagement position to the engagement position, that is, a direction of the pawl 73 biased by the pawl return spring 79B. If the inclination angle is 45° or larger, it is possible to sufficiently reduce the force F1 serving as the frictional force component that hinders the rotation of the pawl 73 out of the force F. If the inclination angle is 45° or larger, a magnitude of the force F2 serving as a component that promotes the rotation of the pawl 73 out of the force F is equal to or greater than the force F1 serving as a component that hinders the rotation of the pawl 73. Therefore, it is possible to effectively prevent a possibility that the pawl 73 may not smoothly rotate due to the force F1.

The vehicle door 10 is substantially in the fully closed state at a position where the full latch claw portion 722 of the latch 72 is separated from the first engagement arm 732 of the pawl 73. Therefore, the striker ST stops moving, and the latch 72 tries to rotate in the clockwise direction in accordance with the rotational biasing force of the latch return spring 79A. The engagement protruding portion 722*a* disposed in the full latch claw portion 722 of the latch 72 which is rotationally biased in the clockwise direction in this way engages with the engagement wall surface 732*c* disposed in the first engagement arm 732 of the pawl 73 located at the engagement position. In this manner, the rotation of the latch 72 in the clockwise direction by the rotational biasing force of the latch return spring 79A is restricted. The position of the latch 72 whose rotation is restricted by the pawl 73 is defined as the full latch position. The operation state of the opening/closing mechanism 40D in which the rotation of the latch 72 in the clockwise direction at the full latch position is restricted is called the full latch state. In the full latch state, the vehicle door 10 is in the fully closed state. In the full latch state, the latch return spring 79A rotationally biases the latch 72 in the clockwise direction from the full latch position to the unlatch position.

Figure 35:
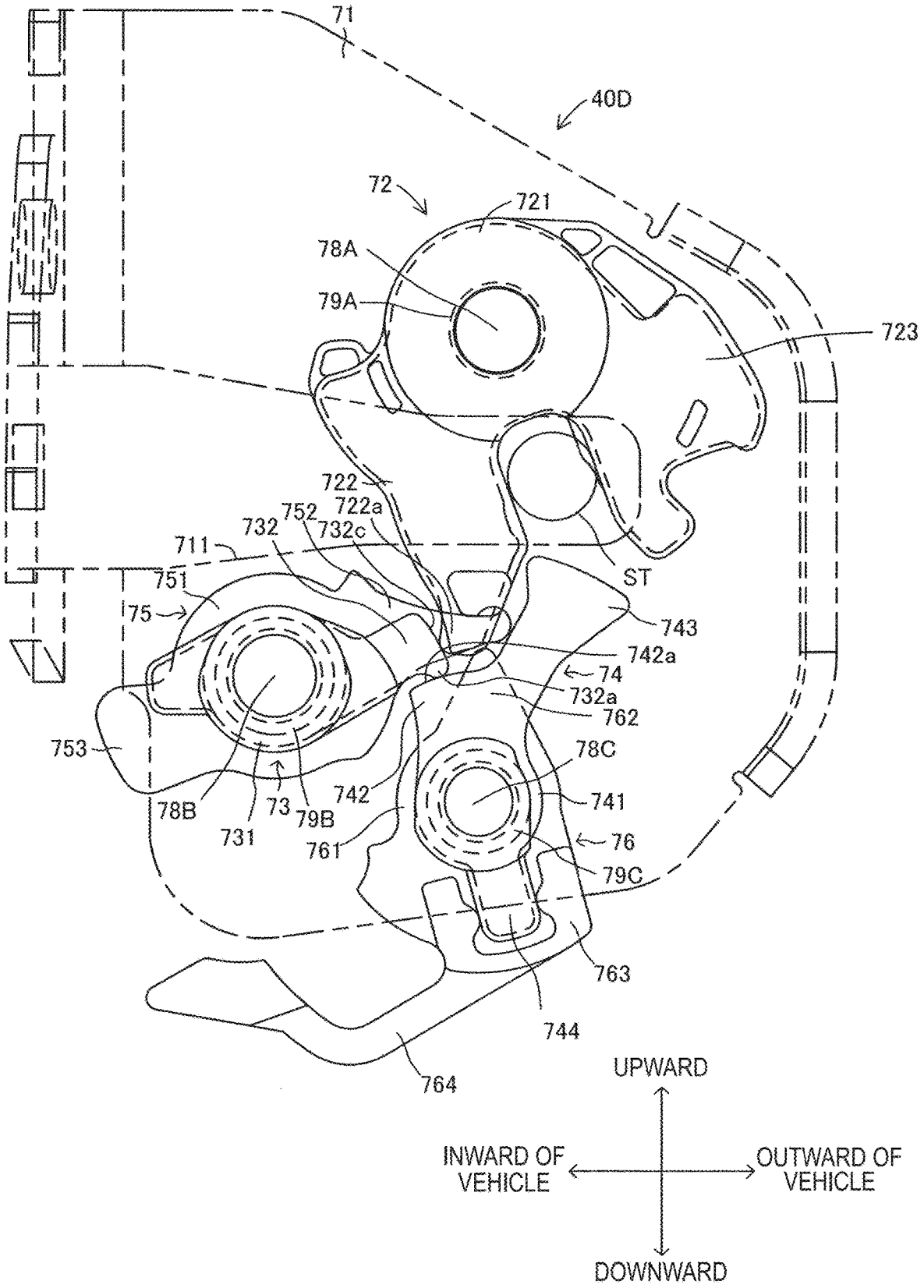
FIG. 35 is a rear view of the opening/closing mechanism in the full latch state.

FIG. 35 is a rear view of the opening/closing mechanism 40D in the full latch state. When the operation state of the opening/closing mechanism 40D is the full latch state illustrated in FIG. 35, the latch 72 located at the full latch position holds the striker ST so that the striker ST cannot be released. The pawl 73 rotates in the counterclockwise direction from the disengagement position illustrated in FIG. 33 to the engagement position illustrated in FIG. 35, and is rotationally restricted at the engagement position. In response to the rotation of the pawl 73 in the counterclockwise direction, the pawl lift lever 75 also rotates in the counterclockwise direction. In this manner, the pawl lift lever 75 is separated from the block lift lever 76. The block lever 74 rotates in the counterclockwise direction in response to the rotation of the block lift lever 76 from the non-restriction position illustrated in FIG. 33 due to the rotational biasing force of the block lever return spring 79C, and is rotationally restricted at the restriction position. In this case, the second engagement arm 742 of the block lever 74 is hidden under the first engagement arm 732 of the pawl 73 located at the engagement position.

When in the full latch state, due to the biasing force applied from the latch 72, the pawl 73 receives the rotating force in the direction against the rotational biasing force of the pawl return spring 79B, that is, the rotating force in the clockwise direction. In this manner, the first engagement arm 732 of the pawl 73 tries to rotate around the pawl support shaft 78B so that the tip side faces downward in FIG. 35. On the other hand, in the full latch state illustrated in FIG. 35, the block lever 74 located at the restriction position is hidden under the first engagement arm 732 of the pawl 73 located at the engagement position. Therefore, the rotation of the first engagement arm 732 is restricted since the engagement protruding portion 732*a* of the first engagement arm 732 abuts on the abutting wall surface 742*a* of the second engagement arm 742 of the block lever 74. In this way, the pawl 73 restricts the rotation of the latch 72, and the block lever 74 restricts the rotation of the pawl 73.

In the opening/closing mechanism 40D according to the present embodiment, as illustrated in FIG. 33, after the full latch claw portion 722 of the latch 72 and the first engagement arm 732 of the pawl 73 disengage from each other, the pawl 73 and the block lever 74 do not come into direct contact with each other, thereby realizing a state where the pawl lift lever 75 and the block lift lever 76 are in contact with each other. At the contact point P between the pawl lift lever 75 and the block lift lever 76, the application direction (direction A) of the biasing force applied from the block lift lever 76 to the pawl lift lever 75 is inclined with respect to the direction (direction A1) from the contact point P toward the rotation center of pawl 73. The inclination angle in the direction A with respect to the direction A1 is preferably 45° or larger. According to the present embodiment, the inclination angle is 50°. Therefore, out of the force F applied to the pawl 73, the force F1 which generates the frictional force that hinders the rotation of the pawl 73 is weak. The force F2 that rotates the pawl 73 toward the engagement position in the counterclockwise direction is stronger than the force F1. Therefore, the pawl 73 separated from the full latch claw portion 722 smoothly rotates in the counterclockwise direction. In this manner, the full latch state is promptly realized. In other words, it is possible to reduce a possibility that the operation state may fall into the pseudo latch state or the completely fixed state since the rotational operation of the pawl 73 is not smoothly performed. Therefore, it is possible to effectively prevent a disadvantage caused by the operation state falling into the pseudo latch state or the completely fixed state.

In a case where the vehicle door 10 in the fully closed state is opened, the door outside handle 17 or the door inside handle disposed in the vehicle door 10 is rotated from the initial position to the opening position. In this manner, the operation lever is operated inside the locking/unlocking mechanism 30 of the vehicle door lock device 20, and the block lever 74 rotates in the clockwise direction.

Figure 36:
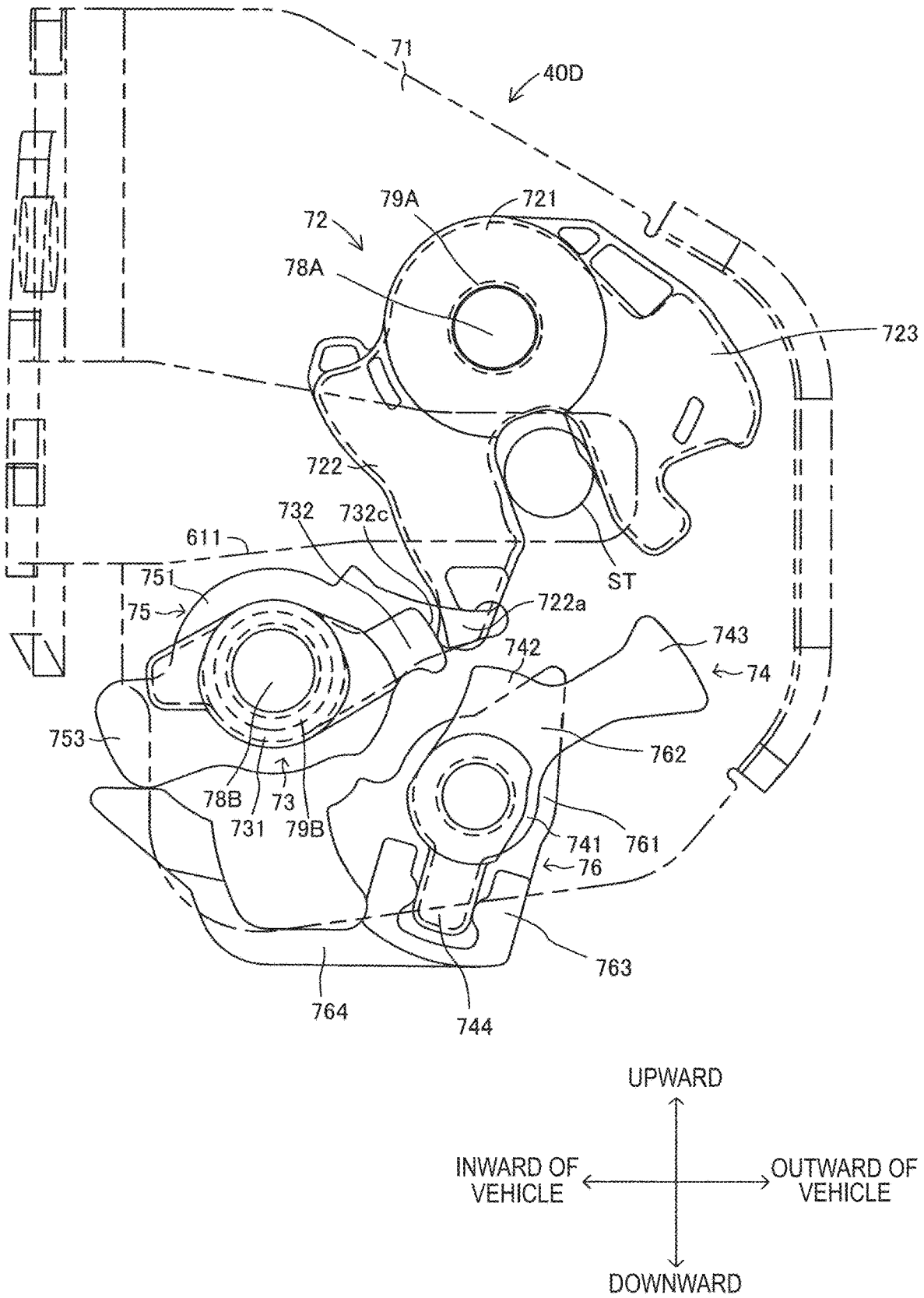
FIG. 36 is a rear view of the opening/closing mechanism which illustrates a state where the block lever of the opening/closing mechanism in the full latch state rotates in the clockwise direction.

FIG. 36 is a rear view of the opening/closing mechanism 40D which illustrates a state where the block lever 74 of the opening/closing mechanism 40D in the full latch state rotates in the clockwise direction. As illustrated in FIG. 36, if the block lever 74 rotates in the clockwise direction, the second engagement arm 742 of the block lever 74 is separated from the first engagement arm 732 of the pawl 73. In this manner, the pawl 73 and the pawl lift lever 75 rotate in the clockwise direction by receiving the biasing force input from the latch 72 and the elastic reaction force of the weather strip installed in the peripheral edge of the vehicle door 10. Even in a case where the pawl 73 is not rotated by the input load, the third extension arm 764 of the block lift lever 76 rotating in response to the rotation of the block lever 74 presses the connecting arm 753 of the pawl lift lever 75 as illustrated in FIG. 36. In this manner, the pawl 73 and the pawl lift lever 75 rotate in the clockwise direction.

If the pawl 73 rotates in the clockwise direction in this way, the engagement protruding portion 722*a* disposed in the full latch claw portion 722 of the latch 72 and the engagement wall surface 732*c* formed in the first engagement arm 732 of the pawl 73 disengage from each other. In this manner, the latch 72 rotates in the clockwise direction in accordance with the rotational biasing force of the latch return spring 79A. As illustrated in FIG. 36, the half latch arm 743 is retreated from the rotation region of the latch 72 by the rotation of the block lever 74. Accordingly, the rotation of the latch 72 in the clockwise direction is not restricted by the half latch arm 743. Therefore, the latch 72 is located again at the unlatch position. In this case, the striker ST can be separated from the striker holding recess portion 724 of the latch 72, and can move the striker entering groove 711 in the vehicle outward direction. Accordingly, the vehicle door 10 can be opened.

According to the present embodiment, the following state is realized. When the full latch claw portion 722 of the latch 72 presses the pawl 73 in response to the closing operation of the vehicle door 10 and the pawl 73 rotates from the engagement position toward the disengagement position, as illustrated in FIG. 33, the pawl 73 and the block lever 74 do not come into contact with each other. The first extension arm 752 of the pawl lift lever 75 and the second extension arm 762 of the block lift lever 76 are in contact with each other. In this case, as illustrated in FIG. 34, the direction (direction A) of the force F applied to the first extension arm 752 from the second extension arm 762 at the contact point P is inclined by 45° or larger with respect to the direction (direction A1) from the contact point P toward the rotation center of the pawl 73. Therefore, out of the force F, the magnitude of the component force F1 applied as the frictional force to the first extension arm 752 is reduced. Accordingly, the rotational operation toward the disengagement position of the pawl 73 rotating integrally with the pawl lift lever 75 is smoothly performed by the frictional force generated at the above-described contact point P. As a result, it is possible to avoid a possibility that the operation state may fall into the pseudo latch state or the completely fixed state during the closing operation of the vehicle door 10. Accordingly, it is possible to prevent a disadvantage caused by the engagement between the pawl 73 and the block lever 74 when the vehicle door 10 is closed.

A vehicle door lock device according to an aspect of this disclosure includes a latch, a pawl, a block lever, and a half latch lever. The latch has a full latch claw portion and a half latch claw portion, engages with a striker attached to a vehicle body during a closing operation of a vehicle door, is rotatable between an unlatch position serving as a rotation position where the engaged striker is releasable and a full latch position serving as a rotation position where the striker is held not to be releasable, and rotates from the unlatch position to the full latch position by the engaged striker moving in response to the closing operation of the vehicle door. The pawl is rotatable between an engagement position serving as a rotation position where the pawl enters a rotation region of the full latch claw portion and a disengagement position serving as a rotation position where the pawl is retreated from the rotation region of the full latch claw portion, is pressed by the full latch claw portion to rotate in a direction from the engagement position toward the disengagement position when the latch rotates in a direction from the unlatch position to the full latch position, engages with the full latch claw portion of the latch located at the full latch position by rotating from the disengagement position to the engagement position after the pressing of the full latch claw portion is completed when the latch is located at the full latch position, thereby restricting the rotation of the latch in a direction toward the unlatch position. The block lever is rotatable between a restriction position serving as a rotation position where the block lever enters a rotation region of the pawl and a non-restriction position serving as a rotation position where the block lever is retreated from the rotation region of the pawl, is located at the non-restriction position when the pawl rotates in a direction from the engagement position toward the disengagement position, engages with the pawl located at the engagement position by rotating from the non-restriction position to the restriction position when the pawl is located at the engagement position by rotating from the disengagement position to the engagement position, thereby restricting the rotation of the pawl in a direction toward the disengagement position. The half latch lever is rotatable between an operation position inside an operation region serving as a rotation region for restricting the rotation of the latch in a direction toward the unlatch position by entering the rotation region of the half latch claw portion and engaging with the half latch claw portion when the latch is located at the half latch position serving as a rotation position for holding the striker not to be releasable, which is the rotation position between the unlatch position and the full latch position, and a non-operation position inside a non-operation region serving as a rotation region where the half latch lever is retreated from the rotation region of the half latch claw portion, and that is located at the operation position when the rotation position of the latch is located at the rotation position from the half latch position to the full latch position during the closing operation of the vehicle door.

According to the aspect of this disclosure, when the rotation position of the latch is located from the half latch position to the full latch position during the closing operation of the vehicle door, the half latch lever enters the rotation region of the half latch claw portion, and is located at the operation position where the half latch lever can engage with the half latch claw portion. When the vehicle door lock device is in a pseudo latch state described above, the rotation position of the latch is located between the half latch position and the full latch position. Therefore, the half latch lever is located at the operation position when the vehicle door lock device is in the pseudo latch state during the closing operation of the vehicle door. Accordingly, in a case where the latch rotates in the direction toward the unlatch position by releasing the pseudo latch state, the half latch claw portion of the latch engages with the half latch lever located at the operation position. In this manner, the latch is rotationally restricted at the half latch position. Therefore, the vehicle door is brought into a half closed state, and the vehicle door can be prevented from being opened. In this way, according to the aspect of this disclosure, it is possible to provide the vehicle door lock device which can prevent a disadvantage that the vehicle door may be opened in a case where the vehicle door lock device is brought into the pseudo latch state.

In the aspect of this disclosure, the "operation position" of the half latch lever may be the rotation position where at least a portion of the half latch lever enters the rotation region of the half latch claw portion of the latch located at the half latch position. Therefore, for example, the rotation position where a whole surface of a wall surface (half latch engagement wall surface) on which the half latch lever can engage with the half latch claw portion enters the rotation region of the half latch claw portion is the operation position inside the operation region. The rotation position where a portion of the half latch engagement wall surface enters the rotation region of the half latch claw portion is also the operation position inside the operation region.

The half latch lever may be configured to be located at the non-operation position (non-operation region) when the rotation position of the latch is located closer to the unlatch position side than the half latch position during the closing operation of the vehicle door.

The vehicle door lock device according to the aspect of this disclosure may include a half latch lever biasing member that rotationally biases the half latch lever in a direction from the non-operation position toward the operation position, and a half latch stopper for restricting the rotation of the half latch lever rotated in the direction from the non-operation position toward the operation position by a rotational biasing force of the half latch lever biasing member, at the operation position. In this case, a configuration may be adopted as follows. The half latch lever is rotationally biased by the half latch lever biasing member in the direction from the non-operation position toward the operation position when the rotation position of the latch is the rotation position from the half latch position to the full latch position during the closing operation of the vehicle door. The half latch lever is rotationally restricted by the half latch stopper. In this manner, the half latch lever is located at the operation position. According to this configuration, when the rotation position of the latch is located at the rotation position from the half latch position to the full latch position, the half latch lever can be located at the operation position by the rotational biasing force of the half latch lever biasing member and the rotational restriction of the half latch stopper.

The half latch lever may be configured to be coaxially rotatable with the block lever, and may have a coupling piece which engages with the block lever. The coupling piece may be configured to engage with the block lever rotating in a direction from the restriction position toward the non-restriction position when the half latch lever is located at the operation position, and may be configured not to engage with the block lever rotating in a direction from the non-restriction position toward the restriction position when the half latch lever rotates in a direction from the operation position toward the non-operation position and the half latch lever is located at the operation position. According to this configuration, in a case where the block lever rotates from the restriction position to the non-restriction position during an opening operation of the vehicle door, the block lever engages with the coupling piece of the half latch lever. In this manner, the half latch lever located at the operation position rotates in the direction toward the non-operation position. In this manner, the half latch lever remains at the operation position when the vehicle door is opened, thereby preventing the latch from engaging with the half latch lever at the half latch position. When the block lever rotates in the direction from the non-restriction position toward the restriction position during the closing operation of the vehicle door, the block lever does not engage with the coupling piece of the half latch lever located at the operation position. Therefore, a case is effectively prevented as follows. The block lever is prevented from rotating in the direction toward the restriction position of the block lever after engaging with the coupling piece of the half latch lever located at the operation position.

The half latch lever may be configured to be rotatable around a rotary shaft different from a rotary shaft of the block lever. In this case, the vehicle door lock device according to the aspect of this disclosure may include a rotation transmission mechanism that transmits the rotation of the block lever to the half latch lever so that the half latch lever rotates in a direction from the operation position toward the non-operation position in a case where the block lever rotates from the restriction position to the non-restriction position.

According to this configuration, the half latch lever is rotatable around the rotary shaft different from that of the block lever. Therefore, the half latch lever can rotate independently of the block lever. Therefore, the half latch lever can rotate in the direction toward the operation position without being affected by a rotational operation of the block lever. The block lever is caused to rotate from the restriction position to the non-restriction position when the latch is located at the full latch position. In this manner, the half latch lever rotates to the non-operation position via the rotation transmission mechanism. Therefore, the latch is prevented from engaging with the half latch lever at the half latch position due to the half latch lever remaining at the operation position when the vehicle door is opened.

A vehicle door lock device according to another aspect of this disclosure includes a latch, a pawl, a block lever, a pawl lift lever, a block lift lever, and a block lever biasing member. The pawl lift lever is connected to the pawl so as to rotate integrally with the pawl, and has a first extension arm extending radially outward from a rotation center of the pawl. The block lift lever is connected to the block lever so as to rotate integrally with the block lever, and has a second extension arm extending radially outward from a rotation center of the block lever. The block lever biasing member rotationally biases the block lever together with the block lift lever in a direction from the non-restriction position toward the restriction position. The first extension arm and the second extension arm come into contact with each other when the pawl rotates toward the disengagement position, and are configured so that a biasing force of the block lever biasing member is applied from the second extension arm to the first extension arm at a contact point therebetween. The first extension arm and the second extension arm are configured so that an application direction of the biasing force at the contact point between the first extension arm and the second extension arm within a rotary plane between the pawl and the block lever is inclined with respect to a direction from the contact point toward the rotation center of the pawl.

According to the aspect of this disclosure, when the full latch claw portion of the latch presses the pawl in response to the closing operation of the vehicle door so that the pawl rotates from the engagement position toward the disengagement position, the first extension arm of the pawl lift lever and the second extension arm of the block lift lever come into contact with each other. In this case, the biasing force of the block lever biasing member is applied from the second extension arm to the first extension arm at the contact point. Here, a biasing direction of the biasing force at the contact point is inclined with respect to the direction from the contact point toward the rotation center of the pawl. Therefore, a component force applied to the first extension arm as a frictional force out of the above-described biasing force is reduced. Accordingly, the rotational operation toward the disengagement position of the pawl that rotates integrally with the pawl lift lever is smoothly performed by the frictional force generated at the contact point. As a result, it is possible to avoid the vehicle door lock device from being brought into the pseudo latch state or the completely fixed state during the closing operation of the vehicle door. In this way, according to the aspect of this disclosure, it is possible to provide the vehicle door lock device which can prevent a disadvantage caused by the engagement between the pawl and the block lever when the vehicle door is closed.

Hitherto, the embodiments disclosed here and modification examples thereof have been described. However, the embodiments and the modification examples are merely specific examples for embodying this disclosure, and this disclosure is not to be considered as being limited by the examples. This disclosure can be modified unless this disclosure departs from the technical idea or the main features.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door lock device comprising:

a latch that has a full latch claw portion and a half latch claw portion, that engages with a striker attached to a vehicle body during a closing operation of a vehicle door, that is rotatable between an unlatch position serving as a rotation position where the engaged striker is releasable and a full latch position serving as a rotation position where the striker is held not to be releasable, and that rotates from the unlatch position to the full latch position by the engaged striker moving in response to the closing operation of the vehicle door;

a pawl that is rotatable between an engagement position serving as a rotation position where the pawl enters a rotation region of the full latch claw portion and a disengagement position serving as a rotation position where the pawl is retreated from the rotation region of the full latch claw portion, that is pressed by the full latch claw portion to rotate in a direction from the engagement position toward the disengagement position when the latch rotates in a direction from the unlatch position to the full latch position, and that engages with the full latch claw portion of the latch located at the full latch position by rotating from the disengagement position to the engagement position after the pressing of the full latch claw portion is completed when the latch is located at the full latch position, thereby restricting the rotation of the latch in a direction toward the unlatch position;

a block lever that is rotatable between a restriction position serving as a rotation position where the block lever enters a rotation region of the pawl and a non-restriction position serving as a rotation position where the block lever is retreated from the rotation region of the pawl, that is located at the non-restriction position when the pawl rotates in a direction from the engagement position toward the disengagement position, that engages with the pawl located at the engagement position by rotating from the non-restriction position to the restriction position when the pawl is located at the engagement position by rotating from the disengagement position to the engagement position, thereby restricting the rotation of the pawl in a direction toward the disengagement position; and a half latch lever that is rotatable between an operation position inside an operation region serving as a rotation region for restricting the rotation of the latch in a direction toward the unlatch position by entering the rotation region of the half latch claw portion and engaging with the half latch claw portion when the latch is located at a half latch position serving as a rotation position for holding the striker not to be releasable, which is the rotation position between the unlatch position and the full latch position, and a non-operation position inside a non-operation region serving as a rotation region where the half latch lever is retreated from the rotation region of the half latch claw portion, and that is located at the operation position when the rotation position of the latch is located at the rotation position from the half latch position to the full latch position during the closing operation of the vehicle door, wherein the half latch lever is configured to be rotatable around a rotary shaft that is 1) different from a rotary shaft of the block lever and 2) different from a rotary shaft of the pawl, the vehicle door lock device further comprises a rotation transmission mechanism that transmits the rotation of the block lever to the half latch lever so that the half latch lever rotates in a direction from the operation position toward the non-operation position in a case where the block lever rotates from the restriction position to the non-restriction position, and a rotation direction of the latch from the unlatch position to the full latch position is opposite a rotation direction of the block lever from the restriction position to the non-restriction position.

2. The vehicle door lock device according to claim 1, further comprising:

a half latch lever biasing member that rotationally biases the half latch lever in a direction from the non-operation position toward the operation position; and a half latch stopper for restricting the rotation of the half latch lever rotated in the direction from the non-operation position toward the operation position by a rotational biasing force of the half latch lever biasing member, at the operation position.

3. The vehicle door lock device according to claim 1, further comprising a block lift lever that is connected to the block lever so as to rotate integrally with the block lever, and that has an extension arm extending radially outward from a rotation center of the block lever, wherein the rotation transmission mechanism comprises an engagement pin disposed on the extension arm and configured to slidably engage with an engagement groove formed on the half latch lever.

4. The vehicle door lock device according to claim 1, wherein the rotation direction of the latch from the unlatch position to the full latch position is the same as a rotation direction of the half latch lever from the operation position to the non-operation position.

5. The vehicle door lock device according to claim 1, wherein a rotation direction of the pawl from the engagement position to the disengagement position is the same as the rotation direction of the block lever from the restriction position to the non-restriction position.

6. The vehicle door lock device according to claim 1, wherein a rotation direction of the pawl from the engagement position to the disengagement position is opposite a rotation direction of the half latch lever from the operation position to the non-operation position.

7. A vehicle door lock device comprising:

a latch that has a full latch claw portion and a half latch claw portion, that engages with a striker attached to a vehicle body during a closing operation of a vehicle door, that is rotatable between an unlatch position serving as a rotation position where the engaged striker is releasable and a full latch position serving as a rotation position where the striker is held not to be releasable, and that rotates from the unlatch position to the full latch position by the engaged striker moving in response to the closing operation of the vehicle door;

a pawl that is rotatable between an engagement position serving as a rotation position where the pawl enters a rotation region of the full latch claw portion and a disengagement position serving as a rotation position where the pawl is retreated from the rotation region of the full latch claw portion, that is pressed by the full latch claw portion to rotate in a direction from the engagement position toward the disengagement position when the latch rotates in a direction from the unlatch position to the full latch position, and that engages with the full latch claw portion of the latch located at the full latch position by rotating from the disengagement position to the engagement position after the pressing of the full latch claw portion is completed when the latch is located at the full latch position, thereby restricting the rotation of the latch in a direction toward the unlatch position;

a block lever that is rotatable between a restriction position serving as a rotation position where the block lever enters a rotation region of the pawl and a non-restriction position serving as a rotation position where the block lever is retreated from the rotation region of the pawl, that is located at the non-restriction position when the pawl rotates in a direction from the engagement position toward the disengagement position, that engages with the pawl located at the engagement position by rotating from the non-restriction position to the restriction position when the pawl is located at the engagement position by rotating from the disengagement position to the engagement position, thereby restricting the rotation of the pawl in a direction toward the disengagement position; and a half latch lever that is rotatable between an operation position inside an operation region serving as a rotation region for restricting the rotation of the latch in a direction toward the unlatch position by entering the rotation region of the half latch claw portion and engaging with the half latch claw portion when the latch is located at a half latch position serving as a rotation position for holding the striker not to be releasable, which is the rotation position between the unlatch position and the full latch position, and a non-operation position inside a non-operation region serving as a rotation region where the half latch lever is retreated from the rotation region of the half latch claw portion, and that is located at the operation position when the rotation position of the latch is located at the rotation position from the half latch position to the full latch position during the closing operation of the vehicle door, wherein the half latch lever is configured to be rotatable around a rotary shaft that is 1) different from a rotary shaft of the block lever and 2) different from a rotary shaft of the pawl, the vehicle door lock device further comprises a rotation transmission mechanism that transmits the rotation of the block lever to the half latch lever so that the half latch lever rotates in a direction from the operation position toward the non-operation position in a case where the block lever rotates from the restriction position to the non-restriction position, and a rotation direction of the latch from the unlatch position to the full latch position is the same as a rotation direction of the half latch lever from the operation position to the non-operation position.

8. The vehicle door lock device according to claim 7, further comprising:

a half latch lever biasing member that rotationally biases the half latch lever in a direction from the non-operation position toward the operation position; and a half latch stopper for restricting the rotation of the half latch lever rotated in the direction from the non-operation position toward the operation position by a rotational biasing force of the half latch lever biasing member, at the operation position.

9. The vehicle door lock device according to claim 7, further comprising a block lift lever that is connected to the block lever so as to rotate integrally with the block lever, and that has an extension arm extending radially outward from a rotation center of the block lever, wherein the rotation transmission mechanism comprises an engagement pin disposed on the extension arm and configured to slidably engage with an engagement groove formed on the half latch lever.

10. The vehicle door lock device according to claim 7, wherein a rotation direction of the pawl from the engagement position to the disengagement position is the same as a rotation direction of the block lever from the restriction position to the non-restriction position.

11. The vehicle door lock device according to claim 7, wherein a rotation direction of the pawl from the engagement position to the disengagement position is opposite the rotation direction of the half latch lever from the operation position to the non-operation position.

12. A vehicle door lock device comprising:

a latch that has a full latch claw portion and a half latch claw portion, that engages with a striker attached to a vehicle body during a closing operation of a vehicle door, that is rotatable between an unlatch position serving as a rotation position where the engaged striker is releasable and a full latch position serving as a rotation position where the striker is held not to be releasable, and that rotates from the unlatch position to the full latch position by the engaged striker moving in response to the closing operation of the vehicle door;

a pawl that is rotatable between an engagement position serving as a rotation position where the pawl enters a rotation region of the full latch claw portion and a disengagement position serving as a rotation position where the pawl is retreated from the rotation region of the full latch claw portion, that is pressed by the full latch claw portion to rotate in a direction from the engagement position toward the disengagement position when the latch rotates in a direction from the unlatch position to the full latch position, and that engages with the full latch claw portion of the latch located at the full latch position by rotating from the disengagement position to the engagement position after the pressing of the full latch claw portion is completed when the latch is located at the full latch position, thereby restricting the rotation of the latch in a direction toward the unlatch position;

a block lever that is rotatable between a restriction position serving as a rotation position where the block lever enters a rotation region of the pawl and a non-restriction position serving as a rotation position where the block lever is retreated from the rotation region of the pawl, that is located at the non-restriction position when the pawl rotates in a direction from the engagement position toward the disengagement position, that engages with the pawl located at the engagement position by rotating from the non-restriction position to the restriction position when the pawl is located at the engagement position by rotating from the disengagement position to the engagement position, thereby restricting the rotation of the pawl in a direction toward the disengagement position; and a half latch lever that is rotatable between an operation position inside an operation region serving as a rotation region for restricting the rotation of the latch in a direction toward the unlatch position by entering the rotation region of the half latch claw portion and engaging with the half latch claw portion when the latch is located at a half latch position serving as a rotation position for holding the striker not to be releasable, which is the rotation position between the unlatch position and the full latch position, and a non-operation position inside a non-operation region serving as a rotation region where the half latch lever is retreated from the rotation region of the half latch claw portion, and that is located at the operation position when the rotation position of the latch is located at the rotation position from the half latch position to the full latch position during the closing operation of the vehicle door, wherein the half latch lever is configured to be rotatable around a rotary shaft that is 1) different from a rotary shaft of the block lever and 2) different from a rotary shaft of the pawl, the vehicle door lock device further comprises a rotation transmission mechanism that transmits the rotation of the block lever to the half latch lever so that the half latch lever rotates in a direction from the operation position toward the non-operation position in a case where the block lever rotates from the restriction position to the non-restriction position, and a rotation direction of the pawl from the engagement position to the disengagement position is the same as a rotation direction of the block lever from the restriction position to the non-restriction position.

13. The vehicle door lock device according to claim 12, further comprising:

a half latch lever biasing member that rotationally biases the half latch lever in a direction from the non-operation position toward the operation position; and a half latch stopper for restricting the rotation of the half latch lever rotated in the direction from the non-operation position toward the operation position by a rotational biasing force of the half latch lever biasing member, at the operation position.

14. The vehicle door lock device according to claim 12, further comprising a block lift lever that is connected to the block lever so as to rotate integrally with the block lever, and that has an extension arm extending radially outward from a rotation center of the block lever, wherein the rotation transmission mechanism comprises an engagement pin disposed on the extension arm and configured to slidably engage with an engagement groove formed on the half latch lever.

15. The vehicle door lock device according to claim 12, wherein the rotation direction of the pawl from the engagement position to the disengagement position is opposite a rotation direction of the half latch lever from the operation position to the non-operation position.

* * * * *